US010822862B2

(12) United States Patent
Header

(10) Patent No.: US 10,822,862 B2
(45) Date of Patent: Nov. 3, 2020

(54) CONTINUOUS SILL FOR DOORS WITH SIDELITES

(71) Applicant: Gregory A Header, Richland, PA (US)

(72) Inventor: Gregory A Header, Richland, PA (US)

( * ) Notice: Subject to any disclaimer, the term of this patent is extended or adjusted under 35 U.S.C. 154(b) by 81 days.

(21) Appl. No.: 16/283,766

(22) Filed: Feb. 23, 2019

(65) Prior Publication Data

US 2020/0270932 A1 Aug. 27, 2020

(51) Int. Cl.
*E06B 3/32* (2006.01)
*E06B 1/70* (2006.01)

(52) U.S. Cl.
CPC ..... *E06B 1/70* (2013.01); *E06B 2001/707* (2013.01)

(58) Field of Classification Search
CPC ..... E06B 1/70; E06B 2001/707
USPC ..... 49/467; 52/204.51
See application file for complete search history.

(56) References Cited

U.S. PATENT DOCUMENTS 258,486 A 5/1882 Singer
2,202,482 A 12/1938 Dahl
2,648,107 A 8/1953 Bates
3,032,839 A 5/1962 Miller
3,811,238 A 5/1974 Brinker
3,851,420 A 12/1974 Tibbets
4,237,664 A 12/1980 Wilmes
4,555,882 A 12/1985 Moffitt et al.
4,945,680 A * 8/1990 Giguere ..... E06B 1/70 49/467
5,426,894 A 6/1995 Headrick
5,517,788 A 5/1996 McGough et al.
5,524,391 A * 6/1996 Joffe ..... E06B 1/524 49/467
5,542,217 A 8/1996 Larivee, Jr.
5,588,266 A 12/1996 Headrick
(Continued)

FOREIGN PATENT DOCUMENTS

AU 2009100510 A4 7/2009
AU 2009100511 A4 7/2009
(Continued)

OTHER PUBLICATIONS

SureSill Water Management Guide, Jan. 2016, SureSill Ltd., Austin, Texas.

(Continued)

*Primary Examiner* — Jerry E Redman
(74) *Attorney, Agent, or Firm* — Stone Creek Services LLC; Alan M Flum

(57) ABSTRACT

Disclosed is a sill assembly and sill that can be positioned continuously under doorways with swing doors, sidelites, and vertical door frame members such as vertical jambs, and mull posts, or the vertical members of sidelites. One variation of the sill assembly can be used for inswing doors while another can be used for outswing doors. The sill assembly includes a backstop and optionally can include end dams. These in combination with the structure of the sill assembly shed water away from the building structure and allow for the possibility of the sill assembly being installed without an additional sill pan or flashing. The sill assembly can optionally include one or more thermal breaks. The sill assembly can be structured so the thermal breaks of the door, sidelites, and vertical door frame members all align with the thermal breaks of the sill assembly.

20 Claims, 53 Drawing Sheets

(56) References Cited

U.S. PATENT DOCUMENTS

| | | | | |
|---|---|---|---|---|
| 5,611,173 | A | 3/1997 | Headrick et al. | |
| 5,638,641 | A | 6/1997 | Joffe et al. | |
| 5,673,517 | A * | 10/1997 | Stanclift | E06B 1/70 49/468 |
| 5,822,923 | A * | 10/1998 | Governale | E06B 3/365 49/365 |
| 5,921,038 | A | 7/1999 | Burroughs et al. | |
| 5,956,909 | A | 9/1999 | Chou | |
| 6,052,949 | A | 4/2000 | Procton et al. | |
| 6,125,599 | A | 10/2000 | Mees et al. | |
| 6,219,979 | B1 | 4/2001 | Lohr | |
| 6,289,635 | B1 * | 9/2001 | Procton | E06B 1/70 49/467 |
| 6,345,477 | B1 | 2/2002 | Kepler et al. | |
| 6,367,201 | B1 | 4/2002 | Massey et al. | |
| 6,371,188 | B1 | 4/2002 | Baczuk et al. | |
| 6,637,158 | B2 | 10/2003 | Bennett | |
| 6,718,700 | B2 | 4/2004 | Rochman | |
| 6,763,639 | B2 | 7/2004 | Bennett et al. | |
| 6,789,358 | B2 | 9/2004 | Procton et al. | |
| 7,222,462 | B2 | 5/2007 | Ellingson | |
| 7,263,808 | B2 | 9/2007 | Massey et al. | |
| 7,350,336 | B2 | 4/2008 | Bennett | |
| 7,472,516 | B2 * | 1/2009 | Pepper | E06B 1/70 49/467 |
| 7,600,346 | B2 | 10/2009 | Meeks | |
| 7,669,369 | B2 | 3/2010 | Henry et al. | |
| 7,775,011 | B2 | 8/2010 | Baczuk et al. | |
| 7,877,940 | B2 | 2/2011 | Meeks et al. | |
| 8,375,659 | B2 | 2/2013 | Bogenhagen et al. | |
| 8,490,332 | B2 | 7/2013 | Van Camp et al. | |
| 8,555,551 | B2 | 10/2013 | Meeks et al. | |
| 8,567,128 | B2 | 10/2013 | Van Camp et al. | |
| 8,695,293 | B2 | 4/2014 | Teodorovich | |
| 8,919,056 | B2 | 12/2014 | Rochman | |
| 9,051,777 | B2 | 6/2015 | Van Camp et al. | |
| 9,316,041 | B2 * | 4/2016 | Olson | E06B 1/52 |
| 9,624,716 | B2 | 4/2017 | Mitchell et al. | |
| 9,725,945 | B2 | 8/2017 | Swank et al. | |
| 9,845,634 | B2 | 12/2017 | Heid et al. | |
| 10,697,228 | B2 * | 6/2020 | Swank | E06B 7/18 |
| 2004/0016187 | A1 | 1/2004 | Dame | |
| 2004/0128925 | A1 | 7/2004 | Massey | |
| 2004/0139667 | A1 * | 7/2004 | Massey | E05C 9/1808 52/204.1 |
| 2004/0200152 | A1 | 10/2004 | Khanlarian | |
| 2004/0200153 | A1 * | 10/2004 | Khanlarian | E06B 1/70 49/468 |
| 2005/0198911 | A1 | 9/2005 | Bcazuk et al. | |
| 2006/0101736 | A1 | 5/2006 | Okugawa | |
| 2006/0225364 | A1 * | 10/2006 | Chen | E06B 1/70 49/467 |
| 2009/0038231 | A1 * | 2/2009 | Erbrect | E06B 7/2305 49/476.1 |
| 2009/0165406 | A1 | 7/2009 | Campbell et al. | |
| 2010/0192469 | A1 * | 8/2010 | McDaniel | E06B 1/70 49/469 |
| 2013/0199101 | A1 * | 8/2013 | Rager-Frey | E06B 1/70 49/469 |
| 2013/0199102 | A1 * | 8/2013 | Rager-Frey | E06B 7/14 49/469 |
| 2015/0052820 | A1 * | 2/2015 | Van Camp | E06B 1/70 49/468 |
| 2015/0361712 | A1 * | 12/2015 | Eisenbarth | E06B 3/10 52/204.5 |
| 2016/0053529 | A1 | 2/2016 | Petitbone | |
| 2016/0273260 | A1 * | 9/2016 | Jolie | E06B 7/2316 |
| 2017/0101817 | A1 * | 4/2017 | Swank | E06B 7/26 |
| 2017/0306688 | A1 * | 10/2017 | Clarke, Jr. | E05C 1/004 |
| 2017/0342764 | A1 | 11/2017 | Headrick | |
| 2018/0135347 | A1 * | 5/2018 | Geier | E06B 1/70 |
| 2018/0274244 | A1 * | 9/2018 | Ortega | E06B 1/62 |
| 2019/0106929 | A1 * | 4/2019 | Farahmandpour | E06B 7/14 |
| 2020/0024889 | A1 * | 1/2020 | Mitchell | E06B 1/70 |
| 2020/0087976 | A1 * | 3/2020 | Bagnall | E06B 7/14 |

FOREIGN PATENT DOCUMENTS

| | | | | |
|---|---|---|---|---|
| AU | 2011110521 | A4 | 1/2012 | |
| AU | 2011101515 | A4 | 2/2012 | |
| CA | 2851461 | A1 * | 11/2014 | E06B 3/70 |
| CA | 2881561 | A1 * | 12/2015 | E06B 7/2305 |
| CA | 2928089 | A1 * | 11/2016 | E06B 1/70 |
| CA | 2954229 | A1 * | 7/2017 | E06B 7/26 |
| CA | 3001401 | A1 * | 10/2018 | E06B 7/14 |
| CN | 103422776 | A | 12/2013 | |
| CN | 104088555 | A | 10/2014 | |
| CN | 105317328 | A | 2/2016 | |
| DE | 29820383 | U1 * | 3/2000 | E06B 1/70 |
| DE | 102005035220 | A1 * | 6/2006 | E06B 7/20 |
| EP | 1752603 | A1 | 2/2007 | |
| FR | 2575215 | A1 | 6/1986 | |
| KR | 1020100103273 | A | 9/2010 | |
| WO | 2009086510 | A1 | 7/2009 | |

OTHER PUBLICATIONS

Pemko Residential Thresholds: Bumper Thresho-sills for Outswing Doors, May 2017, Pemko Assa Abloy, Ventura, California.

Pemko Assa Abloy Residential Thresholds, Feb. 2010, Pemko Assa Abloy, Ventura, California.

Inswing Adjustable Sill, Outswing Bumper Sill, Inswing Low Profile Sill, Feb. 2014, Codel Entry Systems, Wilsonville, Oregon.

Codel Coatings, Feb. 2014, Codel Entry Systems, Wilsonville, Oregon.

Water-Shed Sill, Stop Water at the Door, Jan. 2017, Codel Entry Systems, Wilsonville, Oregon.

Endura Products Assembly Instructions, Sep. 2017, Endura Products, Inc., Colfax, North Carolina.

ADA Compliant Sill Options, Nov. 2017, Endura Products, Inc., Colfax, North Carolina.

Traditional Sills, Nov. 2009, Endura Products, Inc., Colfax, North Carolina.

Z-All Aluminum Lineal Sill, Jun. 2017, Endura Products, Inc., Colfax, North Carolina.

Z-Series Adjustable Sills, May 2017, Endura Products, Inc., Colfax, North Carolina.

ADA Sidelight Seat, Nov. 2017, Endura Products, Inc., Colfax, North Carolina.

The Euro Door, Aug. 2015, HH Windows and Doors, Inc. Seattle, Washington.

Andersen Clad Outswing Entry Doors 2001 to Present, Jan. 2018, Andersen Corporation, Bayport, Minnesota.

Ascent Hinged French Doors, Eagles Windows and Doors, Mar. 2011, Andersen Corporation, Bayport, Minnesota.

Patio & Sidelite Frame System with Continuous Sill and Header, Sep. 2010, The Detering Company, Houston, Texas.

Door Unit Construction, Reeb Learning Center, downloaded from the Internet from https://learn.reeb.com/door-unit-construction/ on Jun. 5, 2018.

AG Millworks French Swing Doors, downloaded from the Internet from https://agmillworks.com/french_swing_patio_doors on Jun. 9, 2018.

All You Need to Know, downloaded from the Internet from http://www.doornmore.com/pinstructions/view/window/id/60/ on Jun. 5, 2018.

AFCO Industries Inc. Catalog, May 2009, AFCO Industries, Inc., Alexandra, Louisiana.

S/Guard Proline Am5Ex-Subsill 3000mm Gold, MB DIY, Middlesbrough, Great Britain, downloaded from the Internet from https://www.mbdiy.co.uk/shop/door-hardware/vents-and-weather-seals/s-guard-proline-am5ex-subsill-3000mm-gold/ on Feb. 28, 2020.

Projecting Sub-sill section drawings, Aura Plus, Landmark Window Solutions, Portsmouth, New Hampshire, downloaded from the Internet from http://www.doubleglazinginportsmouth.com/rationel-products/projecting-sub-sill-section-drawings/#prettyPhoto on Feb.

(56) References Cited

OTHER PUBLICATIONS 28, 2020. Note that this URL is no longer active. The page is available on the Internet Archive without the drawings at https://web.archive.org/web/20160603122700/http://www.doubleglazinginportsmouth.com/rationel-products/windows-doors/rationel-aura-auraplus/ as of Jun. 22, 2020.
Stormguard Proline AM5Ex Subsill, Allmand-Smith Ltd, Macclesfield, Cheshire, Great Britain, downloaded from the Internet from https://www.stormguard.co.uk/stormguard-products/proline-subsill-am5ex/ on Jun. 22, 2020 and also in late Feb. 2020.
Waterproofing requirements for doorways to decks and balconies, QBCC Queensland Building and Construction Commission, Published: Feb. 13, 2017, downloaded from the Internet from https://www.qbcc.qld.gov.au/blog/tradie-talk/waterproofing-requirements-doorways-decks-balconies on Feb. 29, 2020.

* cited by examiner

CONTINUOUS SILL FOR DOORS WITH SIDELITES

BACKGROUND

The present disclosure relates to sills within a doorway where the doorway can include one or more doors and one or more sidelites. A sidelite, also spelled sidelight, is a framed glass, acrylic, or other glazing or infill panels that flanks the side of a door. Fixed sidelites have a non-operable glazing or infill panel that does not open. Vented sidelites can have an operable glazing or infill panel; i.e., the glazing or infill panel opens and closes within the frame. A sidelite can also be an infill panel such as wood panel, or composite panel. A composite panel can typically be constructed of aluminum over foam.

Sills can create an air or moisture barrier between the inside and outside of a doorway. For example, a sill can weather seal the bottom of the door, preventing water and outside air from entering the building from underneath the door. A sill pan, or pan flashing, can be placed between the sill and the floor. The sill pan prevents water from collecting and leaking through the sill by diverting water back into the outside environment. The sill pan typically has vertical structures, or dams, on opposite ends to prevent water from infiltrating the vertical framing posts or vertical jambs.

Doorways with both doors and sidelites typically have separate sills under the door and under each sidelite. For example, a doorway with a door and two sidelites would typically have three sills. One sill would be positioned under the door between the vertical framing members, or vertical jambs, that surround the door. A second sill would be positioned beneath one of the sidelites between the vertical framing members, for example, vertical jambs and/or mull posts, that frame the sidelite. A third sill would be positioned beneath the other sidelite between the vertical jambs and mull posts that surround that sidelite. Sill pans could be placed under each sill to prevent water infiltration and protect the corresponding vertical jambs.

Recently, sills have been developed that run continuously under both doors and the accompanying sidelites. These have the potential advantage of simpler installation and less parts than installing a separate sill for the door and each sidelite as described above.

SUMMARY

The inventor set out to create an improved continuous sill assembly optimized for glazed door and sidelite assemblies. The inventor envisions that there are a number of different ways to implement his improved sill assembly for use with both outswing and inswing doors. Three basic variations along with sub-variations are described in detail within the Description section.

These three variations have common features and advantages. First, the sill bodies all include backstops. The backstops align the closed door in the same vertical plane as the sidelites. The backstops prevent air and water infiltration by creating a vertical seal against the door and sidelites. Second, the sill assemblies include one or more horizontal surfaces positioned across the length of either the sill body or sill deck. These horizontal surfaces are structured to seat sidelites and vertical frame members such as mull posts, vertical jambs, or sidelite stiles. For the sill assembly without a sill deck, these horizontal surfaces are located on the sill body. For sill assemblies with one or more sill decks, these horizontal surfaces are located on the sill decks. Third, the sill body in combination with end dams, are shaped to shed water away from the building. This allows for the possibility of using the sill body as its own sill pan and potentially eliminates the need for additional flashing. Fourth, the sill assembly can optionally include thermal breaks, such as thermal struts, structural foam, or other thermally insulating material capable of forming rigid structures. With the aid of the backstop, the thermal breaks in the sill assembly can be aligned over thermal breaks in the doors, sidelites, and vertical frame members. Aligning the thermal breaks can significantly improve the thermal efficiency of the doorway assembly by reducing heat transfer between the inside and outside of the doorway structure. Fifth, sill assemblies can be structured so the bottom lengthwise edge of each sidelite is collinear with the bottom edge of the door. This can help the doorway have a more uniform visual impression.

This Summary introduces a selection of concepts in simplified form that are described the Description. The Summary is not intended to identify essential features or limit the scope of the claimed subject matter.

DRAWINGS

DESCRIPTION

Figure 1:
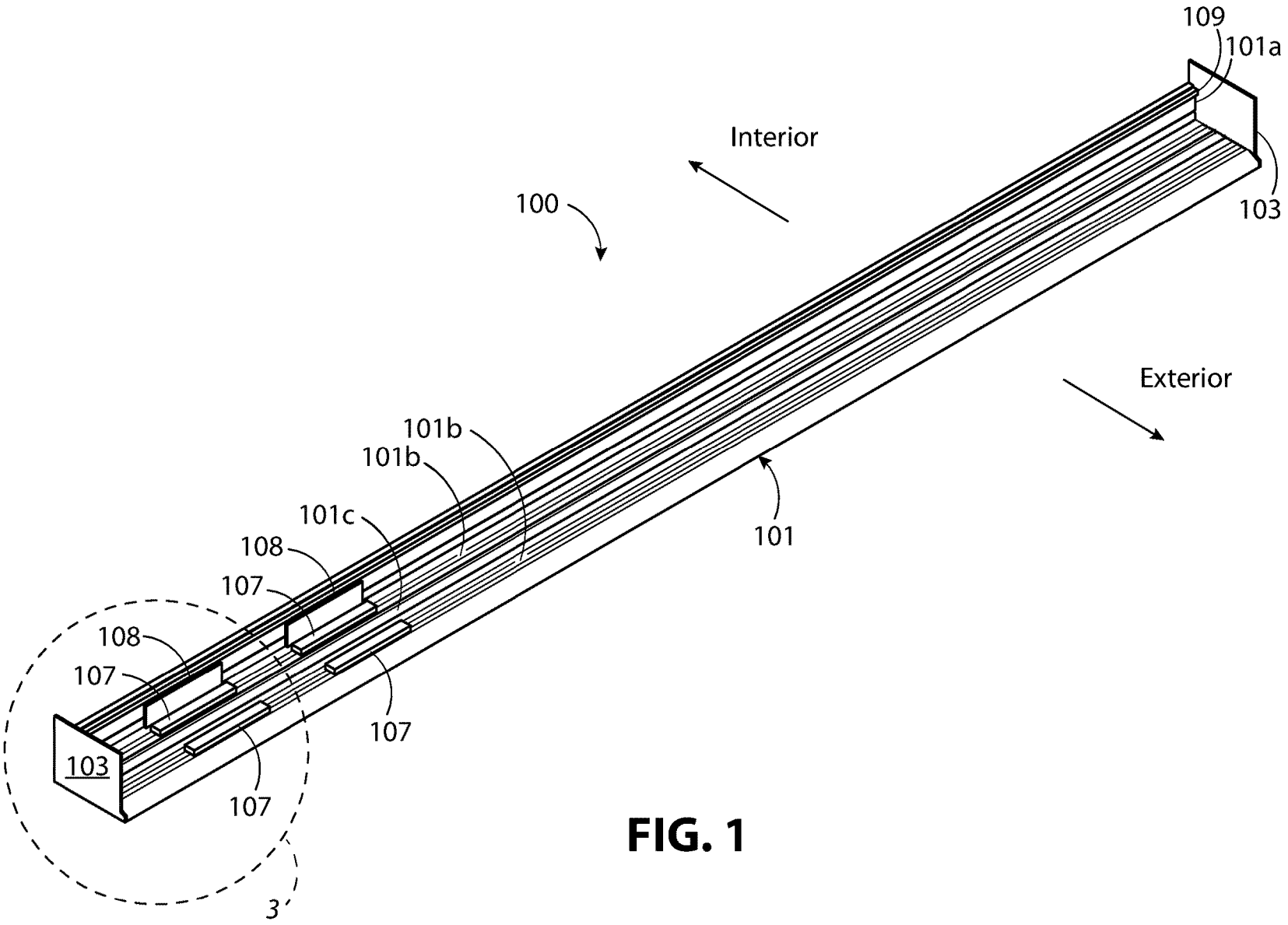
FIG. 1 illustrates a first example of a continuous sill for use with an outswing door and a sidelite, in front perspective view.
Figure 2:
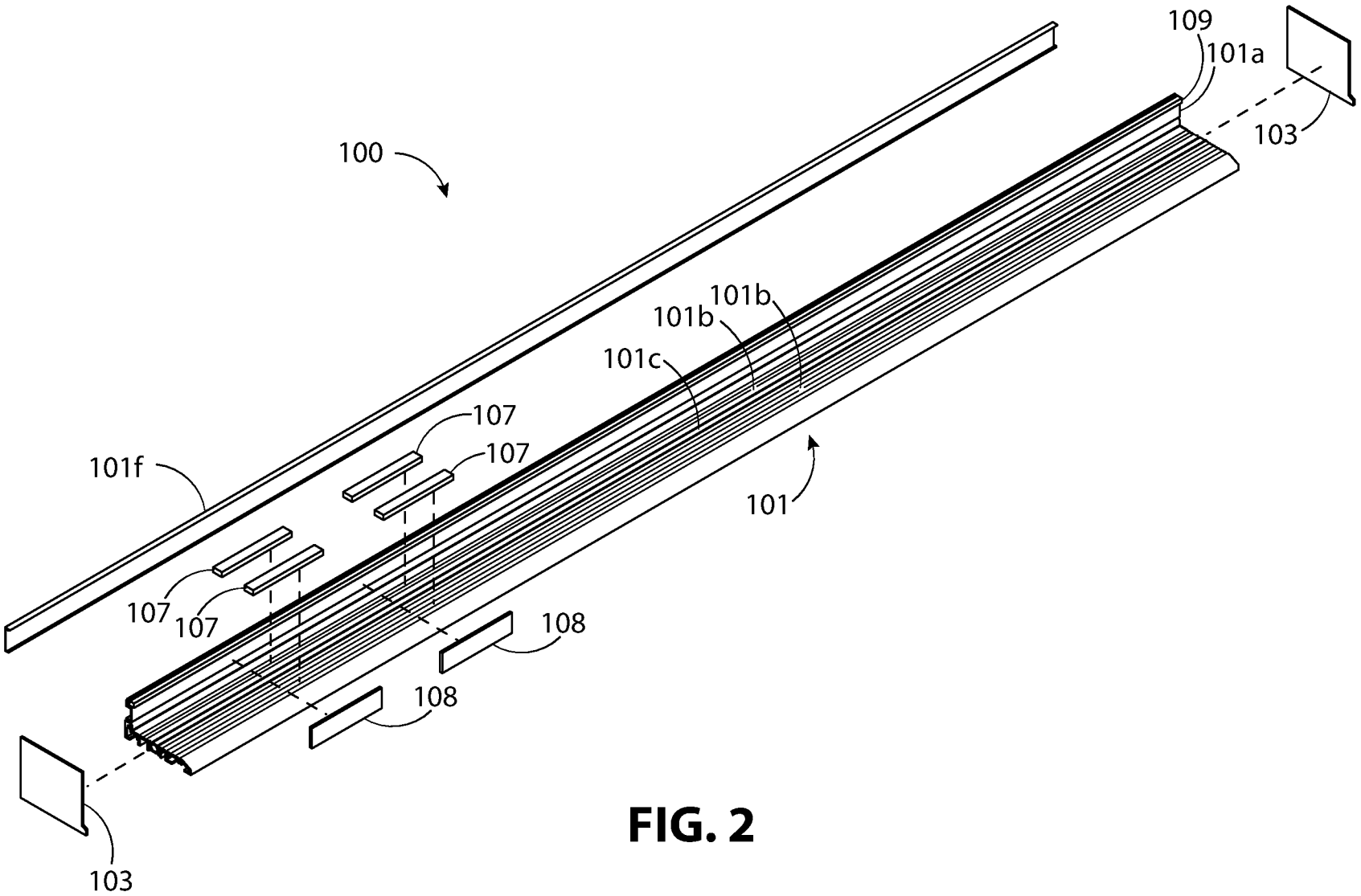
FIG. 2 illustrates the continuous sill of FIG. 1 in exploded front perspective view.
Figure 3:
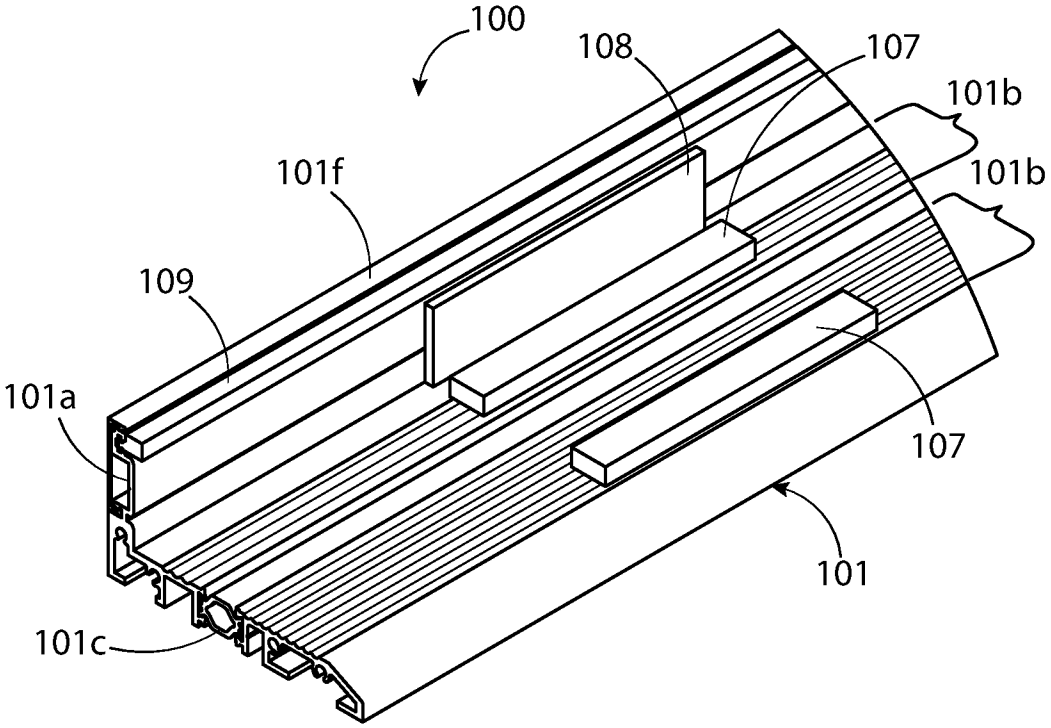
FIG. 3 illustrates a portion the continuous sill of FIG. 1 enlarged for magnification purposes and with the end dam removed for clarity.
Figure 4:
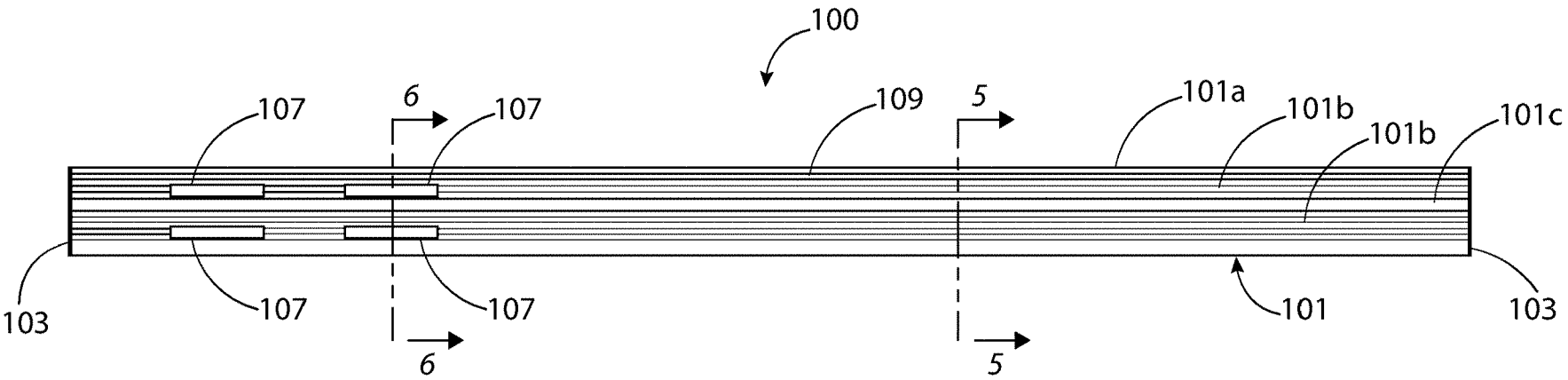
FIG. 4 illustrates a top view of the continuous sill of FIG. 1.

The terms "left," "right," "top, "bottom," "upper," "lower," and "side," are relative terms used throughout this Description to help the reader understand the figures. Unless otherwise indicated, these do not denote absolute direction or orientation and do not imply a particular preference. When describing doorways, doors, sidelites, or sill assemblies, the term "front" refers to the portion of the doorway, door, sidelite, or sill assembly that faces in the direction that the door opens. The term "rear" refers to the portion of the doorway, door, sidelite, or sill assembly that faces away from the direction that the door opens. For a doorway with an inswing door, i.e., a door opens into an interior environment, front refers to portions of the doorway that face the interior environment, and rear refers to portions of the doorway that face the exterior environment. For a doorway with an outswing door, i.e. a door that opens into the exterior environment, front refers to portions of the doorway that face the exterior environment and rear refers to portions of the doorway that face the interior environment. The term "doorway," refers to a fenestration opening that can include one or more doors, sidelites, and door frame members. A "back stop" would be positioned on the rear portion of the doorway. For an outswing door, the back stop would be positioned along the side of the sill assembly that faces the interior environment. For an inswing door, the back stop would be positioned along the side of the sill assembly that faces the exterior environment. The term "door frame member" can refer to door headers, sidelite stiles, mull posts, vertical door jambs, or other structures that can be used to support or frame the doorway. The term "vertical door frame member" can refer to any vertical frame member within a doorway; for example, a vertical jamb, a sidelite stile, or mull post. The term "door opening" refers to the passage created by an open door. Throughout the figures, the designation "interior" refers to the interior environment and "exterior" refers to the exterior environment. Specific dimensions are intended to help the reader understand the scale and advantage of the disclosed material. Dimensions given are typical and the claimed invention is not limited to the recited dimensions.

The following description is made with reference to figures where like numerals refer to like elements. FIGS. 1-13, 70, and 71 illustrate a first example of a sill assembly 100 for an outswing door. FIGS. 14-32 illustrate a second example of a sill assembly 200 for an outswing door. FIGS. 33-43, and 68 illustrate the sill assembly 200 of FIGS. 14-32 with the addition of an alignment portion for aligning and holding the vertical jambs and sidelites. FIGS. 44-56 illustrate an example of a sill assembly 300 for an inswing door. FIGS. 57-67, and 69 illustrate the sill assembly 300 of FIGS. 44-56 with the addition of an alignment portion for aligning and holding the vertical jambs and sidelites.

The sill assembly 100 (FIGS. 1-13, 70, and 71), sill assembly 200 (FIGS. 14-43, and 68), and sill assembly 300 (FIGS. 44-67, and 69) have common features and advantages. First, the sill body 101 (FIGS. 1-13, 70, and 71), sill body 201 (FIGS. 14-43, and 68), and sill body 301 (FIGS. 44-67, and 69) all include backstops; sill backstop 101*a* (FIGS. 1-12, 70, and 71), sill backstop 201*a* (FIGS. 14-43, and 68), and sill backstop 301*a* (FIGS. 44-67, and 69). The sill backstop 101*a*, 201*a*, and 301*a* aligns the door in the closed position, in the same vertical plane as the sidelites. The sill backstop 101*a*, 201*a*, 301*a* prevents air and water infiltration by creating a vertical seal against the door and sidelites. Second, the sill assemblies 100, 200, 300 include a series of horizontal surfaces 101*b* (FIGS. 1-6 and 10-12, 70, and 71), horizontal surfaces 202*b* (FIGS. 14-17, 19, 20, 24, 25, 29, 30, 33-37, 39, 42, 43, and 68), horizontal surfaces 302*b* (FIGS. 44-47, 49, 50, 53, 54, 57-60, 62, and 63, 65, 66, and 69), respectively, disposed across the length of the sill body 101, 201, 301, respectively, for receiving the door, sidelites, vertical jambs, and mull posts. For the sill assembly 100, the horizontal surfaces 101*b* are located on the sill body 101. For sill assemblies 200, 300, the horizontal surfaces 202*b*, 302*b*, respectively, are located on sill decks 202 (FIGS. 14-20, 23-25, 29, 30, 33-39, 41-43, and 68) and sill decks 302 (FIGS. 44-50, 53-55, 57-63, 65-67, and 69), respectively. Third, the sill body 101, 201, 301 in combination with end dam 103 (FIGS. 1, 2, 4, 7-9, 13, and 71), end dam 203 (FIGS. 14-16, 21, 22, and 26-35), and end dam 303 (FIGS. 44-46, 51, 52, and 56-59), respectively, are shaped and structured to shed water away from the building. This can create a watertight barrier with respect to surrounding wall structure, allow for the possibility of using the sill body 101, 201, 301 as its own sill deck, and potentially eliminates the need for additional flashing. Fourth, the sill assembly 100, 200, 300 can optionally include thermal breaks. The thermal breaks illustrated include thermal break 101*c* (FIGS. 1-6, 10-12, 70, and 71), thermal break 201*c* (FIGS. 14-20, 23-25, 29, 30, 33-43, and 68), and thermal break 301*c* (FIGS. 44-50, 53-55, 57-67, and 69), respectively. With the aid of the sill backstop 101*a*, 201*a*, 301*a*, the thermal breaks 101*c*, 201*c*, 301*c* in sill assemblies 100, 200, 300 can be aligned over thermal breaks in the doors (thermal break 105*c* of FIG. 11), sidelites (thermal break 104*c* of FIGS. 10 and 70), and the thermal breaks in the vertical jambs (thermal break 110*c* of FIGS. 12 and 71). Aligning the thermal breaks can significantly improve the thermal efficiency of the doorway assembly by reducing heat transfer between the inside and outside of the doorway structure. Fifth, sill assemblies 100, 200, 300 are structured so sidelite 104 (FIG. 8), sidelite 204 (FIG. 21), and sidelite 304 (FIG. 51), can be aligned along the bottom vertical edge with their respective door, door 105 (FIG. 8), door 205 (FIG. 21), and door 305 (FIG. 51). This can help the doorway have a more uniform visual impression.

Figure 11:
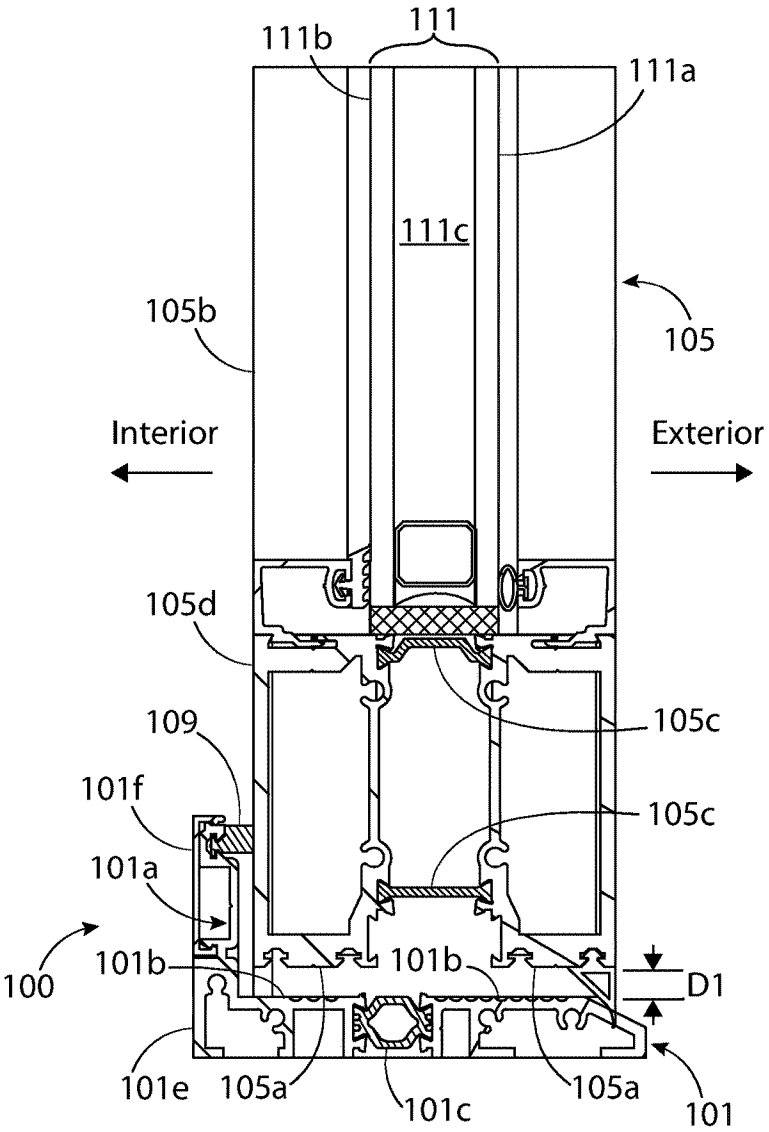
FIG. 11 illustrates a section view of the doorway assembly of FIG. 8 taken along section lines 11-11.
Figure 10:
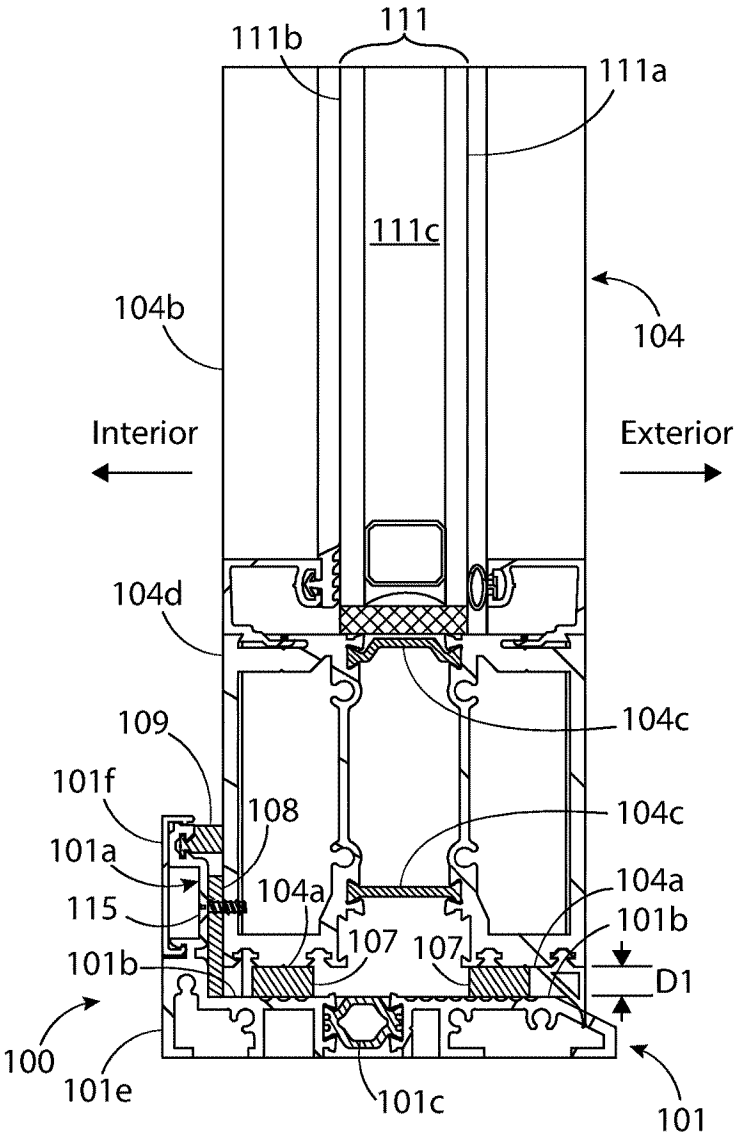
FIG. 10 illustrates a section view of the doorway assembly of FIG. 8 taken along section lines 10-10.

Now, looking at each of the sill assemblies in detail, we turn to the sill assembly 100 of FIGS. 1-13. Referring to FIGS. 1-4, 6, 10, and 70, spacers 107 can be placed on the horizontal surfaces 101*b* to space the bottom of the sidelite 104 (FIGS. 10 and 70) above the sill body 101 and even with the bottom of the door 105 of FIG. 11. Referring to FIG. 10, the spacers 107 lift the bottom surface 104*a* of the sidelite 104 a distance D1. Referring to FIG. 11, D1 represents the clearance between the bottom surface 105*a* of the door 105 and the horizontal surface 101*b* of the sill body 101. Referring to FIG. 10, the spacers 107 are cushioning members made of material with elastic properties, that are capable of supporting the sidelites 104. Examples of appropriate materials for the spacers 107 include ethylene propylene diene monomer (EDPM), polychloroprene (i.e., neoprene), rubber, silicone, or other materials with similar elastic properties that are capable of supporting the sidelites 104.

Figure 5:
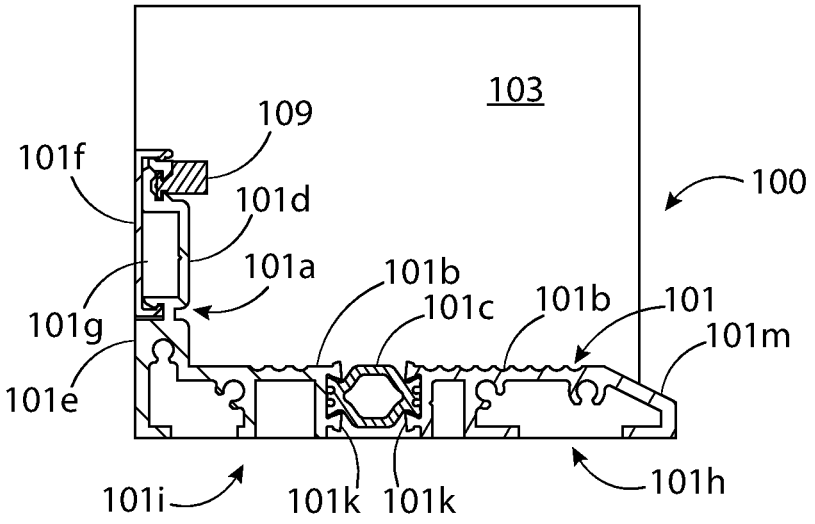
FIG. 5 illustrates a section view of the continuous sill of FIG. 4 taken along section lines 5-5.
Figure 6:
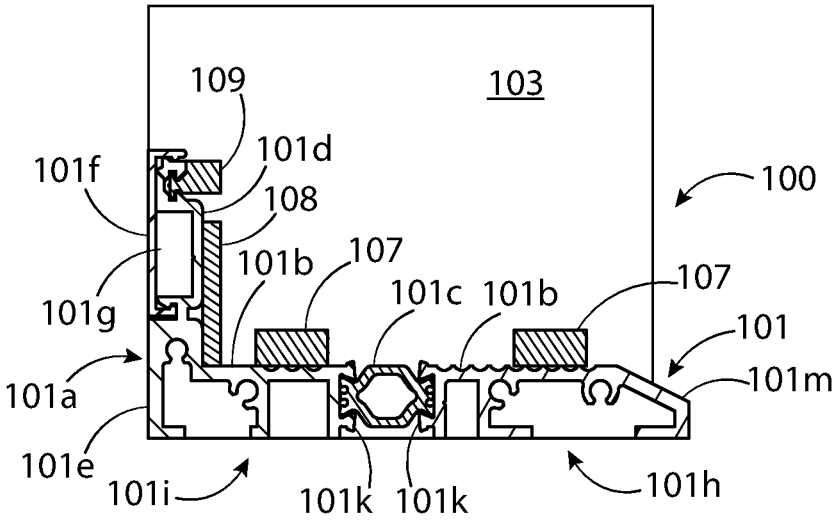
FIG. 6 illustrates a section view of the continuous sill of FIG. 4 taken along section lines 6-6.

Referring to FIGS. 5 and 6, the sill backstop 101*a* projects directly up from the rear-most of the horizontal surfaces 101*b*. The inward-facing surface 101*d* of the sill backstop 101*a* is approximately perpendicular to the horizontal surfaces 101*b*. Referring to FIGS. 5 and 6, and 10-12, the back surface 101*e* (i.e., the outward-facing surface) of the sill backstop 101*a*, defines the back surface and lengthwise back edge of the sill body 101 and can project approximately perpendicular to the horizontal plane of the sill assembly 100. Referring to FIGS. 2, 3, 5, 6, 10, 11, 12, the sill backstop 101*a* can optionally include a cover plate 101*f*. Referring to FIGS. 5 and 6, the cover plate 101*f* can function as decorative trim or can cover a cavity 101*g* that can be used to route wires.

Figure 12:
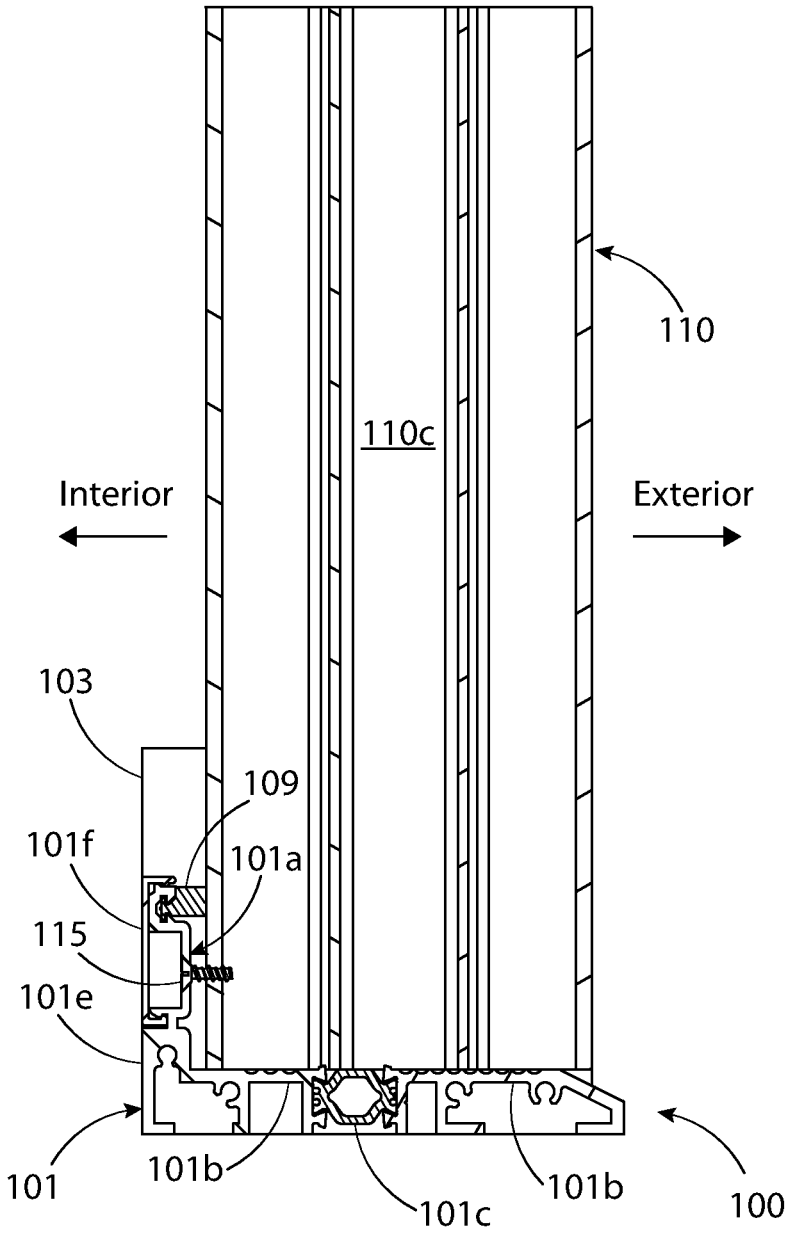
FIG. 12 illustrates a section view of the doorway assembly of FIG. 8 taken along section lines 12-12.
Figure 13:
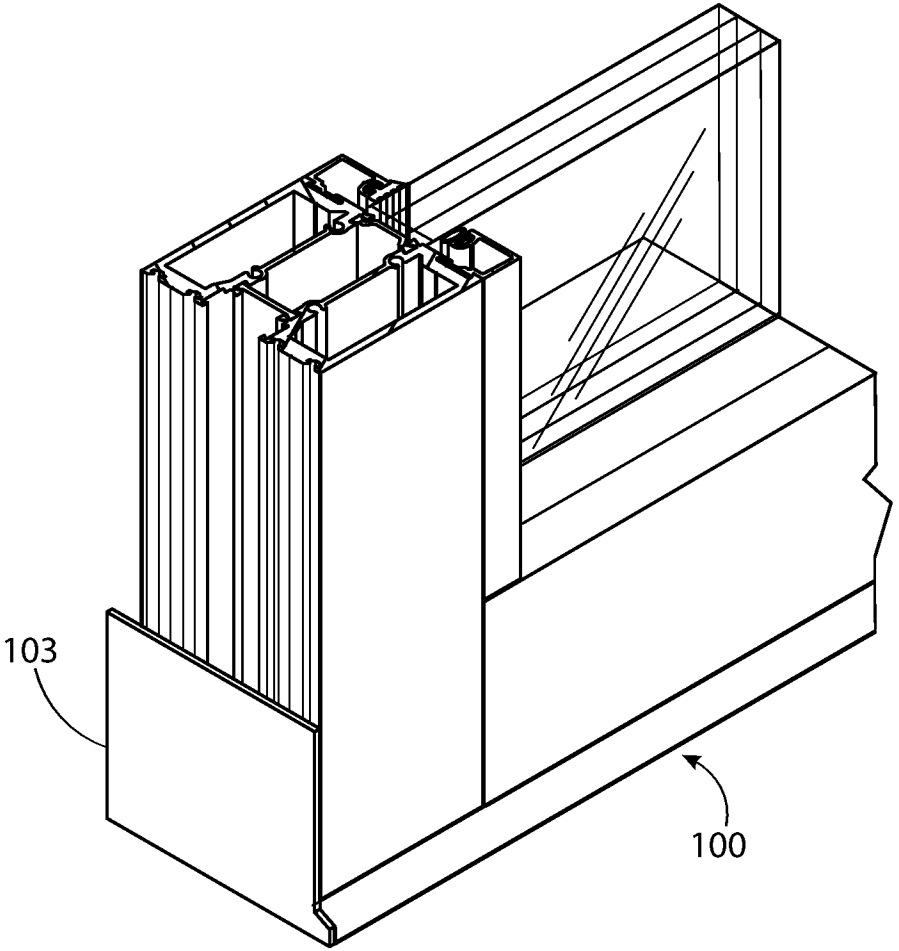
FIG. 13 illustrates a detail view of the doorway assembly of FIG. 7, enlarged for magnification purposes.
Figure 14:
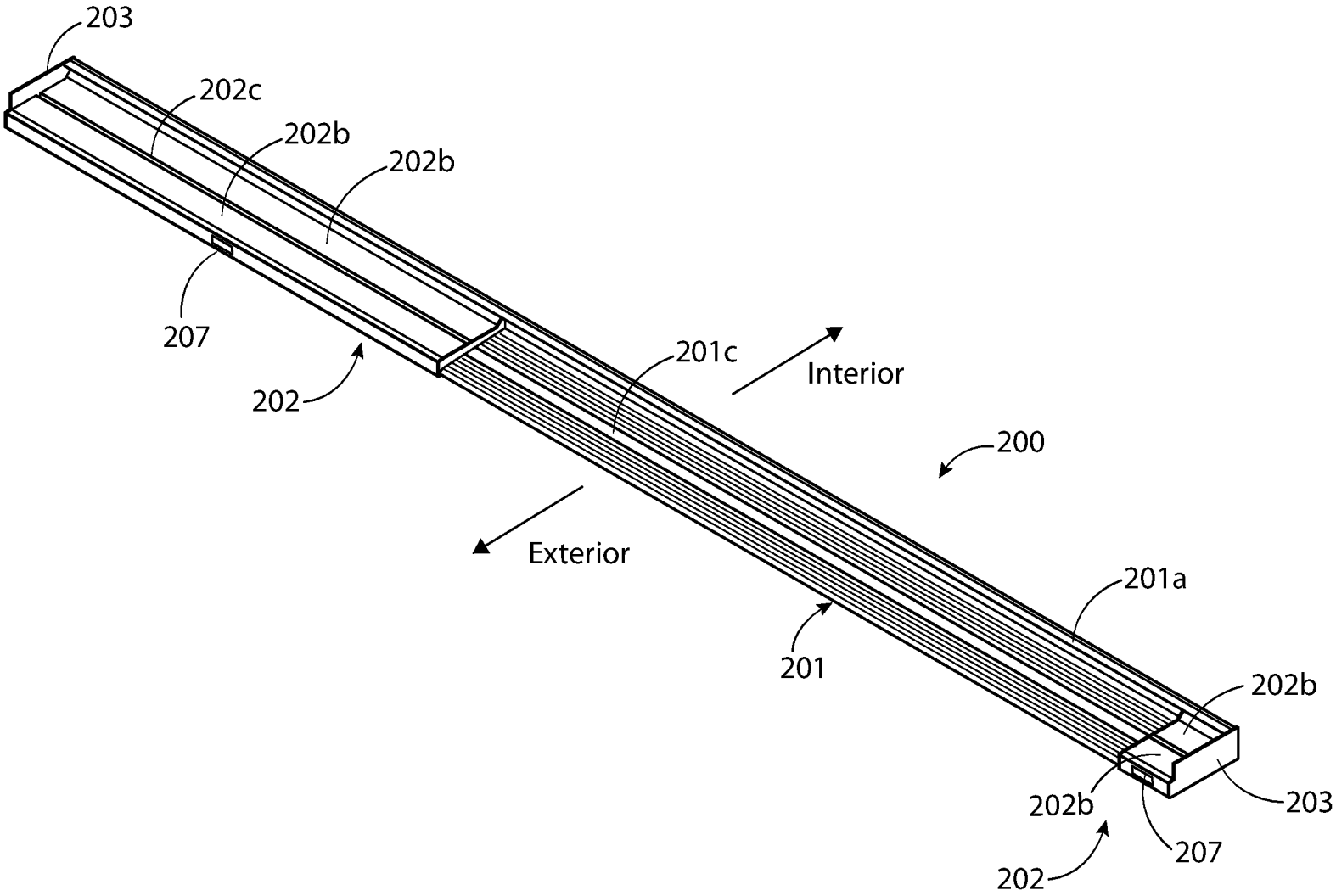
FIG. 14 illustrates a second example of a continuous sill for use with an outswing door and a sidelite, in front perspective view.
Figure 15:
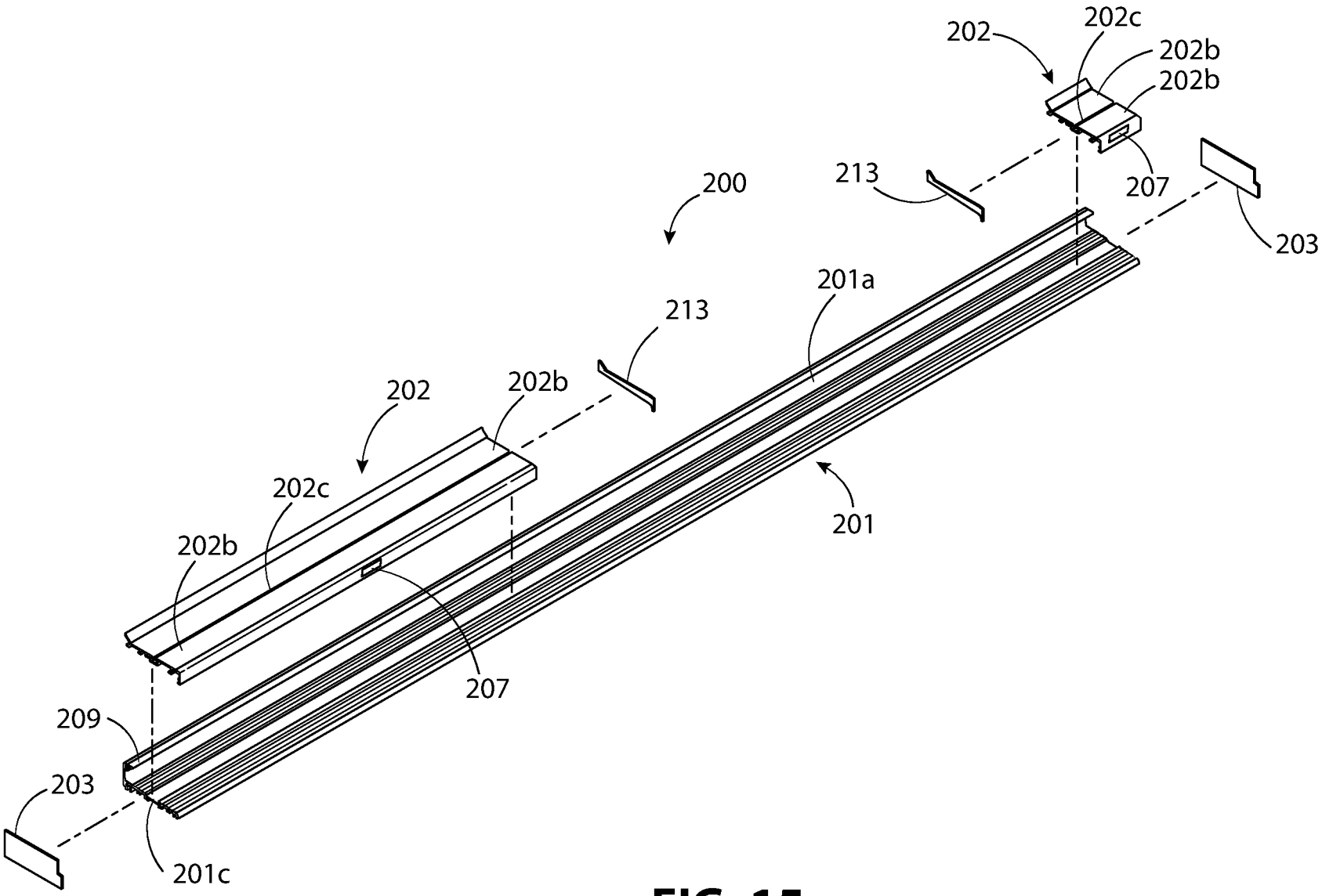
FIG. 15 illustrates the continuous sill of FIG. 14 in exploded front perspective view.
Figure 16:
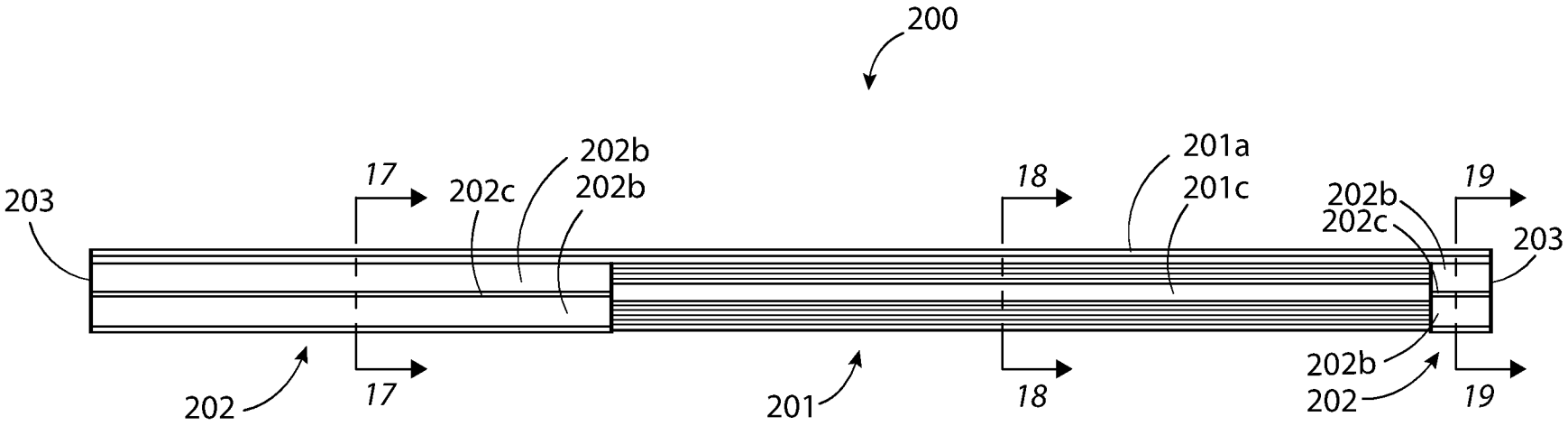
FIG. 16 illustrates a top view of the continuous sill of FIG. 14.
Figure 17:
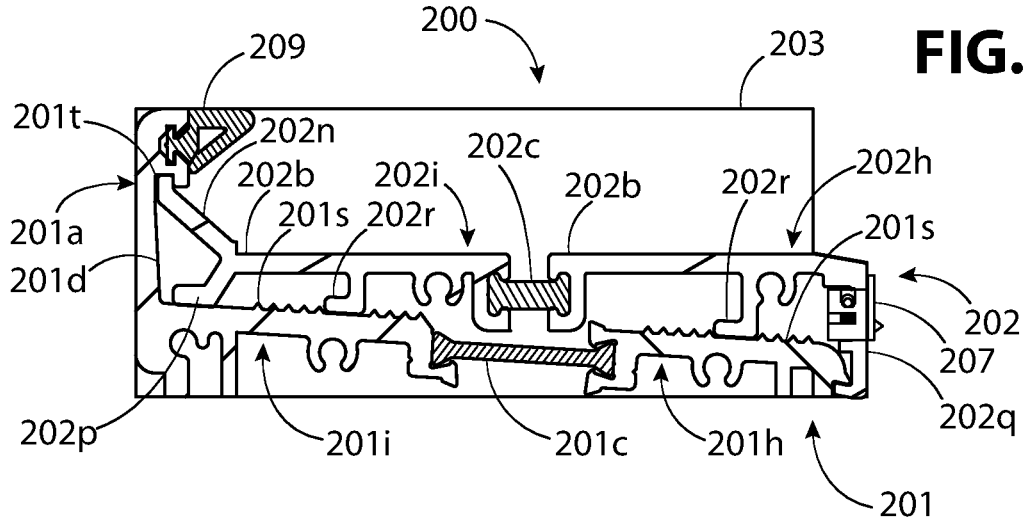
FIG. 17 illustrates a section view of the continuous sill of FIG. 16 taken along section lines 17-17.
Figure 18:
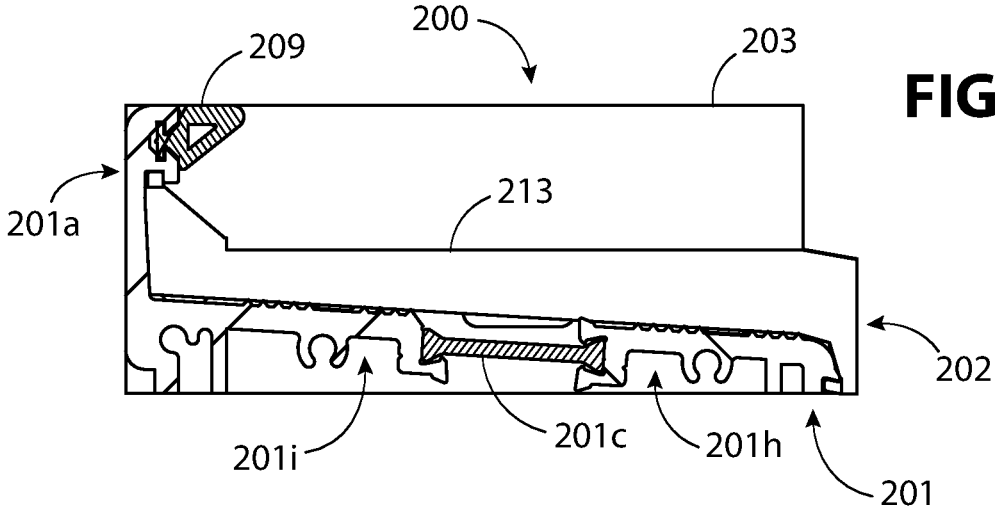
FIG. 18 illustrates a section view of the continuous sill of FIG. 16 taken along section lines 18-18.
Figure 19:
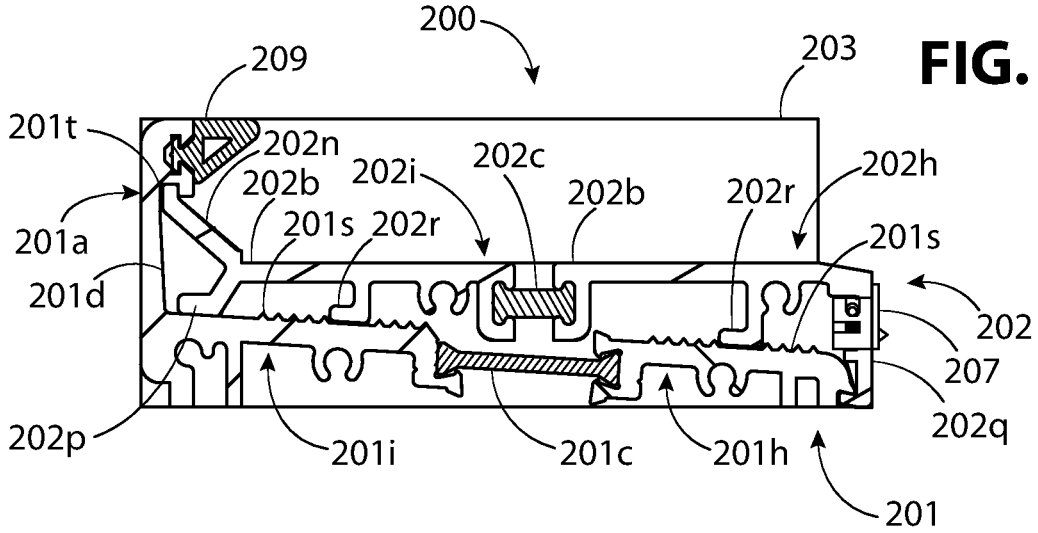
FIG. 19 illustrates a section view of the continuous sill of FIG. 16 taken along section lines 19-19.
Figure 71:
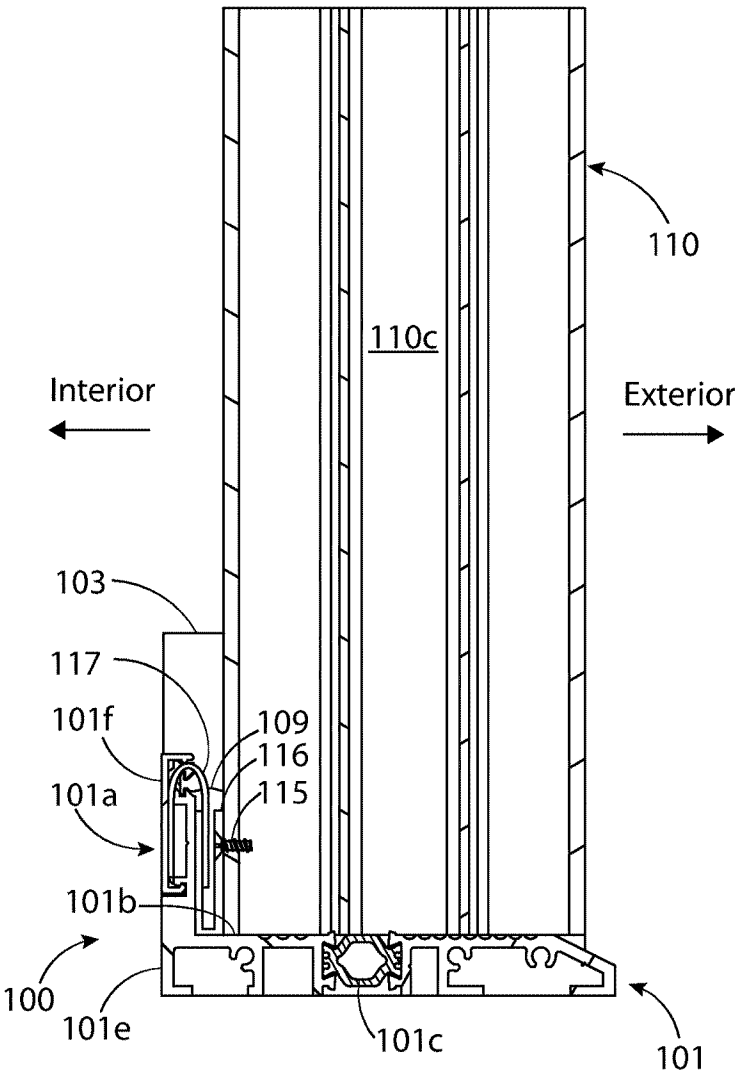
FIG. 71 illustrates an alternative version of the section view of FIG. 12 illustrating the sidelite secured to the backstop by a spring clip, bracket, and threaded fastener.
Figure 70:
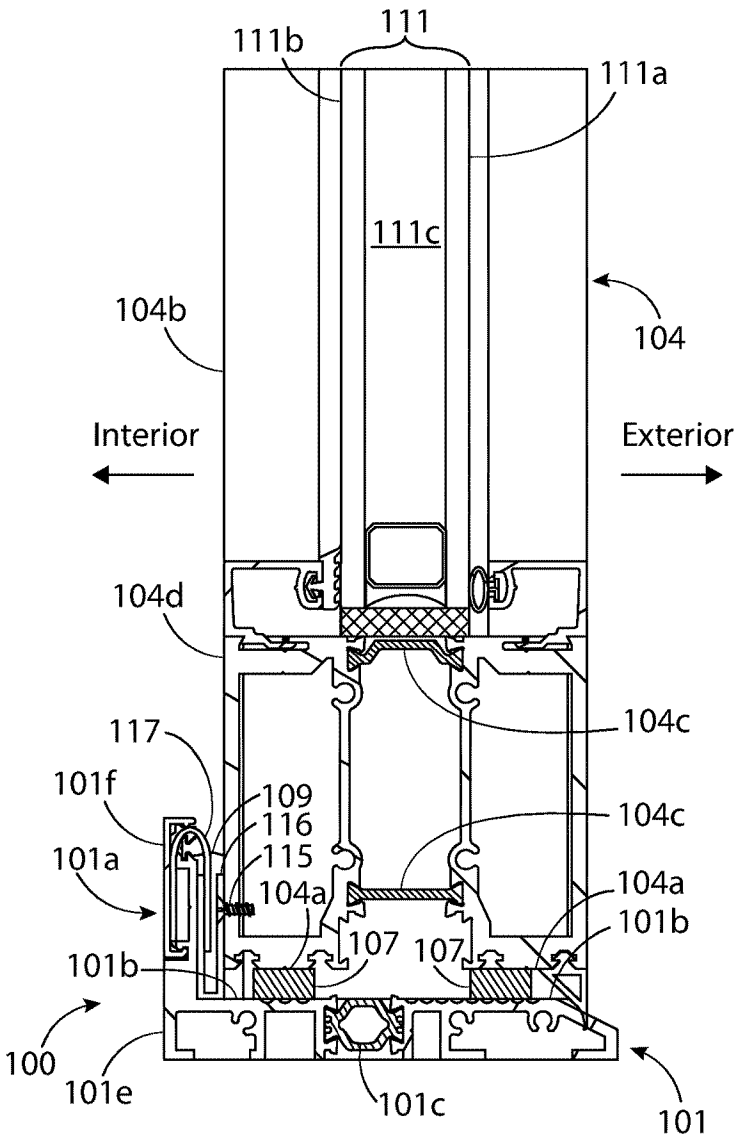
FIG. 70 illustrates an alternative version of the section view of FIG. 10 illustrating the sidelite secured to the backstop by a spring clip, bracket, and threaded fastener.

Referring to FIGS. 1-3, 6, and 10, spacer block 108 spaces the sidelite 104 (FIG. 10) a distance away from the sill backstop 101*a*. Seal 109 creates an air-tight seal and water-tight seal between inward-facing surface 101*d* of the sill backstop 101*a* and the sidelite 104. Seal 109 is typically silicone sealant, other watertight sealants, or sealant tape. Referring to FIGS. 70 and 71, the seal is illustrated as silicone sealant. Referring to FIGS. 1-6, 10-12, 70, and 71, the seal 109 can run either continuously, or in sections, across the sill backstop 101*a* in its entirety. This allows the seal 109 to create an air seal across the sidelite 104 (FIGS. 10 and 70), the door 105 (FIG. 11), and the vertical jamb 110 (FIGS. 12 and 71). Referring to FIGS. 9-12, 70, and 71, the rear surfaces of the sidelite stiles 104*b* (FIGS. 9, 10, and 70) and sidelite bottom rail 104*d* (FIGS. 9, 10, and 70), the door stiles 105*b* and door bottom rail 105*d* (FIGS. 9 and 11), and the vertical jamb 110 (FIGS. 9, 12, and 71) are all aligned against the sill backstop 101*a* in the same plane. If the sidelite stiles 104*b*, sidelite bottom rail 104*d*, door stiles 105*b*, door bottom rail 105*d*, and the vertical jamb 110 are all the same thickness, then their front surfaces would also lie in the same plane, which could be aesthetically desirable. Referring to FIGS. 10, 12, the sidelite 104 (FIG. 10) and the vertical jamb 110 (FIG. 12) can be optionally secured to the sill backstop 101*a* by a threaded fastener 115. The threaded fastener can be a screw, bolt or any other threaded fastener capable of securing the sidelite 104 and the vertical jamb 110 to the sill backstop 101*a*. The thread fastener can optionally be covered by the cover plate 101*f*.

Referring to FIGS. 70 and 71, the sidelite 104 (FIG. 70) and the vertical jamb 110 (FIG. 71) can optional be secured to the sill backstop 101*a* by a combination, threaded fastener 115, a bracket 116, and spring clip 117. The bracket 116 rests against the rearward most of the horizontal surfaces 101*b* and between either the sill backstop 101*a* and the sidelite 104 (FIG. 70) or the sill backstop 101*a* and the vertical jamb 110. The threaded fastener 115 secures the bracket 116 to the sidelite 104 (FIG. 70) or the vertical jamb (FIG. 71). The spring clip 117 straddles the opposite side of the bracket 116 and the sill backstop 101*a*, securing the bracket 116 to the sill backstop 101*a* by spring tension. The spring clip 117 can optionally be embedded within the seal 109, for example silicone or structural silicone. The bracket is illustrated as u-shaped, and the sill backstop 101*a* has been simplified for illustrative purposes. The sill backstop can be shaped as in FIG. 10 with the bracket 116 shaped to accommodate the still backstop. Alternatively, the bracket 116 can be any shaped that allows it act as an intermediary to join the sill backstop 101*a* to either the sidelite 104 (FIG. 70) or the vertical jamb 110 (FIG. 71). While this arrangement has more parts and is more complex than simply using a threaded fastener 115 as in FIGS. 10 and 12, it can be used to prevent leakage between sidelite 104 (FIG. 70) and the sill backstop 101*a* or the vertical jamb 110 (FIG. 71) and the sill backstop 101*a* by not having the threaded fastener penetrate the sill backstop 101*a*.

Referring to FIGS. 5 and 6, the sill body 101 can be extruded from aluminum. The sill backstop 101*a* is integrally formed with the remainder of the sill body 101. For a thermally broken sill, such as those shown throughout this disclosure, the sill can alternatively be extruded in two parts: A front sill body 101*h* and a rear sill body 101*i*. The sill backstop 101*a* being integral with the rear sill body 101*i* and projecting vertically upward. The front sill body 101*h* includes a front portion 101*m* that slopes downward from the horizontal surface 101*b* of the front sill body 101*h*. The front sill body 101*h* and the rear sill body 101*i* are shown joined by the thermal break 101*c*. Referring to FIGS. 10-12, 70, and 71, the thermal break 101*c* in the sill body 101, as well as the thermal breaks 104*c* in sidelite 104 (FIGS. 10 and 70), the thermal breaks 105*c* in the door 105 (FIG. 11), and the thermal break 110*c* in the vertical jamb 110 (FIGS. 12 and 71) are made of thermally insulative material such as polyamide and are illustrated in the form of a thermal strut. Throughout this description, a thermal break can be a thermal strut or can alternatively be made of other thermally insulating materials capable of rigidly joining and thermally isolating the exterior-facing portion and interior-facing portion of the various structures described throughout this disclosure. By rigidly joining, we mean joining the structures in such a way so they form a rigid body that acts as a unit and withstands load bearing and other forces from typical use. Referring to FIGS. 5 and 6, the thermal breaks 101*c* can be crimped into grooves 101*k* in the front sill body 101*h* and the rear sill body 101*i* by large crimping rollers. Crimping in this way can provide a watertight seal across the front sill body 101*h* and the rear sill body 101*i*. Silicone or other waterproof sealant can be placed along the lengthwise seams of the thermal break 101*c* to enhance water tightness. The sill with sill backstop 101*a* integral with the rear sill body 101*i*, thermal breaks 101*c*, end dams 103, horizontal surfaces 101*b*, and front portion 101*m*, structured as described, lends the sill assembly 100 to act as both door threshold and sill pan as this combination can create water-tight barrier with respect to the surrounding wall opening. This can potentially reduce parts count and simplify assembly.

Referring to FIGS. 10-12, 70, and 71, the thermal breaks of the sill body 101, sidelite 104, door 105, and vertical jamb 110 are aligned so that inside-facing section of sill body 101, sidelite 104, door 105, and vertical jamb 110 are thermally isolated. Referring to FIGS. 7-11 and 70, this includes the glazing panels 111 which are illustrated as insulating glass units (IGU). Referring to FIGS. 10 and 11, the glazing panels 111 can include a first glass panel 111*a* and a second glass panel 111*b* separated by a cavity 111*c* filled with either air or gas. Referring to FIGS. 10-12, 70, and 71, the thermal breaks are aligned but not centered. Referring to FIGS. 5 and 6, the width of the front sill body 101*h* and rear sill body 101*i* can be adjusted to align the thermal breaks in FIGS. 10-12, 70, and 71.

FIGS. 14-43, and 68 illustrate a second example of a continuous sill for use with an outswing door and one or more sidelites. The sill assembly 200 of FIGS. 33-43, and 68 includes alignment portions 202*d* (shown in FIGS. 33-39, 42, 43, and 68) for aligning and securing sidelites and vertical jambs. The sill assemblies 200 of FIGS. 14-32 do not include alignment portions. Referring to FIGS. 14-20, 23-25, 29, 30, 33-39, and 41-43, and 68, the sill assembly 200 includes two main portions: The sill body 201 and one or more of the sill decks 202. The sill decks 202 are illustrated extending from the back of the sill body 201 to the front lengthwise edge of the sill body. The sill body 201 acts as the threshold for the door 205 (see FIGS. 24, 27, 28, 31, 32, and 41) and together with the end dams 203 (FIGS. 14-19, 21, 22, 26-38) act as the sill pan as this combination can create a watertight barrier with respect to surrounding wall structure. The sill decks 202 are mounted and secured over the sill body 201 and provide horizontal surfaces 202*b* for the bottom surfaces of the sidelites 204 (FIGS. 23 and 42) and the bottom surfaces of the vertical jambs 210 (FIGS. 25 and 43) to mount against. The horizontal surfaces 202*b* are part of the sill decks 202 and are shown in FIGS. 14-17, 19, 20, 23, 25, 29, 30, 33-37, 39, 42, 43, and 68.

Figure 24:
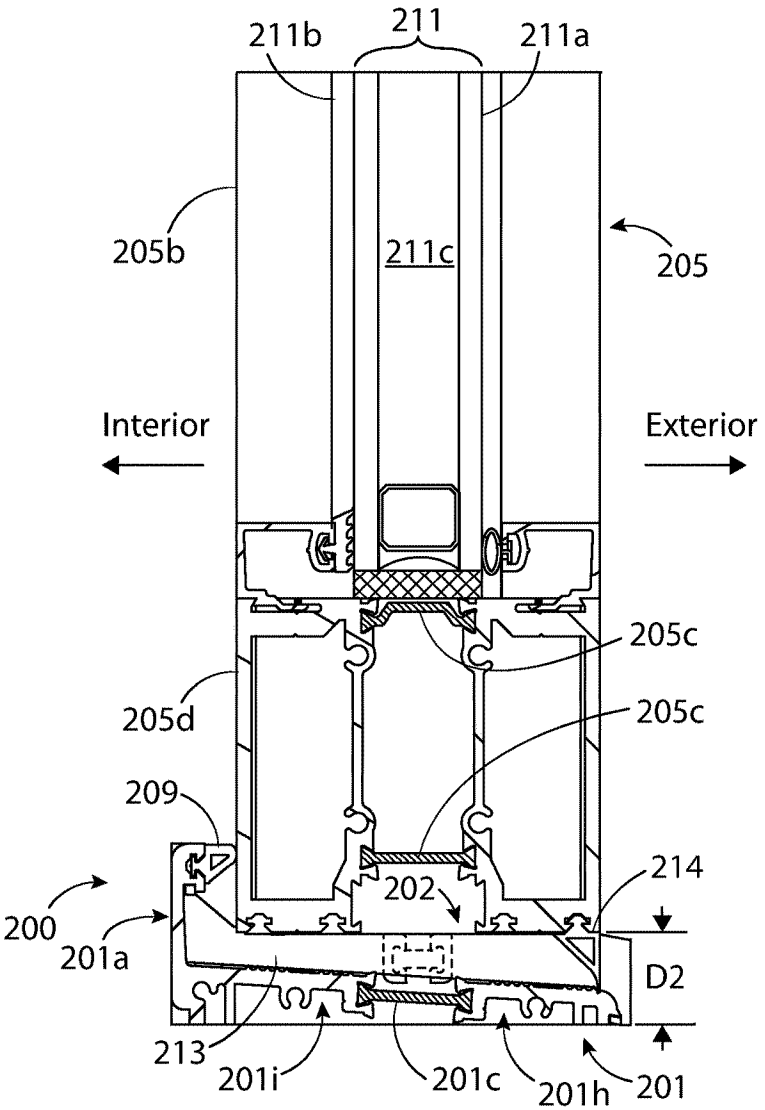
FIG. 24 illustrates a section view of the doorway assembly of FIG. 21 taken along section lines 24-24.
Figure 23:
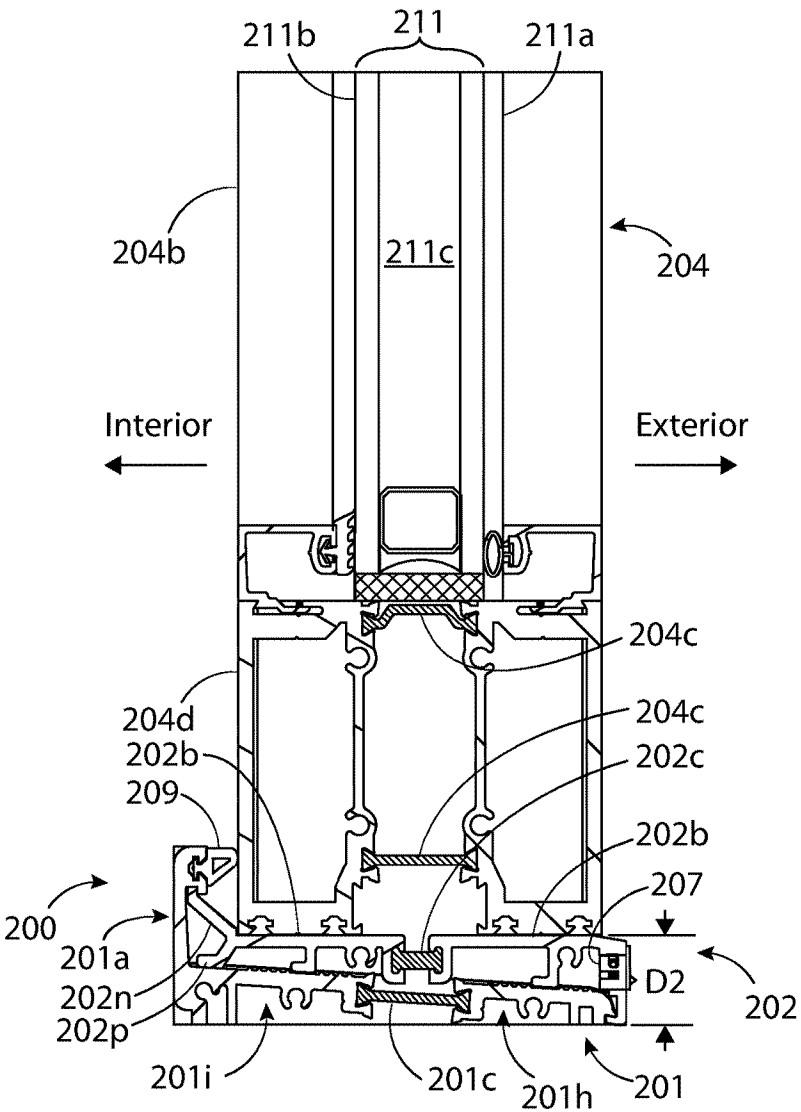
FIG. 23 illustrates a section view of the doorway assembly of FIG. 21 taken along section lines 23-23.
Figure 25:
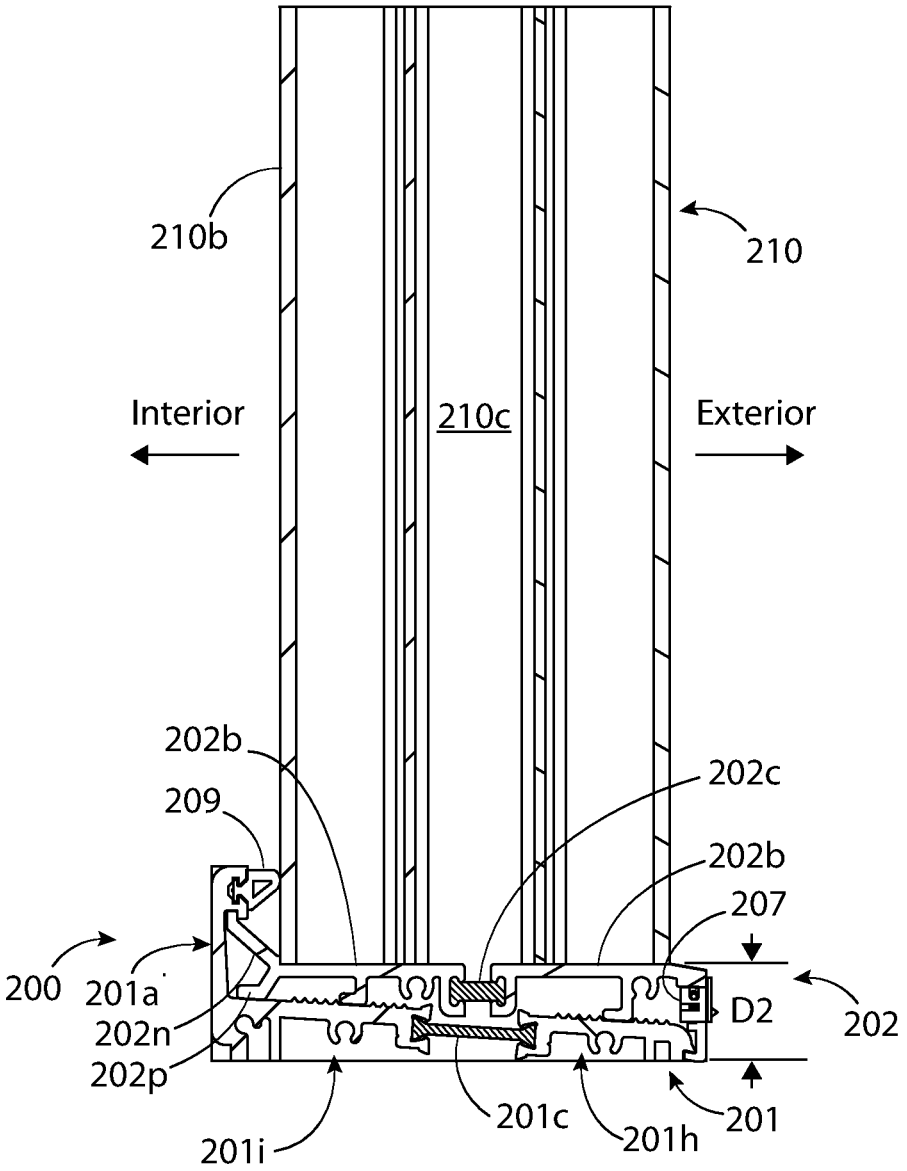
FIG. 25 illustrates a section view of the doorway assembly of FIG. 21 taken along section lines 25-25.
Figure 26:
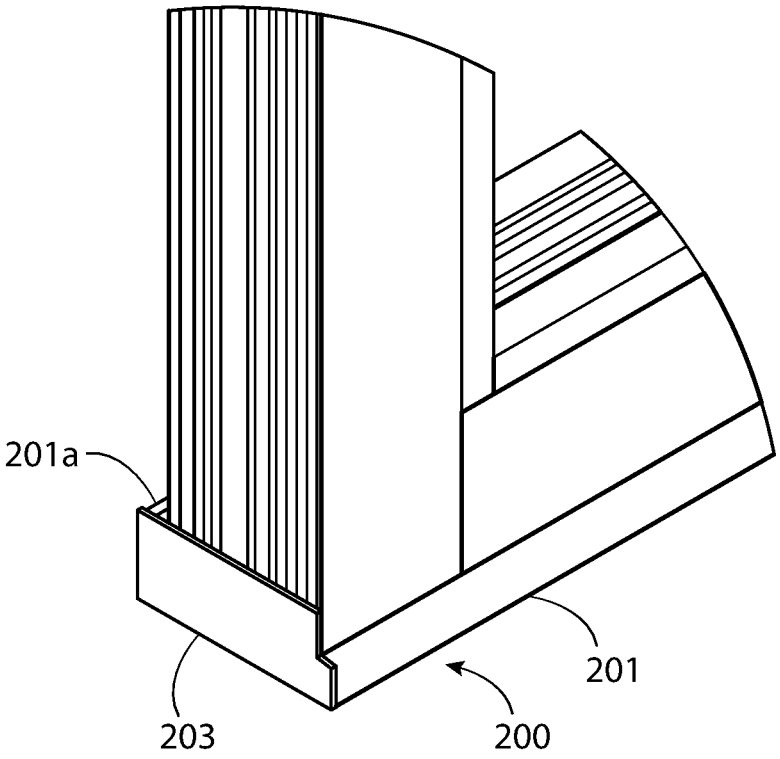
FIG. 26 illustrates a portion of the doorway assembly of FIG. 21, in front perspective view, and enlarged for magnification purposes.

Referring to FIGS. 23 and 25, the sill decks 202 raises the sidelite 204 and vertical jamb 210 a distance D2 above the floor level. Referring to FIGS. 24, 27, 28, 31, 32, and 41, the door 205 closes directly over the sill body 201. Referring to FIG. 24, the bottom of the door bottom rail 205*d* sits above the floor level a distance D2 allowing clearance for the door to swing. Referring to FIGS. 23-25, this arrangement aligns the bottom lengthwise edge of the sidelite bottom rail 204*d* (FIG. 23), the bottom lengthwise edge of the door bottom rail 205*d* (FIG. 24), and the bottom lengthwise edge of the vertical jamb 210 (FIG. 25). Note that the sill deck cover 213 in FIG. 24 is behind the door. The door sweep 214 provides weather sealing from the outside elements but allows accumulated water to drain out to the exterior environment.

Figure 42:
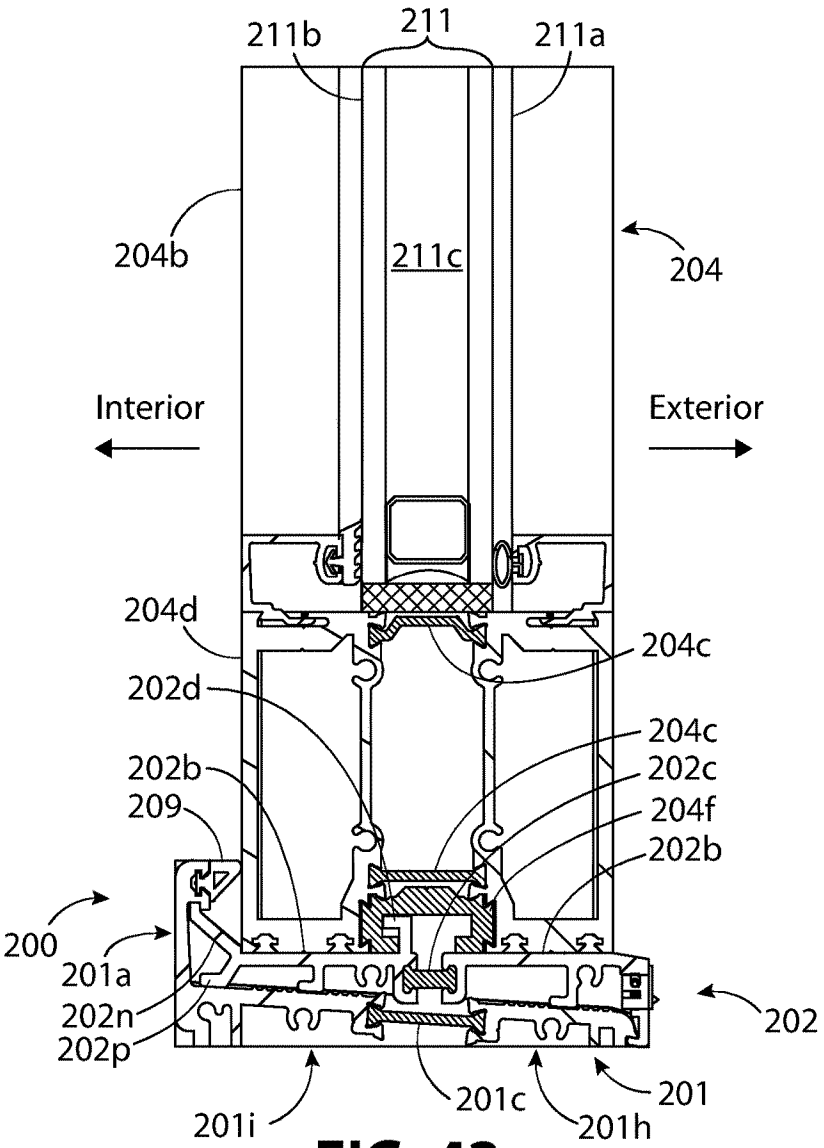
FIG. 42 illustrates an alternative section view of the doorway assembly of FIG. 21 taken along section lines 23-23 and utilizing the continuous sill of FIG. 33.
Figure 41:
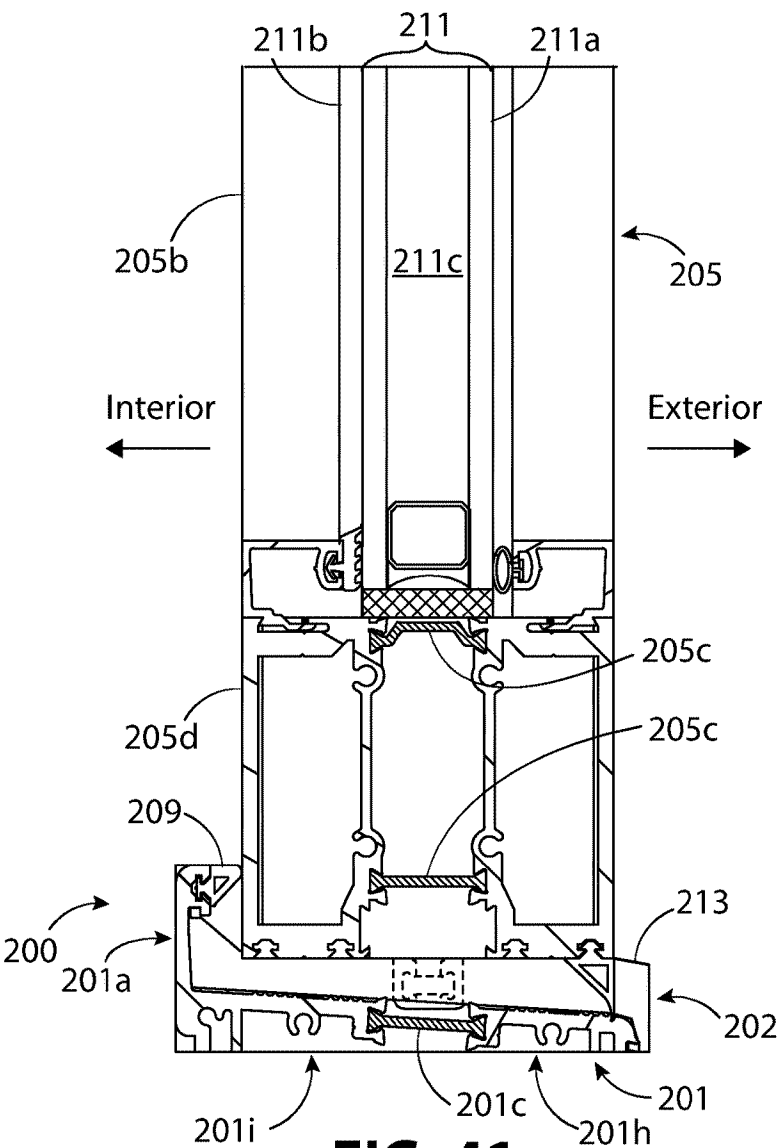
FIG. 41 illustrates an alternative section view of the doorway assembly of FIG. 21 taken along section lines 24-24 and utilizing the continuous sill of FIG. 33.
Figure 43:
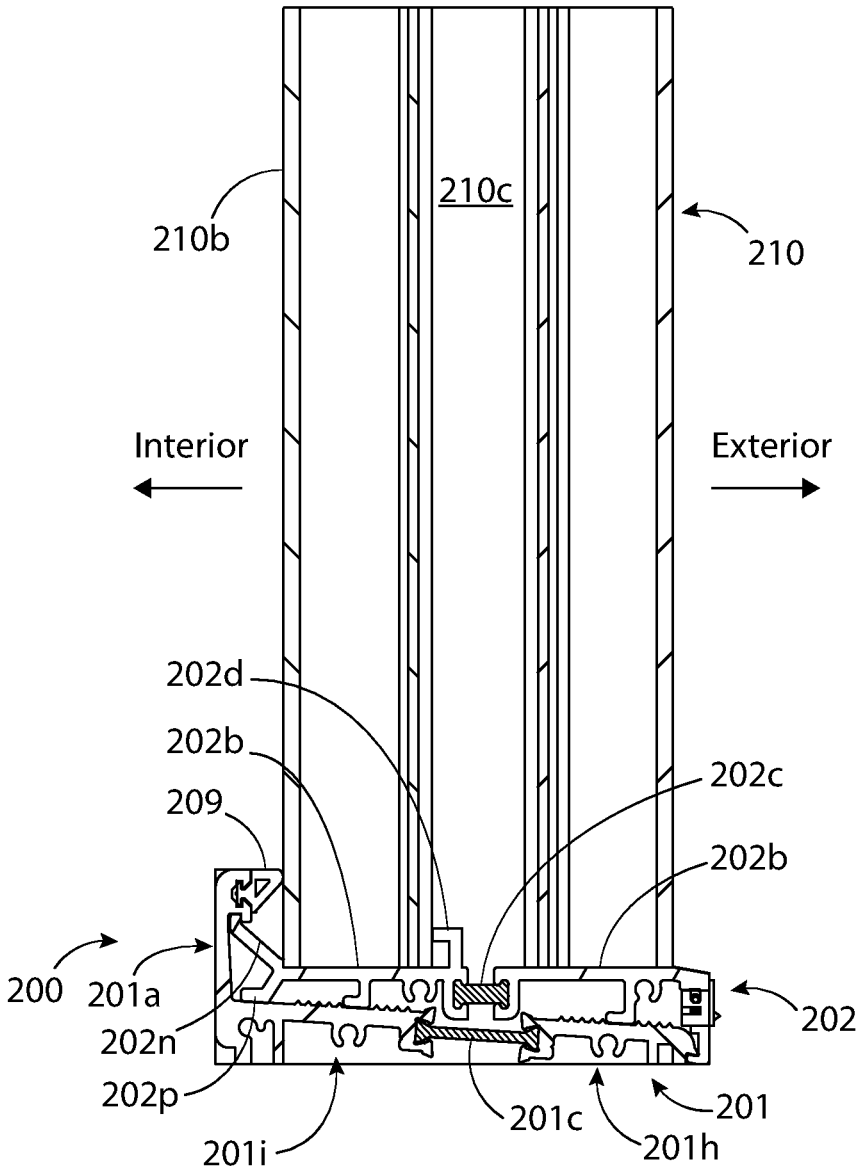
FIG. 43 illustrates an alternative section view of the doorway assembly of FIG. 21 taken along section lines 25-25 and utilizing the continuous sill of FIG. 33.
Figure 44:
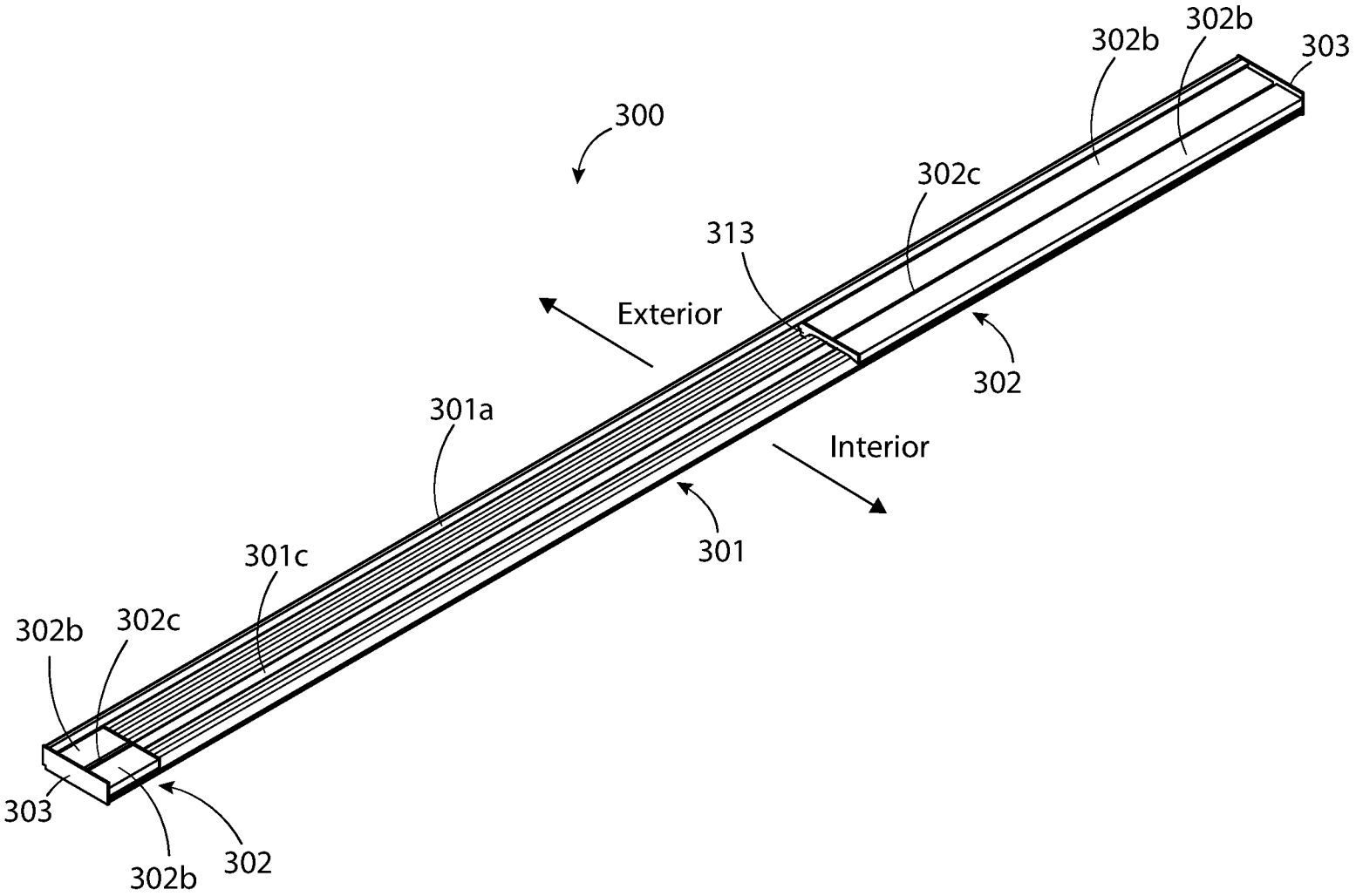
FIG. 44 illustrates a continuous sill for use with an inswing door and a sidelite, in front perspective view.
Figure 45:
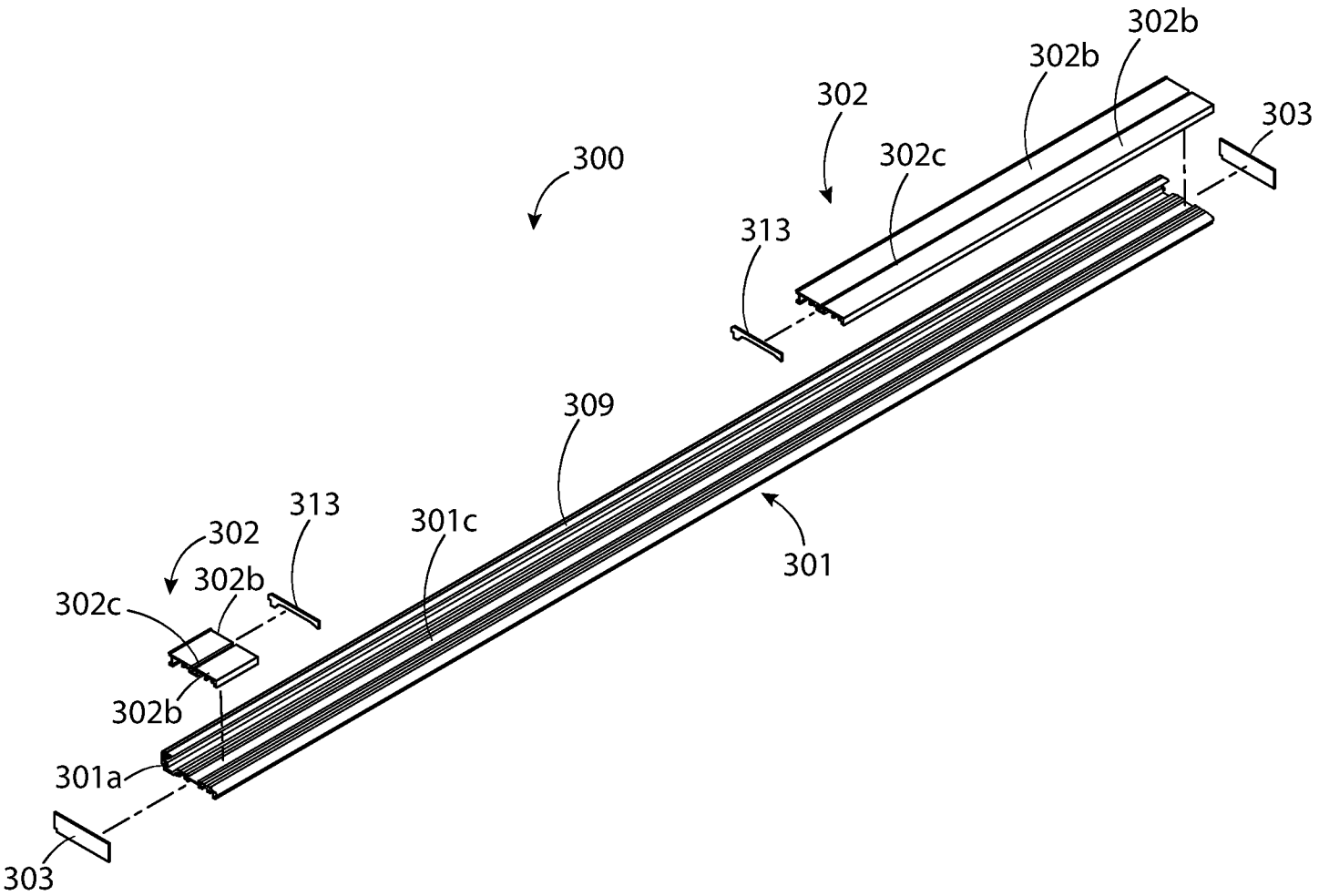
FIG. 45 illustrates the continuous sill of FIG. 44 in exploded perspective view.
Figure 46:
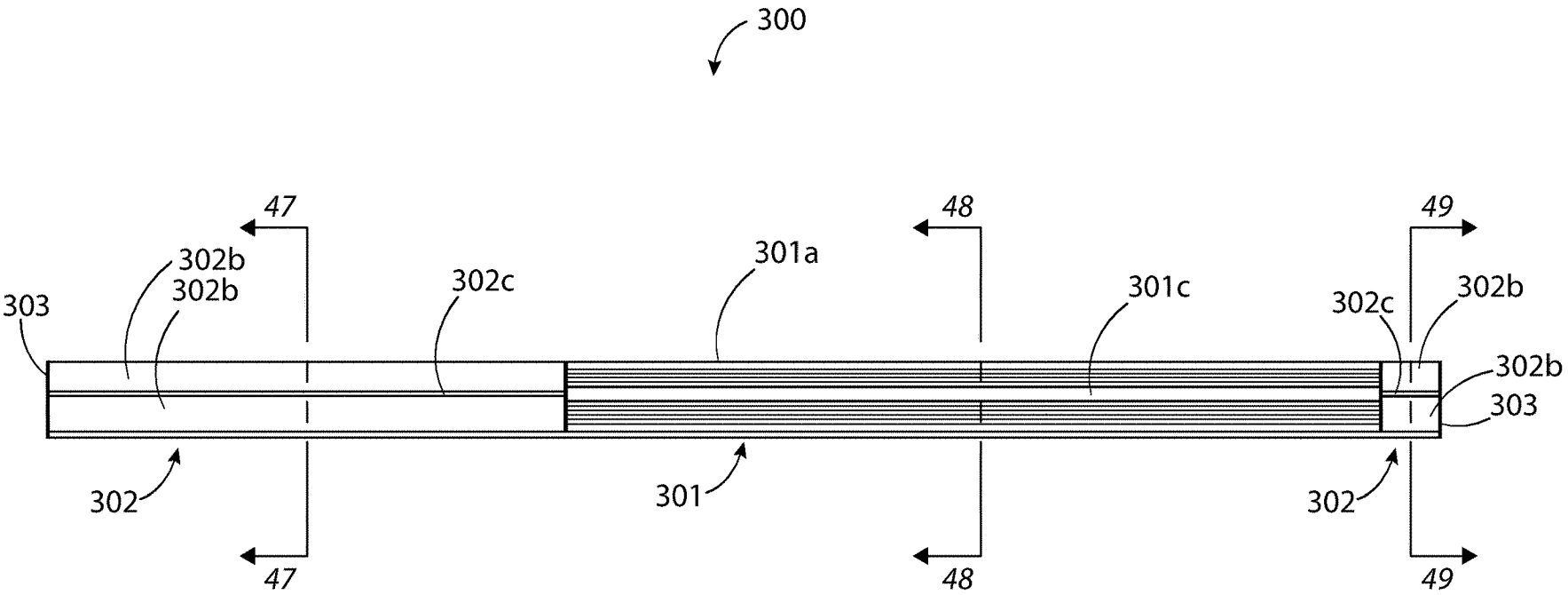
FIG. 46 illustrates a top view of the continuous sill of FIG. 44.
Figure 47:
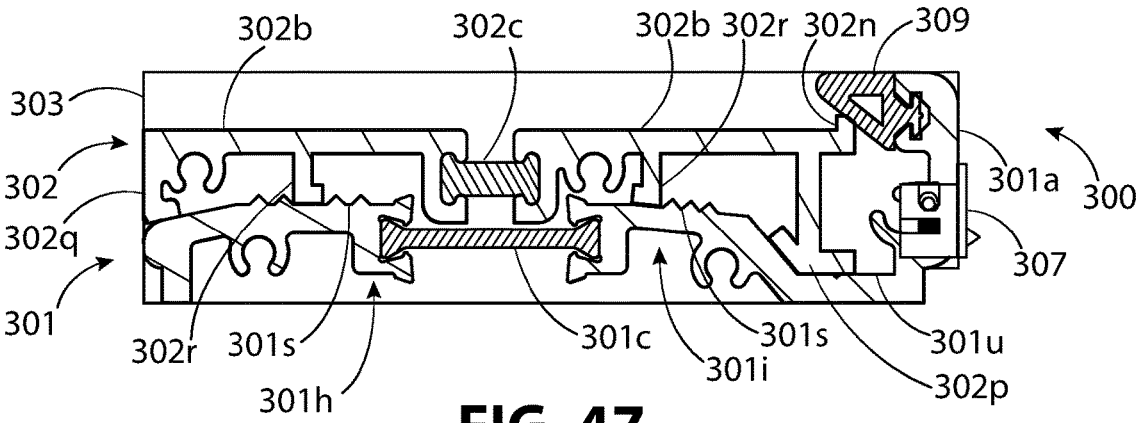
FIG. 47 illustrates a section view of the continuous sill of FIG. 46 taken along section lines 47-47.
Figure 48:
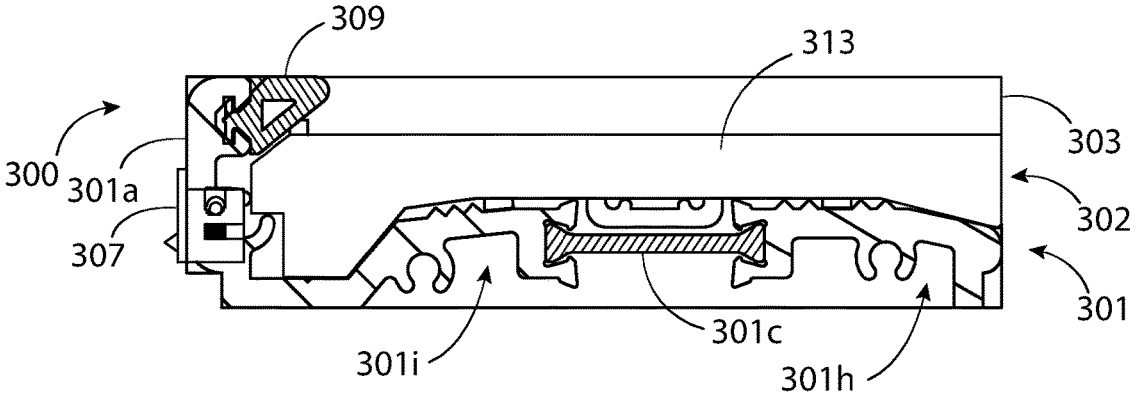
FIG. 48 illustrates a section view of the continuous sill of FIG. 46 taken along section lines 48-48.
Figure 49:
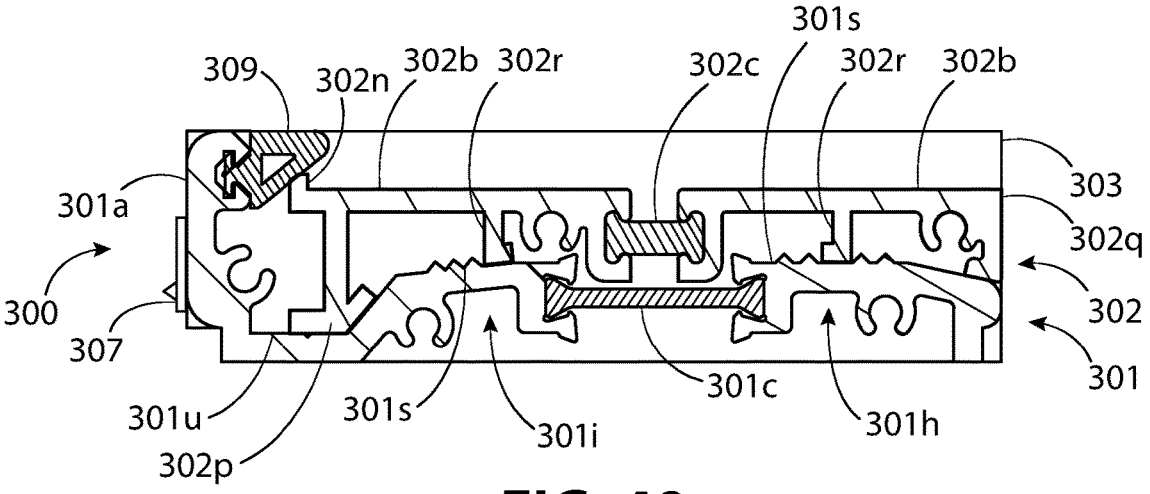
FIG. 49 illustrates a section view of the continuous sill of FIG. 46 taken along section lines 49-49.
Figure 68:
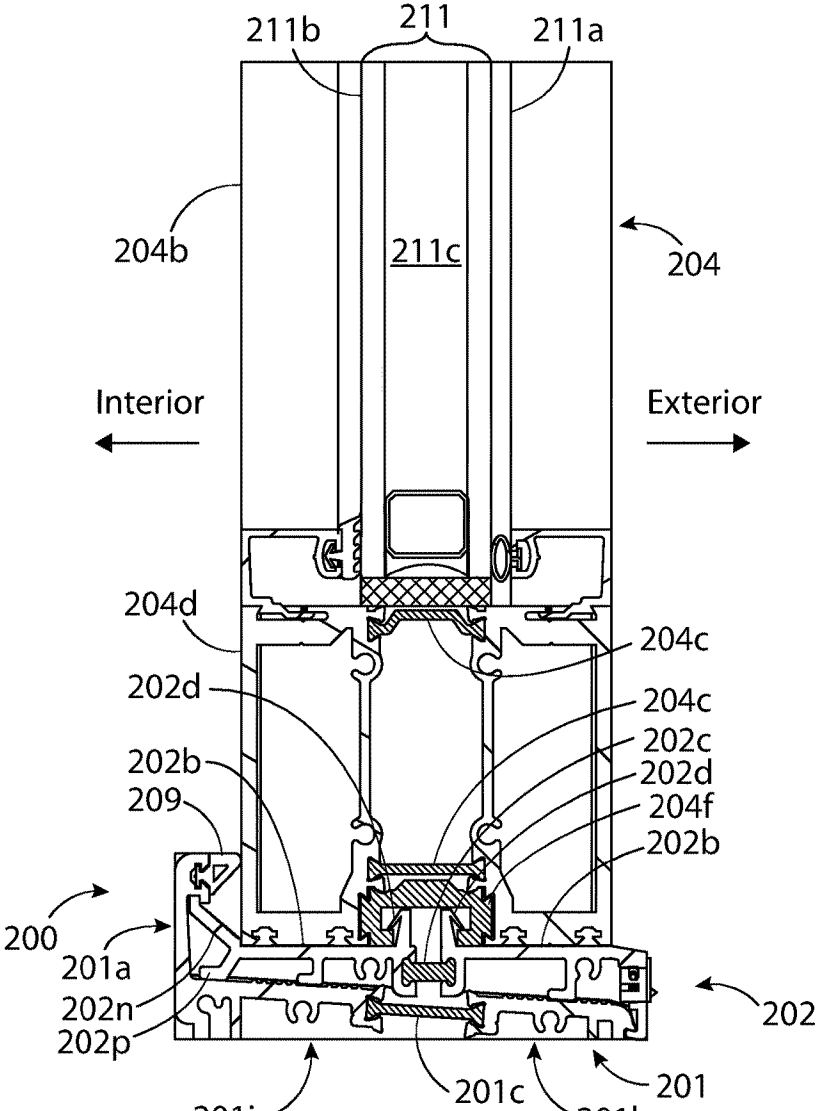
FIG. 68 illustrates an alternative version of the section view of FIG. 42 with an alternative version of the alignment portions.

Referring to FIGS. 23, 42, and 68, the thermal breaks 201*c*, 202*c* of the sill body 201 and the sill decks 202, respectively, can align, as illustrated, under the thermal break 204*c* of the sidelite 204. Referring to FIGS. 25 and 43, the thermal breaks 201*c*, 202*c* of the sill body 201 and the sill decks 202, respectively, can align, as illustrated, under hollow cavity 210*c* between thermal breaks (not shown) of the vertical jamb 210. Referring to FIGS. 24 and 41, in the closed position, the thermal breaks 201*c* of the sill body 201 can be aligned, as illustrated, under the thermal breaks 205*c* of the door 205. By the alignment described above, the inside-facing side of the door 205, the vertical jamb 210, the sidelite 204, sill body 201, and sill decks 202 can be thermally isolated from the exterior environment. Referring to FIGS. 23, 24, 41, 42, and 68 this includes the glazing panels 211 which are illustrated as an IGU. The glazing panels 211 can include a first glass panel 211*a* and a second glass panel 211*b* separated by a cavity 211*c* filled with either air or gas.

Figure 20:
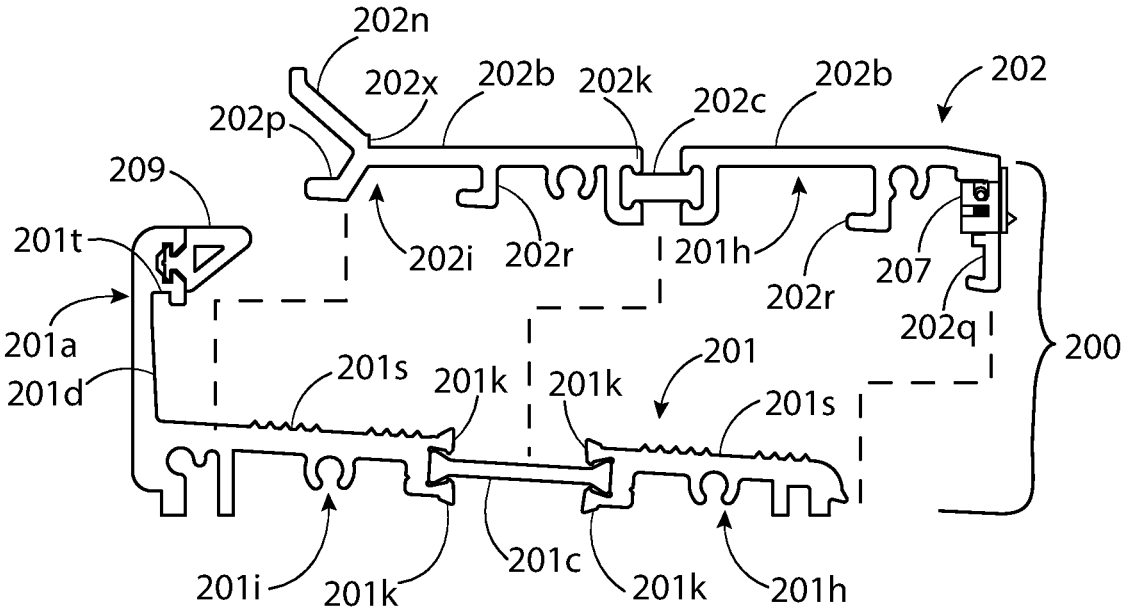
FIG. 20 illustrates a side exploded view of the continuous sill of FIG. 14.
Figure 39:
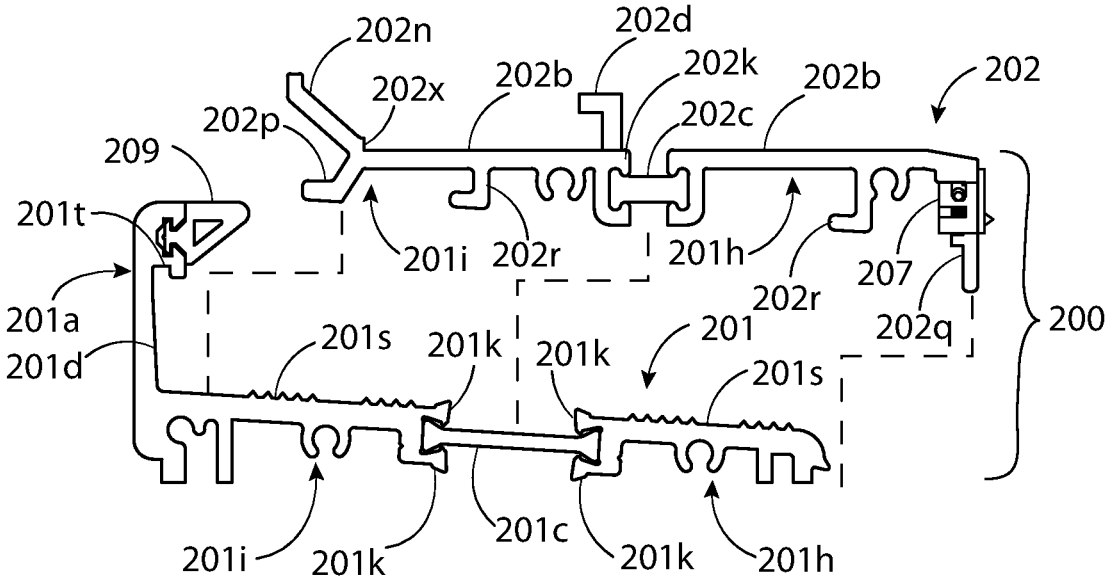
FIG. 39 illustrates an exploded side view of the sill of FIG. 33 with the end dam removed for clarity.
Figure 40:
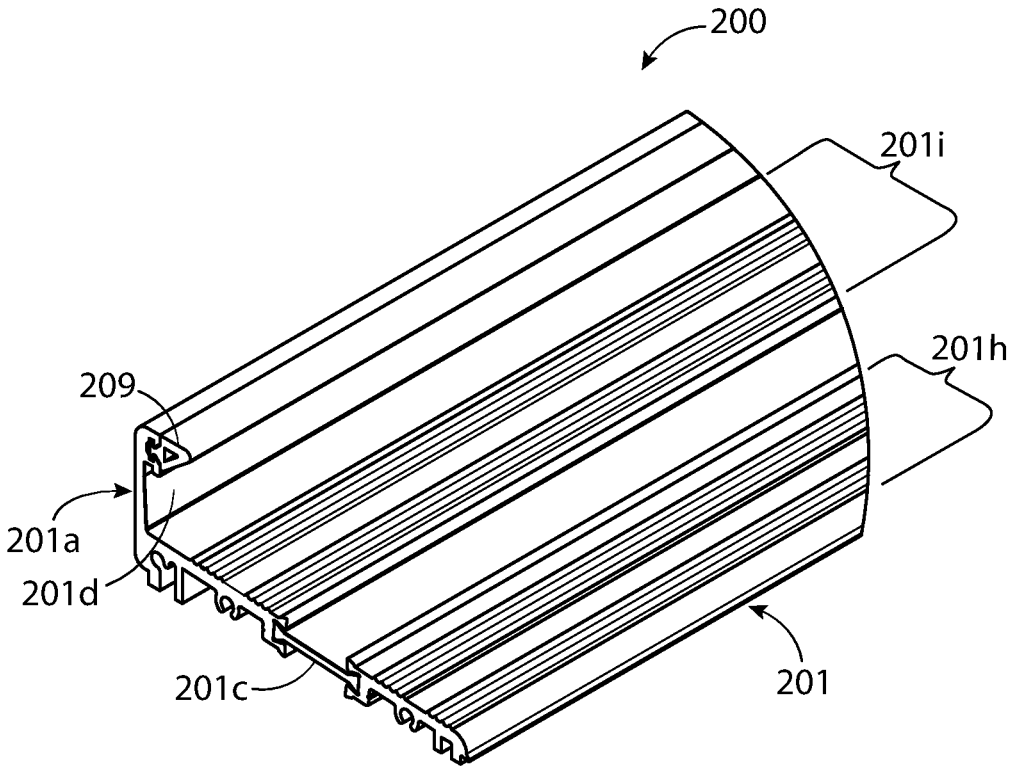
FIG. 40 illustrates a portion of the continuous sill of FIG. 34, in front perspective view, and enlarged for magnification purposes.

Referring to FIGS. 23, 42, and 68, gasket 209 helps to create an air-tight seal between the sill backstop 201*a* and the sidelite 204. Referring to FIGS. 15, 17-20, 23-25, 30, 34, 36-43, and 68, the gasket 209 can run either continuously, or in sections, across the sill backstop 201*a* in its entirety. This allows the gasket 209 to create an air seal across the sidelite 204 (FIGS. 23, 42 and 68), the door 205 (FIGS. 24 and 41), and the vertical jamb 210 (FIGS. 25 and 43). Referring to FIGS. 23-25, 41-43, and 68, the rear surfaces of the sidelite stiles 204*b* and sidelite bottom rail 204*d* (FIGS. 23, 42, and 68), the door stiles 205*b* and the door bottom rail 205*d* (FIGS. 24 and 41), and the vertical jamb 210 (FIGS. 25 and 43), all align in the same plane against the sill backstop 201*a* via the gasket 209. If the sidelite stiles 204*b*, sidelite bottom rail 204*d*, door stiles 205*b*, door bottom rail 205*d*, and the vertical jamb 210 are all the same thickness, then their front surfaces would also lie in the same plane, which could be aesthetically desirable. Referring to FIGS. 20 and 39, a notch 202*x* that projects perpendicularly from the horizontal surface 202*b* of the sill decks 202 can optionally help facilitate alignment of either the sidelite 204 of FIGS. 23 and 42 or the vertical jamb of FIGS. 25 and 43 against the sill backstop 201*a* so they lie in the same plane. Referring to FIGS. 42, 43, 68 the alignment portion 202*d* can align the sidelite 204 (FIG. 42) and the vertical jamb 210 (FIG. 43) against the sill backstop 201*a* in the same plane. Referring to FIGS. 42, and 68, the alignment portion 202*d* can also align the thermal break 202*c* of the sill decks 202 with the thermal breaks 204*c* and the cavity 211*c* of the glazing panels 211. Referring to FIGS. 42 and 68 the alignment portion 202*d* can also help secure the sidelite 204 to the sill decks 202 by a receiver 204*f* fitted within the sidelite 204. Here the receiver 204*f* is shown as a gasket fitted within a euro groove of the sidelite 204. The receiver 204*f* can also be integrated into the sidelite 204 (i.e. a portion of the sidelite 204). Referring to FIG. 43, while not illustrated, the vertical jamb 210 can optional include a receiver 204*f*, or can include an integral portion that performs the function of the receiver. For example, the vertical jamb 210 could include a euro groove. Alternatively, it could be optionally shaped to slidably receive the alignment portion 202*d*. Referring to FIG. 39, the alignment portion 202*d* can be L-shaped. The stem of the alignment portion 202*d* extends upward from the horizontal surface 202*b* of the sill decks 202. The arm of the alignment portion 202*d* extends directly away from the stem and toward the sill backstop 201*a*. In FIG. 39, the stem of the alignment portion 202*d* extends vertically upward from the horizontal surface 202*b* and the arm of the alignment portion 202*d* extends perpendicularly away from stem of the alignment portion 202*d* and horizontally toward the sill backstop 201*a*. The alignment portion 202*d* is shown as being integrally formed with the sill decks 202. However, the alignment portion 202*d* can be rigidly secured to the alignment portion by welding, adhesive, rivets, threaded fasteners or any other method of securing that creates a rigid bond capable of withstanding the forces encountered for a given installation. While the alignment portion 202*d* is shown as L shaped, it can be any shape capable of engaging the receiver 204*f* and aligning the sidelite 204. For example, the alignment portion 202*d* can be a simple upward projection where it could align the sidelite 204, allow it to slide, but would not be captively slidable as in the case of other shapes, for example an L-shaped bracket or a T-shaped bracket. The receiver 204*f* may optionally be shaped to captively and slidably engaging the receiver 204*f* (FIG. 42) or snap and lock into receiver 204*f* (FIG. 68), euro groove, or directly into the sidelite 204.

Referring to FIG. 68, the alignment portions 202*d* may optionally snap into the receiver 204*f*, directly into the euro groove, or directly into a receiver 204*f* integrated into the sidelite 204 (for example, directly into the sidelite 204 itself). The sill deck 202 includes two of the alignment portions 202*d*. Each of the alignment portions 202*d* is illustrated as barbed or hooked. The upper part is angled downward like an arrowhead and thinner than the main stem allowing it to flex. The upper portions of the alignment portions 202*d* project downward away from each other. This arrangement allows the sidelite 204 to be pressed downward against the receiver 202*f* and snap into place. As the sidelite 204 is pressed downward, the upper part of the alignment portions flex inward, allowing the alignment portions 202*d* to pass through the opening in the alignment portion. Once the alignment portions 202*d* pass through the opening and the pressure is release from the upper portions of the alignment portion 202*d*, the upper portions well expand out to their resting position as illustrated thereby securing the sidelite 204 to the sill deck 202.

Referring to FIGS. 17, 19, 20, 23, 25, 36, 37, 39, 42, 43, and 68, the sill decks 202 mounts to the sill body 201 as follows. The sill decks 202 includes a sill deck backstop 202*n* projecting upwardly and obliquely away from the end of the rear sill deck portion 202*i*. The sill deck backstop 202*n* can be hooked shaped as illustrated and can include an end portion that engages a groove 201*t* in the sill backstop 201*a* by pivoting the sill deck 202 downward toward the sill body 201. The end portion is shown as projecting vertically upward, however, any angle that in combination with the groove 201*t* creates a captive relationship between the end portion and groove 201*t* is acceptable. A first mounting portion 202*p* projects downwardly away from the end of the rear sill deck portion 202*i*. The front sill deck portion 202*h* and the rear sill deck portion 202*i*, each include a mounting portion 202*r* that projects downward from their respective bottom surfaces. Each of the mounting portions 202*r* includes a foot that planarly engages the top surfaces 201*s* of respective front sill portion 201*h* and rear sill portion 201*i* of the sill body 201 as the sill deck 202 is rotated downward toward the sill body 201. The front surface 202*q* of the sill deck 202 can snap into place against the front end of the sill body 201.

Referring to FIGS. 17-20, 23-25, 36-39, 40-43, and 68, the sill body 201 can include a front sill portion 201*h* and a rear sill portion 201*i* joined together by a thermal break 201*c*. The thermal break thermally isolates the front sill portion 201*h* from the rear sill portion 201*i*. The thermal break illustrated is in the form of a thermal strut and made of a thermally insulative material such as polyamide. Thermal struts can typically be crimped into place by large crimping rollers. The thermal breaks 201*c* can be crimped into grooves 201*k* (FIGS. 20 and 39) in the front sill portion 201*h* and the rear sill portion 201*i* as previously described. This can create a watertight seal across the front sill portion 201*h* and the rear sill portion 201*i*. Silicone or other waterproof sealant can be placed along the lengthwise seams of the thermal break 201*c* to enhance water tightness. The sill backstop 201*a* extends directly upward from the rear sill portion 201*i* of the sill body 201 and defines the back portion of the sill body 201. The rear sill portion 201*i* and the sill backstop 201*a* are integral and have a unibody construction. Typically, this is accomplished by extrusion for a sill body made of aluminum. The unibody construction assures that the inward-facing surface 201*d* (FIGS. 17, 19, 20, 36, 37, 39, and 40) of the sill backstop 201*a* in combination with the rear sill portion 201*i* are sealed and waterproof. In combination with the end dams 203 (FIGS. 17-19 and 36-38), provides a watertight seal and allows the sill body 201 to act both as a door sill and a sill pan.

Referring to FIGS. 14-17, 19, 20, 23, 25, 29, 30, and 33-39, the thermal breaks 202*c* thermally break the sill decks 202 between the front sill deck portion 202*h* and the rear sill deck portion 202*i*. The front sill deck portion 202*h* and the rear sill deck portion 202*i* are shown in FIGS. 17, 19, 20, 36, 37, and 39. Referring to FIGS. 20 and 39, the thermal break 202*c* can be crimped into grooves 202*k* in the front sill deck portion 202*h* and the rear sill deck portion 202*i* by large crimping rollers as previously described creating a watertight seal across the front sill deck portion 202*h* and the rear sill deck portion 202*i*. As previously described, silicone or other waterproof sealant can be placed also the lengthwise seams of the thermal break 202*c* to enhance water tightness.

Referring to FIGS. 15, 18, 24, 30, 34, 38, and 41, sill deck covers 213 are attached to the sides of the sill decks 202. The sill deck covers 213 face the door openings and create a finished appearance for the side of the sill assembly 200. The sill deck covers 213 also contain any water run-off from the top of the sill decks 202 to within the sill body 201 under the sill decks 202. Referring to FIGS. 23, 25, 42, 43, and 68, the sidelites 204 (FIGS. 23, 42, and 68) and the vertical jamb 210 (FIGS. 25 and 43) can be placed directly on the horizontal surfaces 202*b* of their respective 202 sill decks. They can also be placed with waterproofing silicone or a water-resistant gasket which would reduce the risk of water infiltration onto the sill decks 202. Referring to FIGS. 14, 15, 17, 19, 20, 23, 25, 29, 33, 34, 36, 37, and 39, a weep flap 207, or alternatively a weep hole, can optionally be positioned through the front surface 202*q* (FIGS. 17, 19, 20, 36, 37, and 39) of the sill decks 202. Referring to FIGS. 17, 19, 20, 36, 37, and 39, the top surfaces 201*s* of the sill body 201 are angled downward toward the front of the sill body 201. Any water that might accumulate on the sill decks 202 and leak through to the sill body 201 would tend to flow to the front of the sill body 201 and drain out the weep flaps 207.

Figure 7:
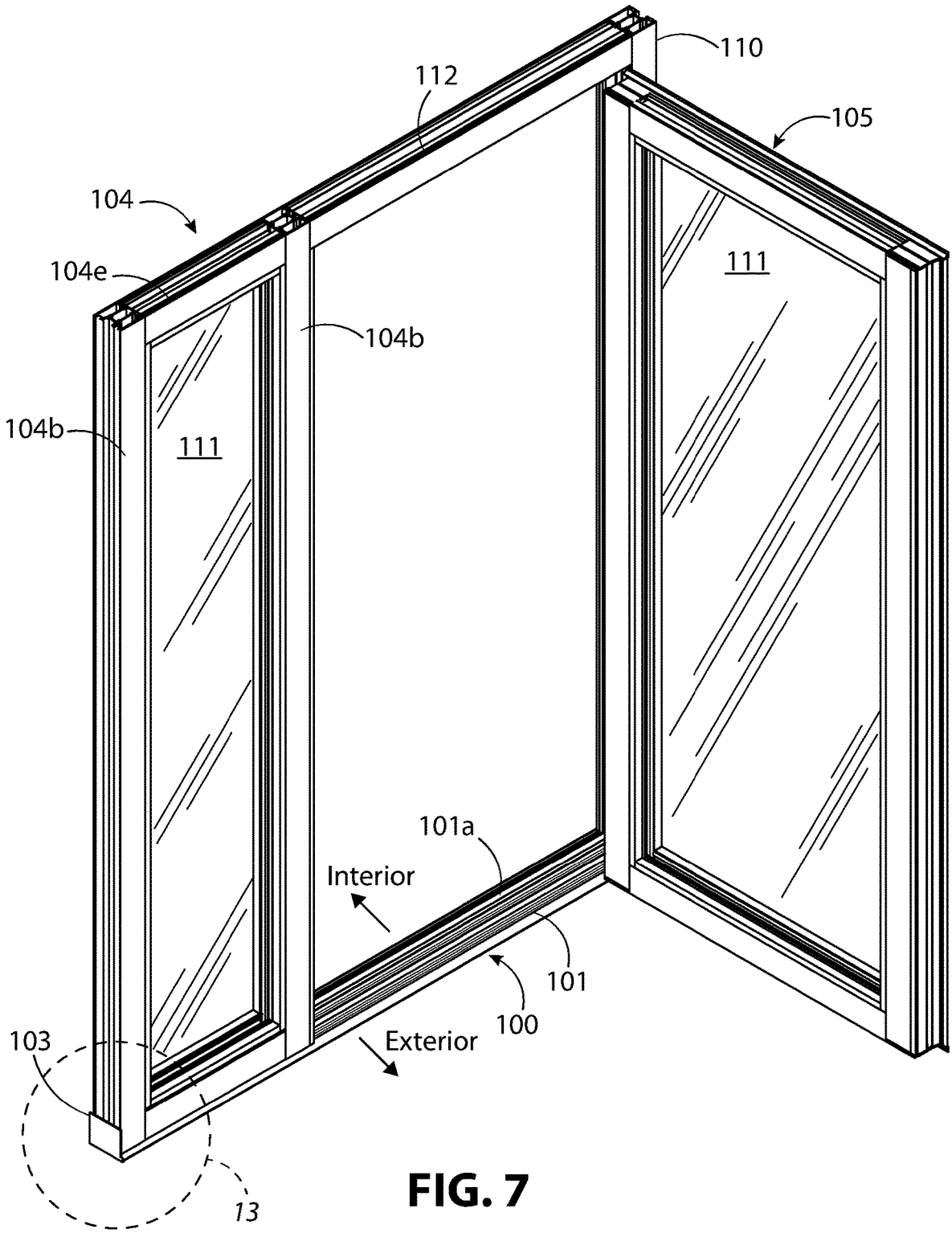
FIG. 7 illustrates a doorway assembly including an outswing door, a sidelite, and incorporating the continuous sill of FIG. 1, in front perspective view.
Figure 8:
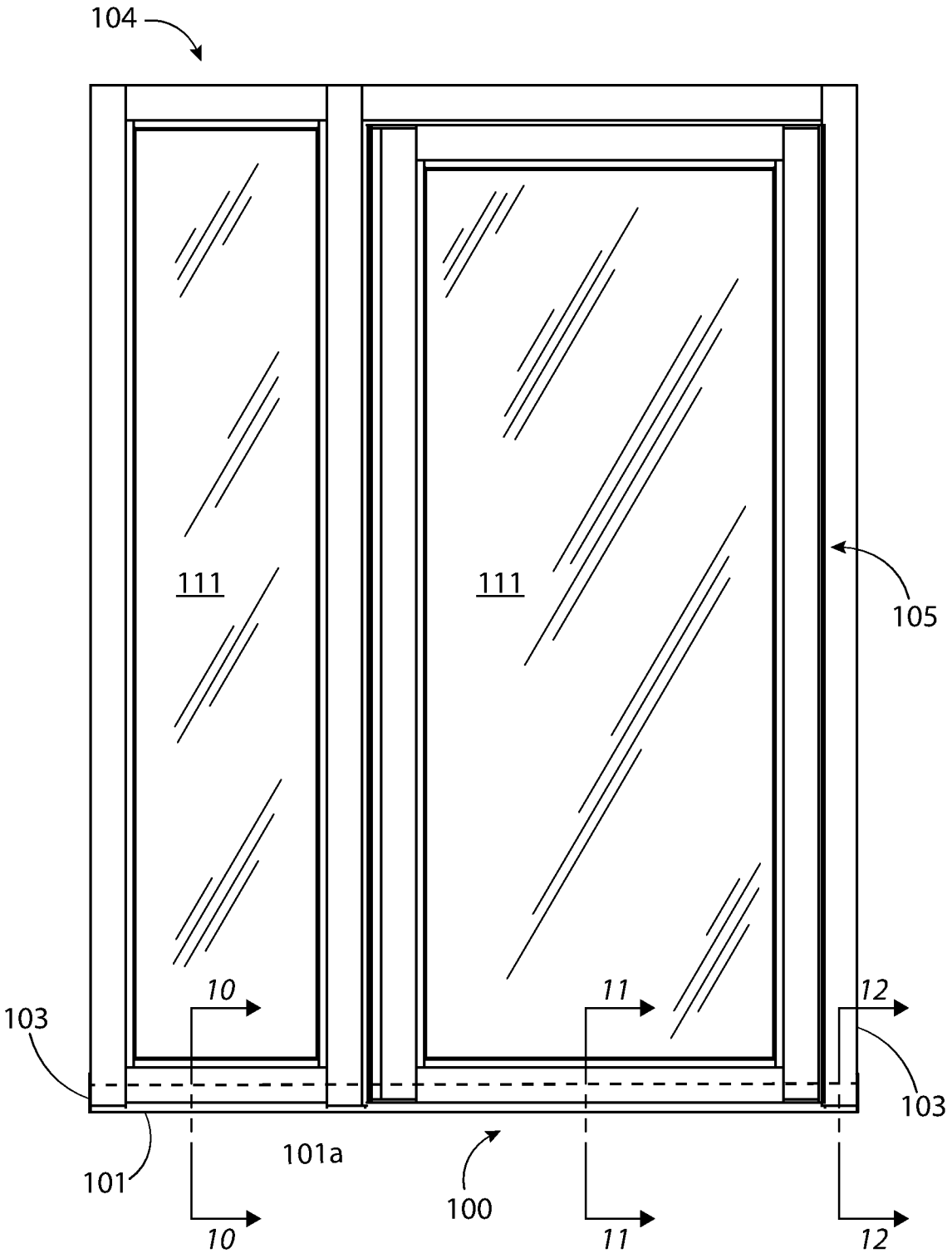
FIG. 8 illustrates a front view of the doorway assembly of FIG. 7.
Figure 9:
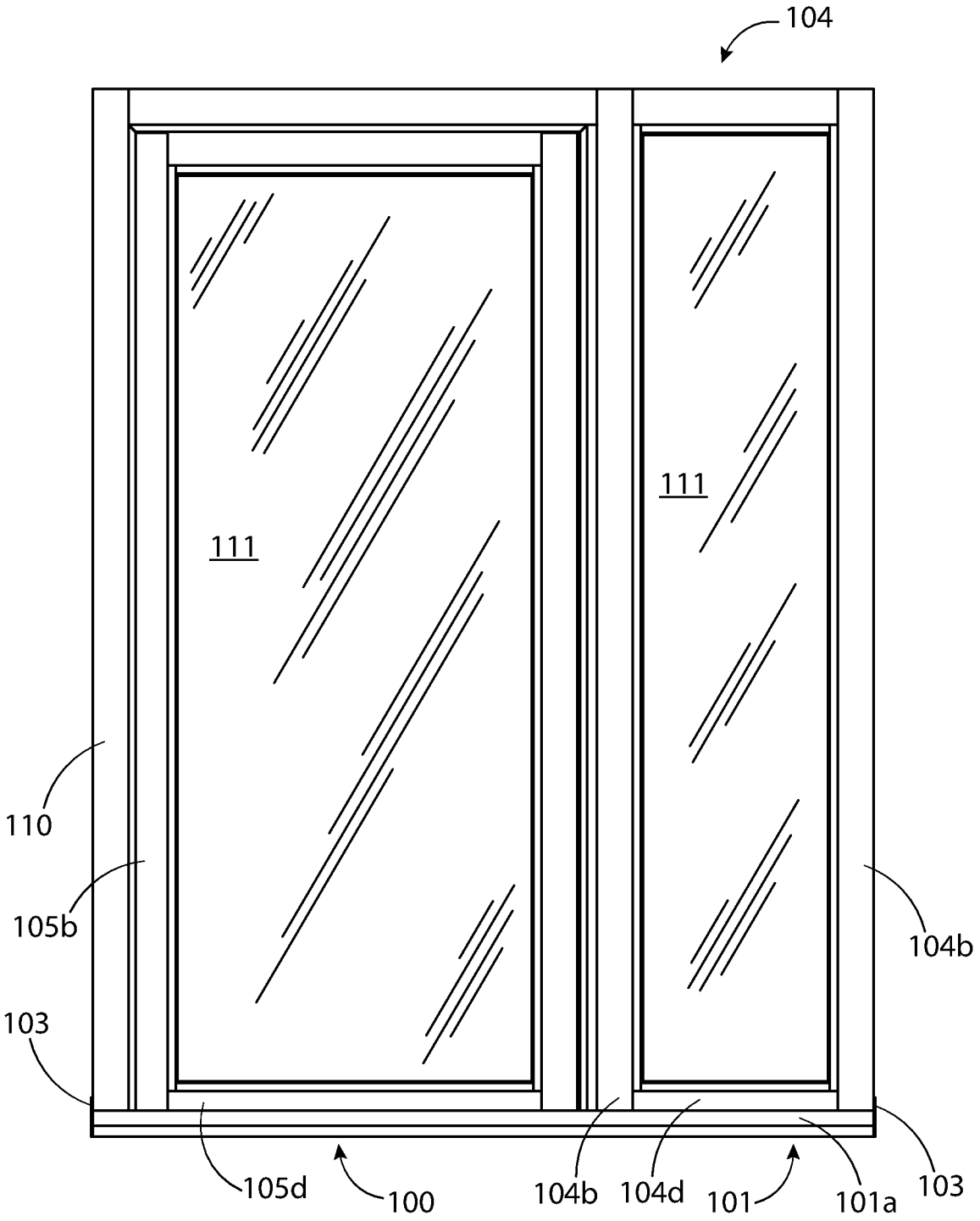
FIG. 9 illustrates a rear view of the doorway assembly of FIG. 7.
Figure 27:
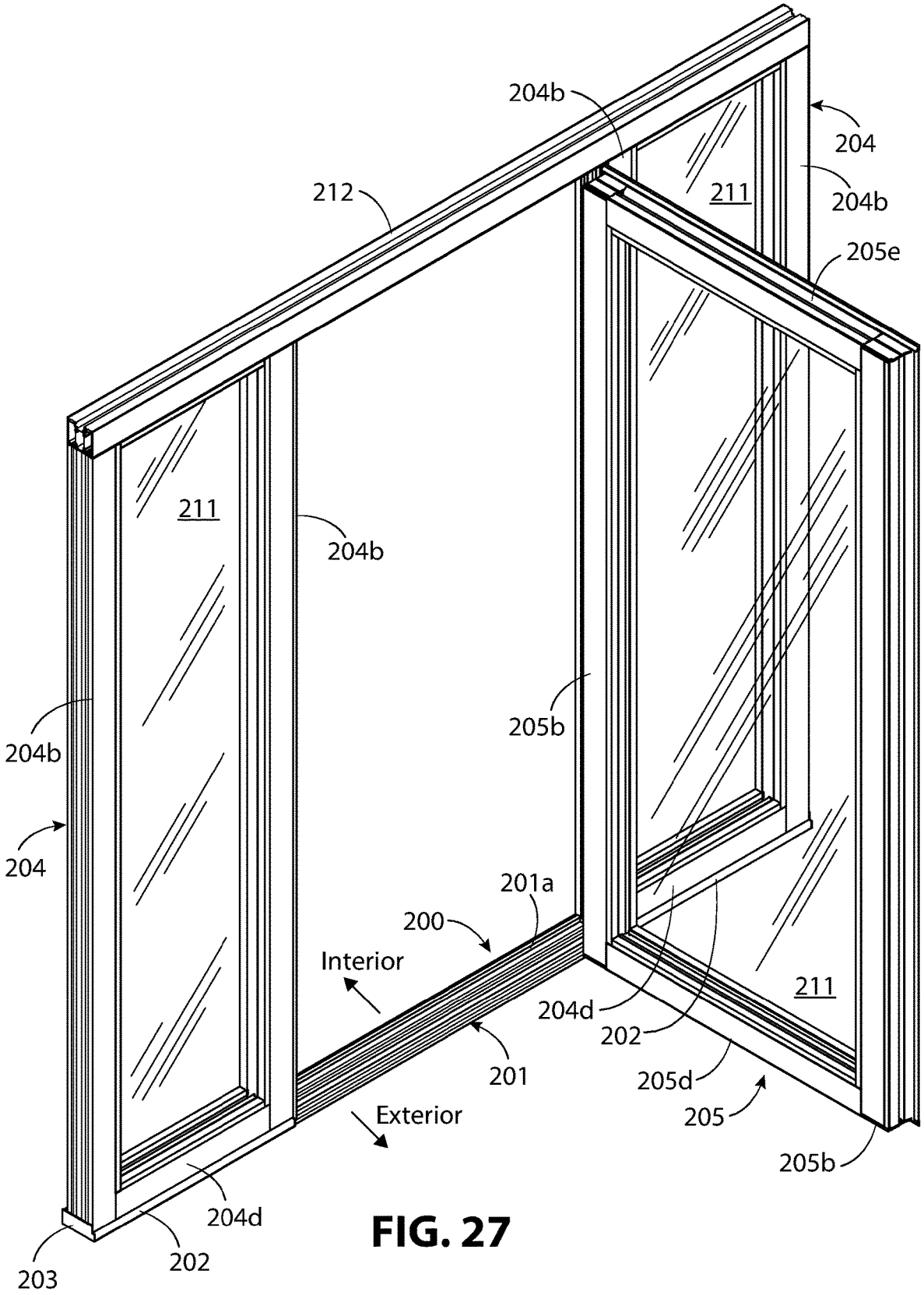
FIG. 27 illustrates a front perspective view of a doorway assembly including an outswing door, two sidelites, a continuous header, and incorporating an extended version of the continuous sill of FIG. 14.
Figure 28:
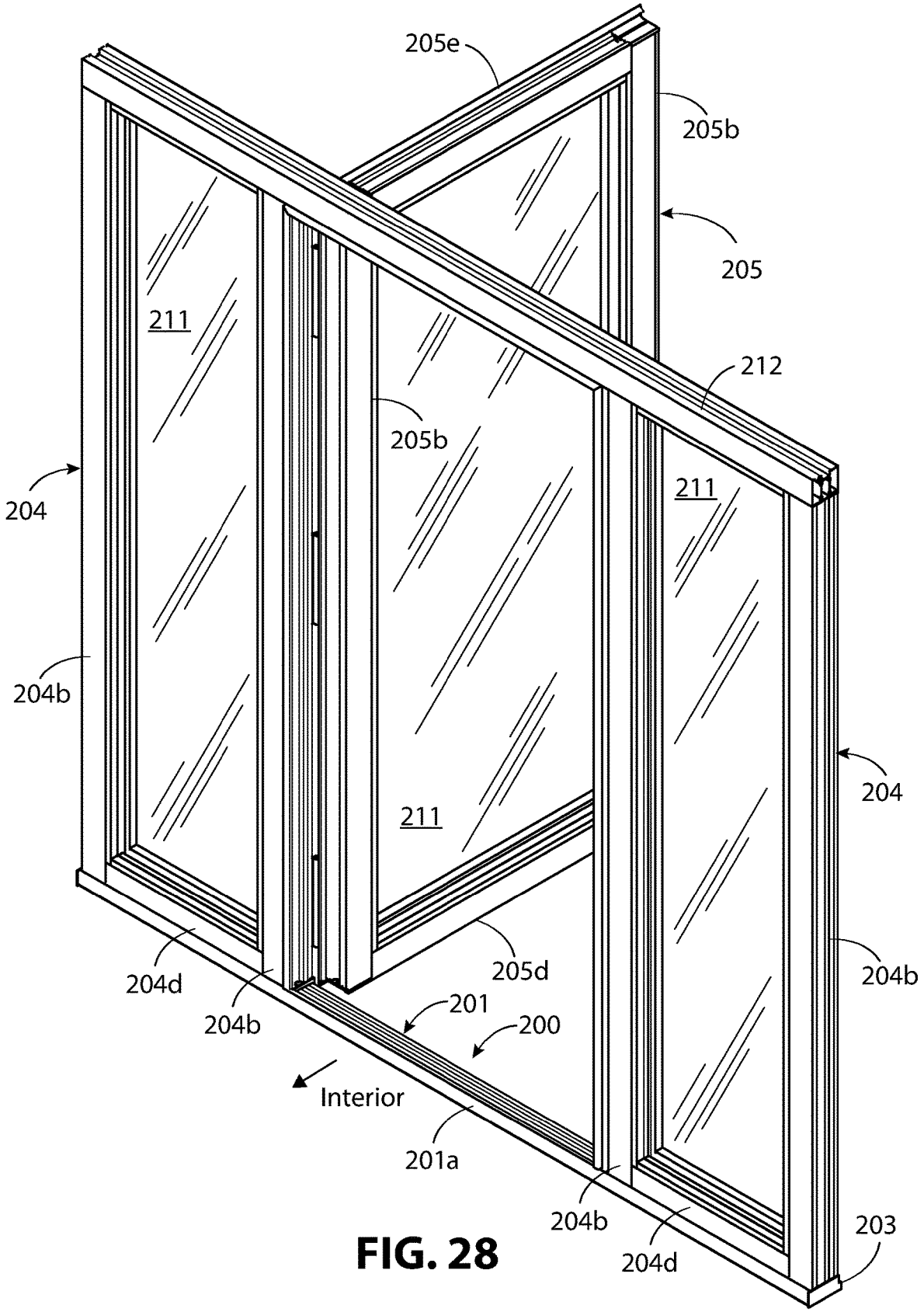
FIG. 28 illustrates a rear perspective view of the doorway assembly of FIG. 27.
Figure 29:
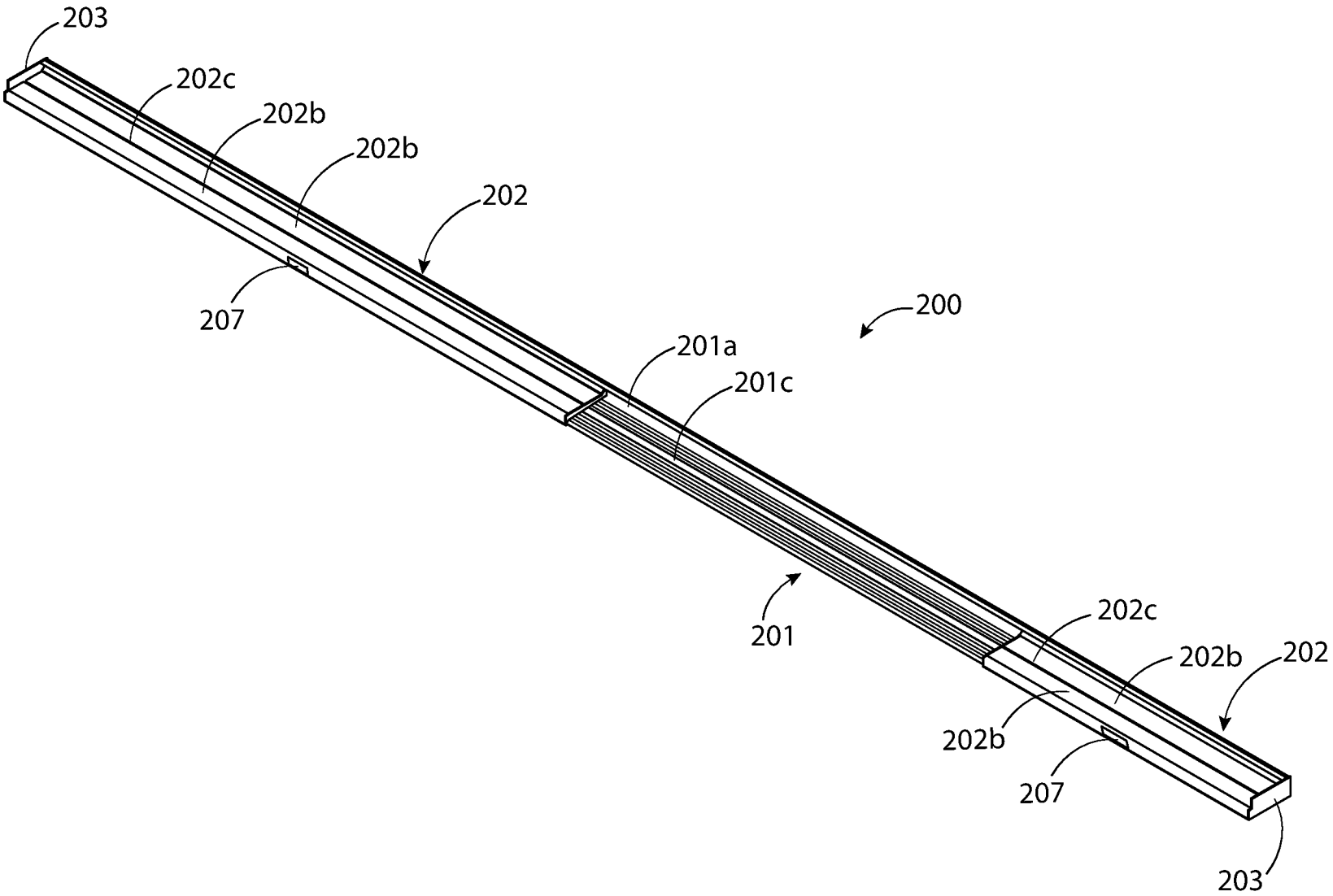
FIG. 29 illustrates an extended version of the continuous sill of FIG. 14 capable of being used with an outswing door and three sidelites.
Figure 30:
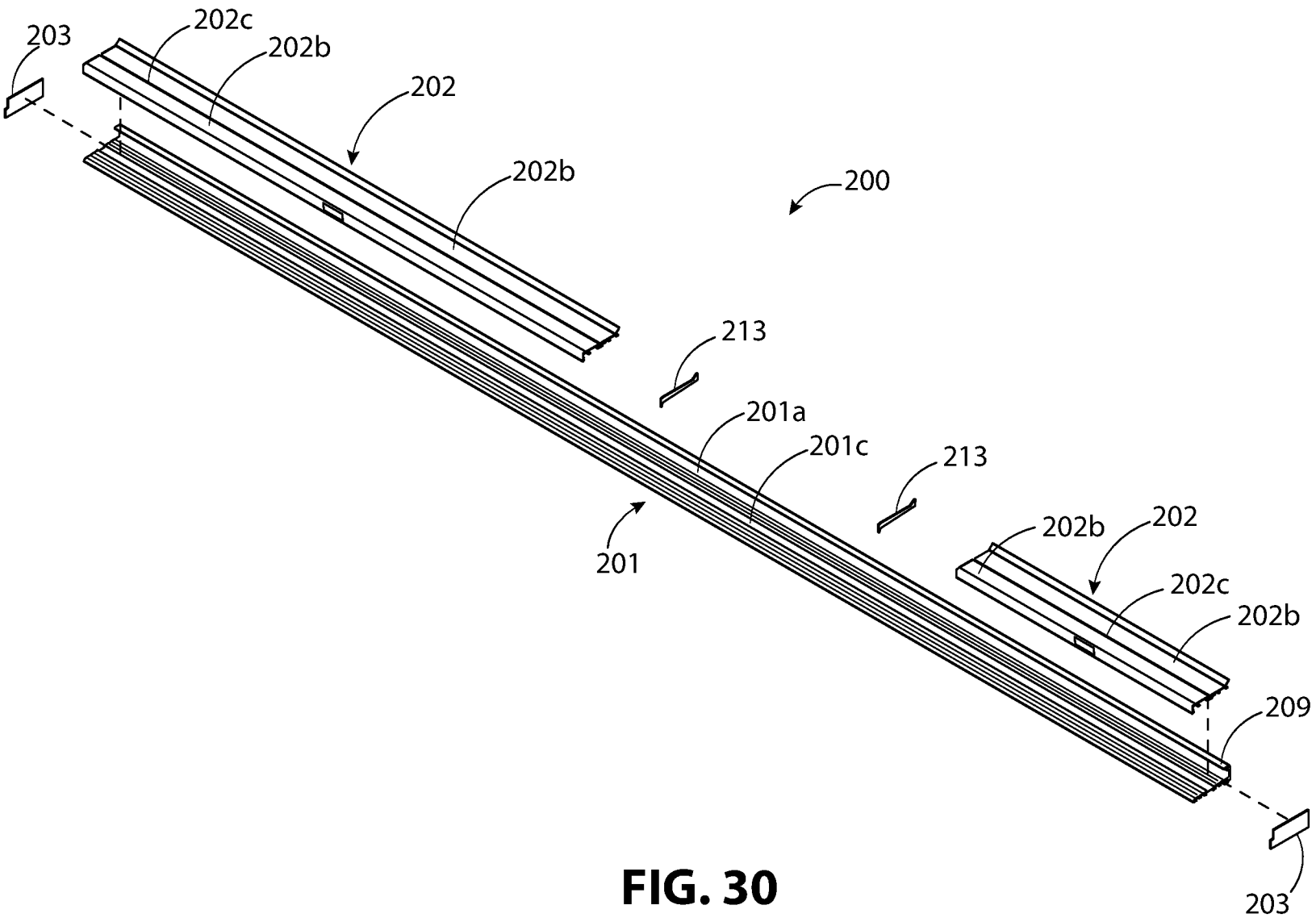
FIG. 30 illustrates an exploded front perspective view of the continuous sill of FIG. 29.
Figure 31:
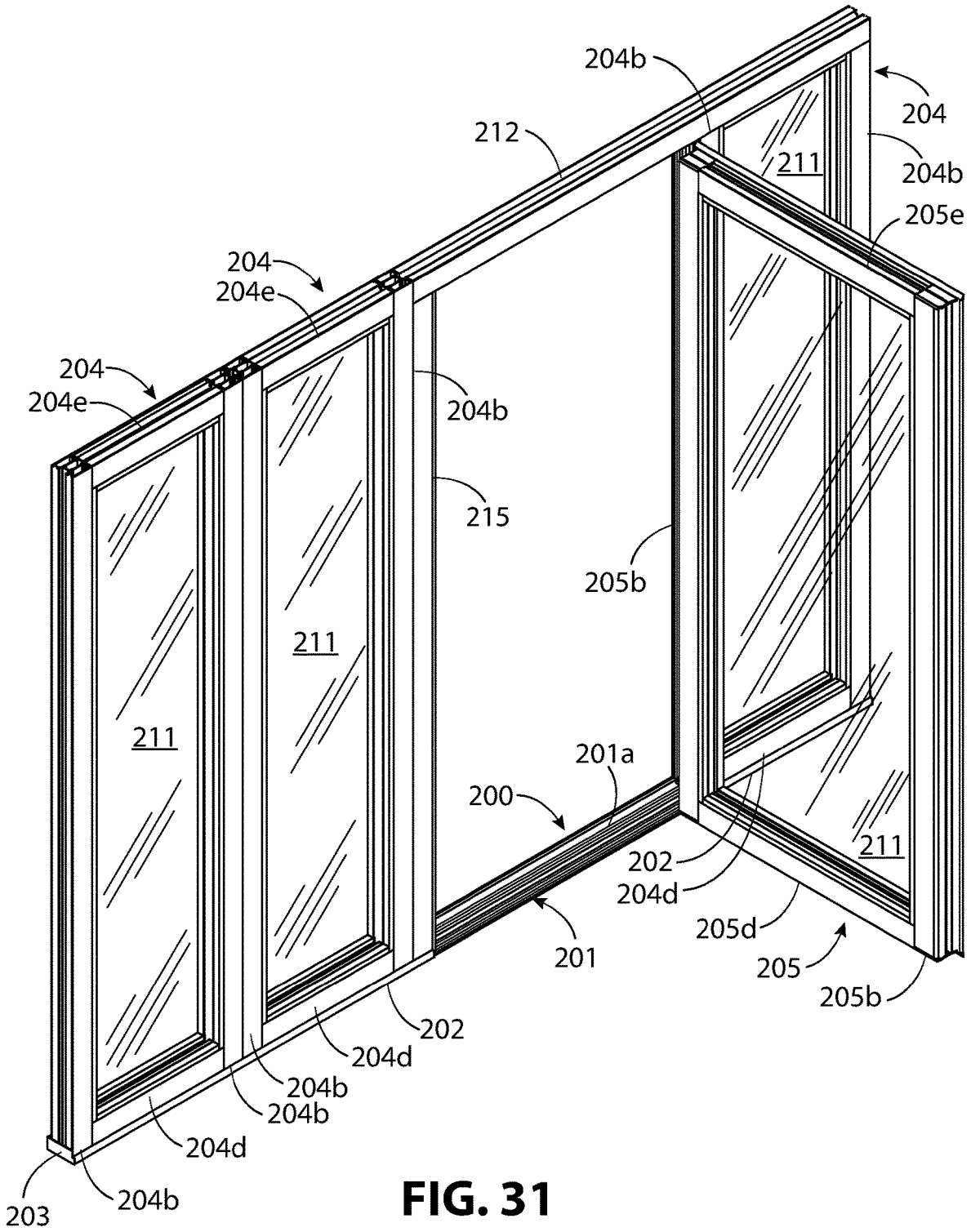
FIG. 31 illustrates a front perspective view of a doorway assembly including a swing door, three sidelites and incorporating the continuous sill of FIG. 29.
Figure 32:
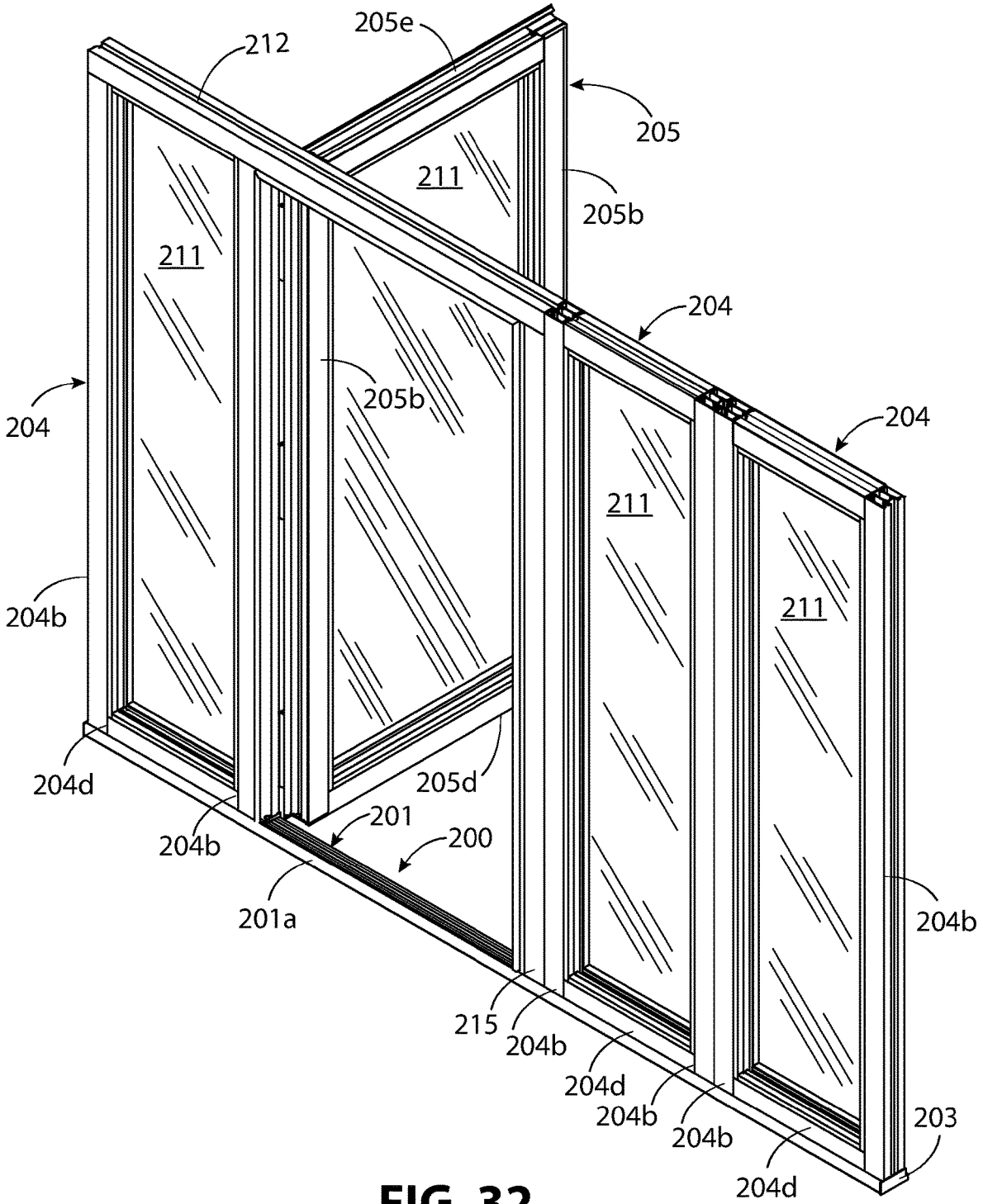
FIG. 32 illustrates a rear perspective view of the doorway assembly of FIG. 29.
Figure 33:
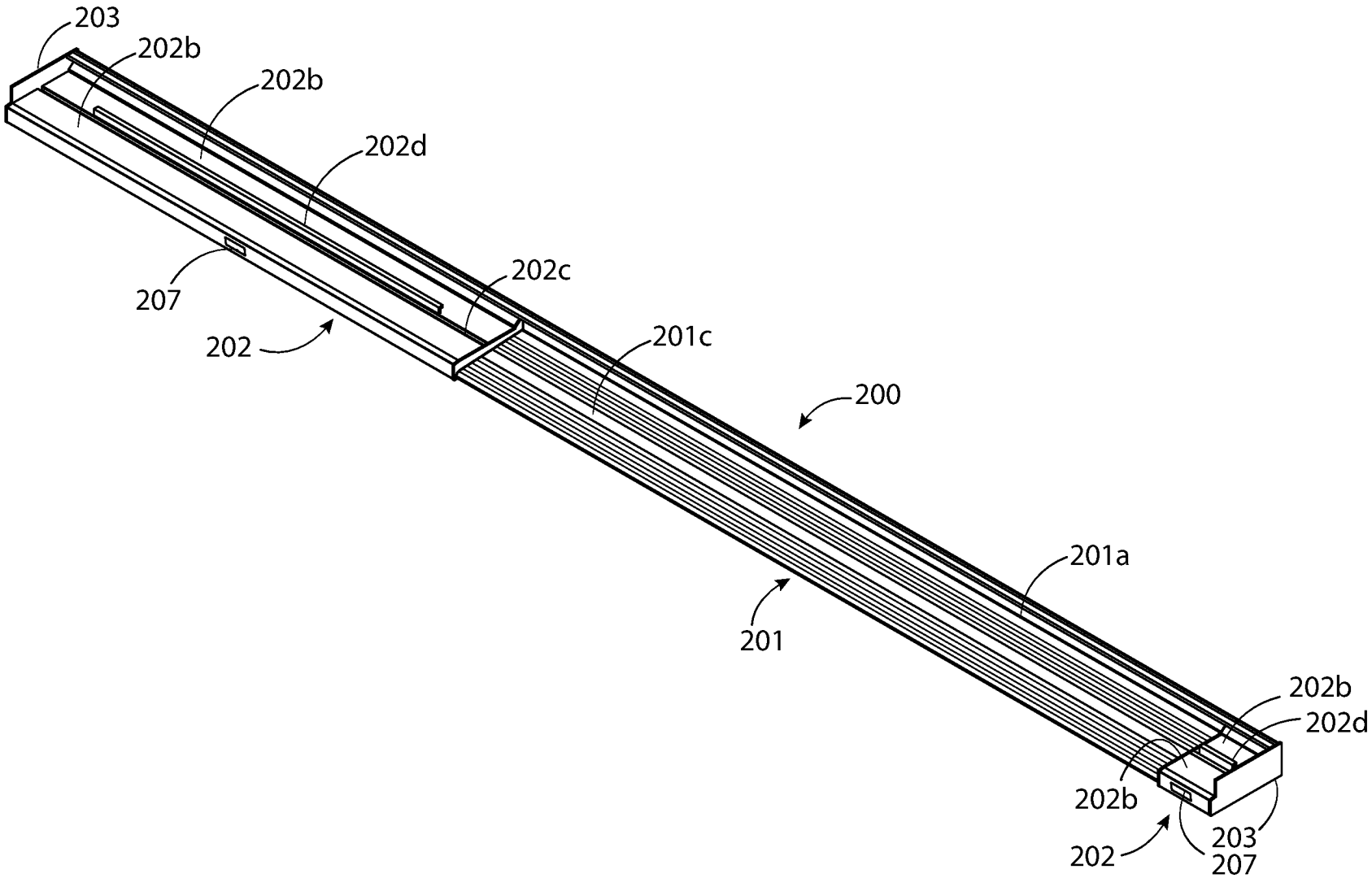
FIG. 33 illustrates a continuous sill, similar to the continuous sill of FIG. 14, in front perspective view, with the addition of alignment portion brackets for aligning and securing the sidelites and door jambs.
Figure 34:
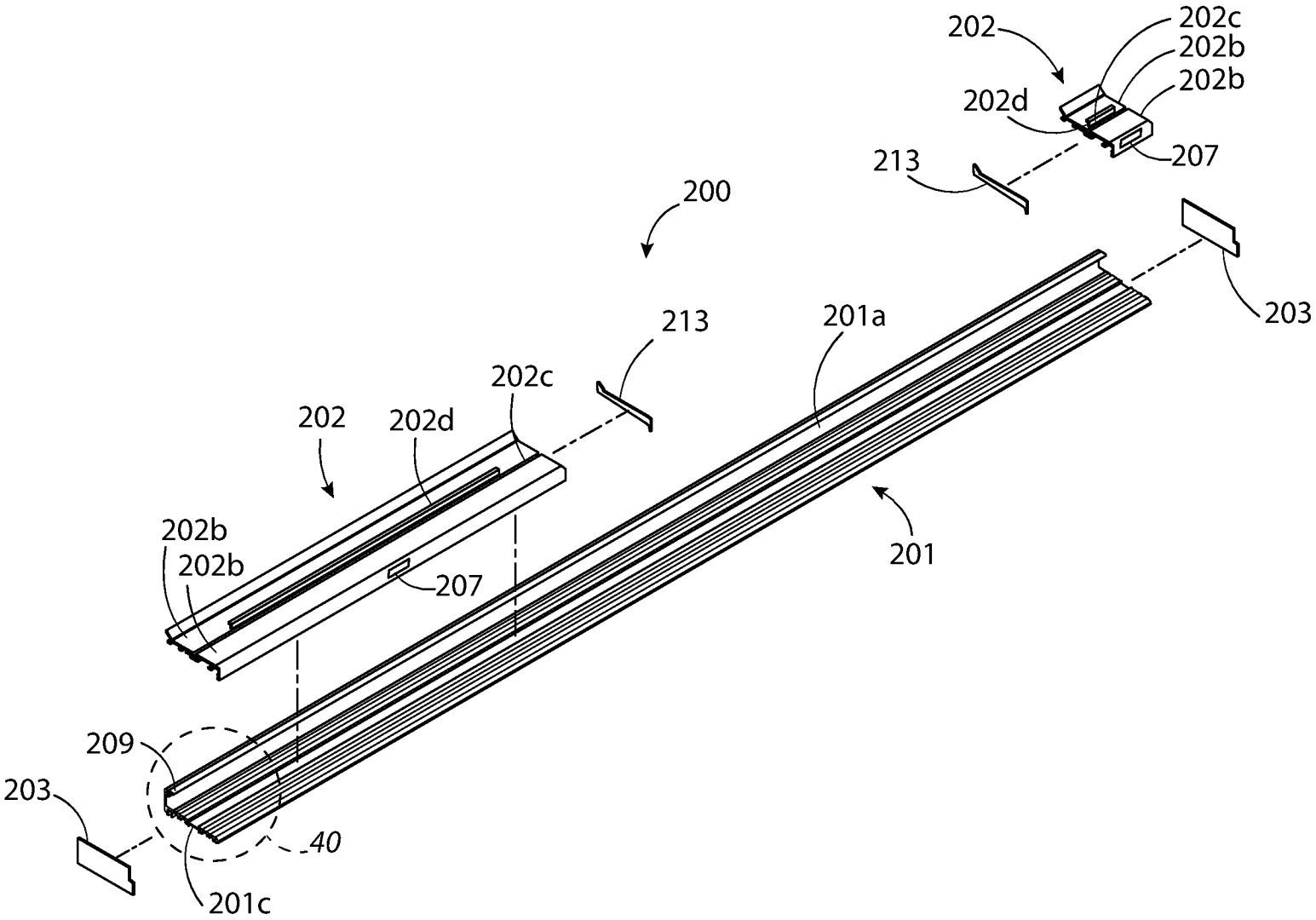
FIG. 34 illustrates the continuous sill of FIG. 33 in exploded perspective view.
Figure 35:
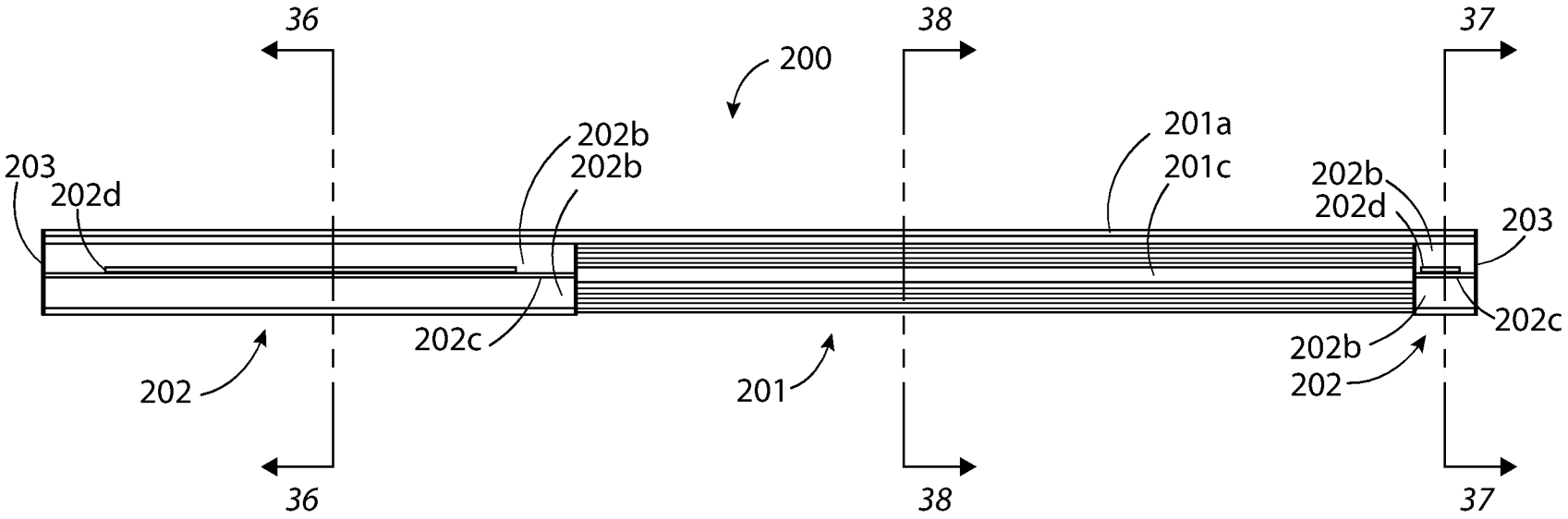
FIG. 35 illustrates a top view of the continuous sill of FIG. 33.
Figure 36:
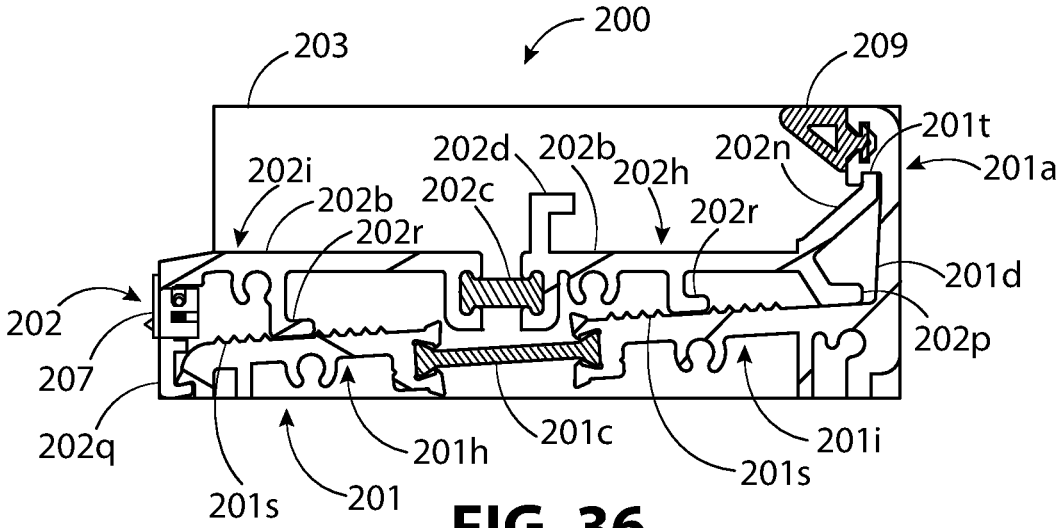
FIG. 36 illustrates a section view of FIG. 35 taken along section lines 36-36.
Figure 37:
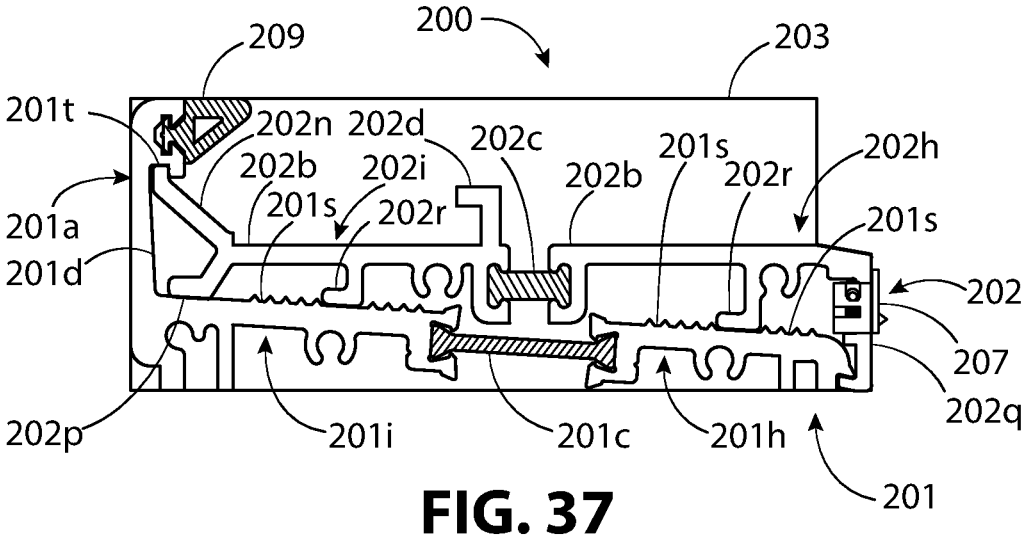
FIG. 37 illustrates a section view of FIG. 35 taken along section lines 37-37.
Figure 38:
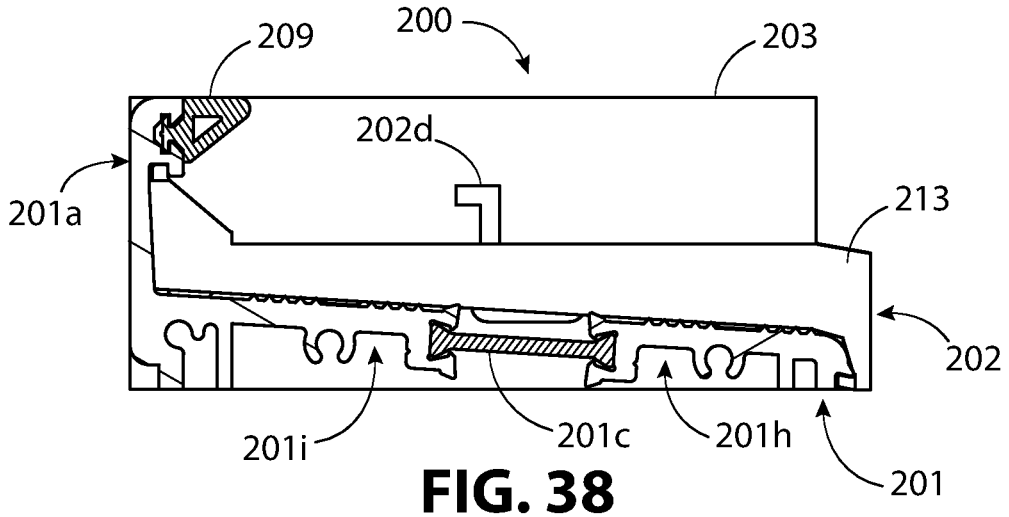
FIG. 38 illustrates a section view of FIG. 35 taken along section lines 38-38.

One of the advantages of the sill assemblies, such as sill assembly 100 of FIGS. 1-13, sill assembly 200 of FIGS. 14-43, and 68, and sill assembly 300 of FIGS. 44-67, and 69, is that they can be adapted to a wide range of door openings. For example, FIG. 7 shows a door passage with one of the sidelites 104 mounted to the left side of the door opening using sill assembly 100. FIGS. 27 and 28 show front and rear perspective views, respectively, of a door opening with one of the sidelites 204 mounted on either side of the door using sill assembly 200. FIGS. 31 and 32 show front and rear perspective views, respectively, of a door opening with one of the sidelites 204 on the right side of the door and with two of the sidelites 204 on the left side of the door using sill assembly 200. The corresponding sill assembly 200 for FIGS. 31 and 32 is shown in perspective view in FIG. 29 and exploded perspective view in FIG. 30.

Figure 21:
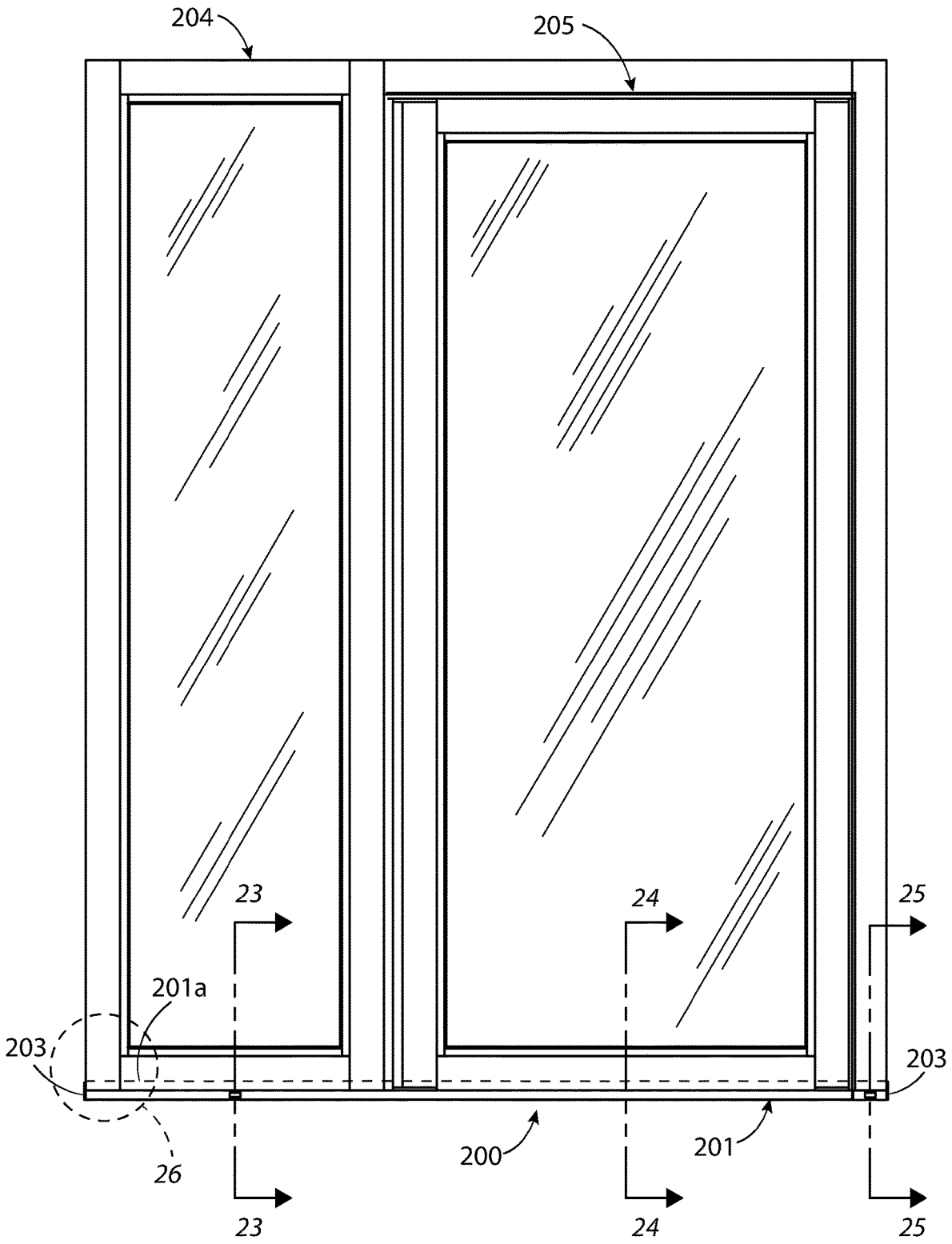
FIG. 21 illustrates a front view of a doorway assembly including an outswing door, sidelite, and incorporating the continuous sill of FIG. 14.
Figure 22:
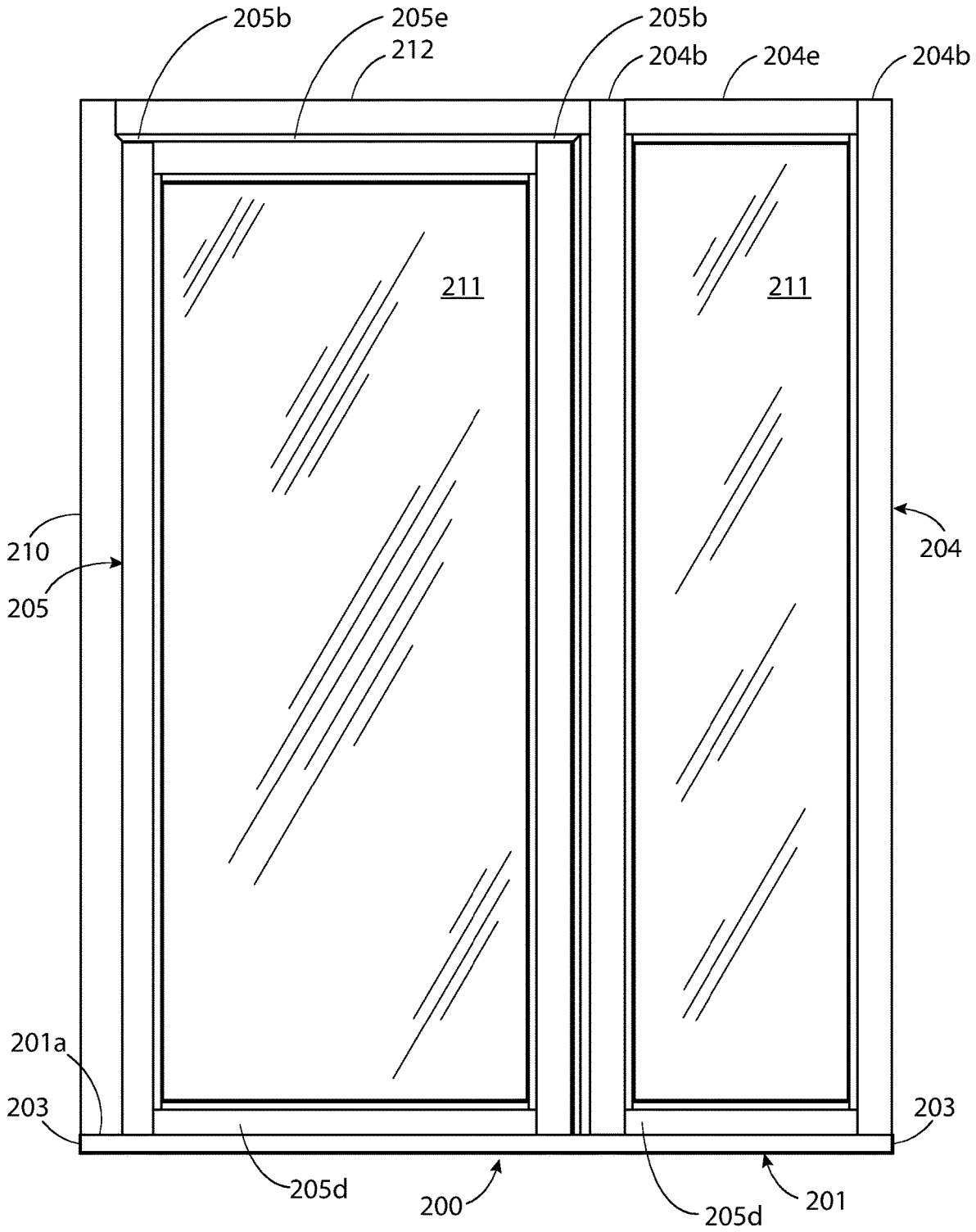
FIG. 22 illustrates a rear view of a doorway assembly including a swing door, sidelite, and incorporating the continuous sill of FIG. 14.

FIG. 7 shows an example of a "stick-built" doorframe. Instead of a continuous header, as in FIGS. 27 and 28, the top of the frame of the doorway is defined by the sidelite top rail 104*e*, the top of the sidelite stile 104*b*, a header 112 directly above the door 105, and the top of the vertical jamb 110. The doorframe of FIGS. 21 and 22 is similarly built as the doorframe of FIG. 7. Referring to FIG. 22, the top of the frame of the doorway includes the sidelite top rail 204*e*, header 212, sidelite stiles 204*b*, and the vertical jamb 210. Glazing panel 211 of the door 205 is surrounded on either side by door stiles 205*b*, on the top by door top rail 205*e*, and on the bottom by door bottom rail 205*d*. Glazing panel 211 of the sidelite 204 is surrounded on the either side by sidelite stiles 204*b*, on the top by sidelite top rail 204*e*, and on the bottom by sidelite bottom rail 204*d*.

FIGS. 27 and 28 shows the door opening being defined by sidelite stiles 204*b* directly surrounding the door 205. The outermost of the sidelite stiles 204*b* on the outward-facing sides of the glazing panels 211 define the outside of the frame of the door opening and there is no need for separate vertical jambs. A header 212 spans the length of the entire door opening and is supported by the sidelite stiles 204*b* of the sidelites 204. The header 212 frames the top of the glazing panels 211 of the sidelites 204 while the sidelite bottom rails 204*d* frame the bottom of the glazing panels 211. The glazing panel 211 of the door 205 is surrounded on the top by a door top rail 205*e*, on the bottom by a door bottom rail 205*d*, and on the sides by door stiles 205*b*. When closed, the door stiles 205*b* and the door bottom rail 205*d* engage the sill backstop 201*a*. Referring to FIG. 27, the bottom of the sidelite stiles 204*b* and the sidelite bottom rail 204*d* are supported by the sill decks 202.

FIGS. 31 and 32 shows a doorway that includes the door opening and a sidelite 204 on right-hand side of the door opening. The door opening and the sidelite 204 are under a header 212 and are supported by a mull post 215 and the sidelite stiles 204*b*. The glazing panel 211 of the sidelite 204 is surrounded by the header 212 on the top, and the sidelite bottom rail 204*d* on the bottom, and the sidelite stiles 204*b* on either side. The door opening is defined by the mull post 215 on the left and the sidelite stile 204*b* on the right. To the left of the mull post 215, the top of the sidelite stiles 204*b* and the sidelite top rail 204*e* act as their own header. The glazing panels on the sidelites 204 are surrounded by the sidelite top rail 204*e* on the top, the sidelite bottom rail 204*d* on the bottom, and the sidelite stiles 204*b* on the vertical edges. The glazing panel 211 of the door 205 is surrounded on the top by a door top rail 205*e*, on the bottom by a door bottom rail 205*d*, and on the sides by door stiles 205*b*. When closed, the door stiles 205*b* and the door bottom rail 205*d* engage the sill backstop 201*a*. Referring to FIG. 31, the bottom of the sidelite stiles 204*b*, the mull post 215, and the sidelite bottom rail 204*d* are supported by the sill decks 202.

The construction of the sill assemblies 100, 200, 300 illustrated in FIGS. 1-13, 14-43, and 44-67, respectively can all be adapted to any of the configurations shown, as well as various other configurations. Since the number of sill decks, their length, and the length of the sill bodies is not limited, a wide range of configurations can be realized. Here are several examples. The sill assembly 200 of FIGS. 29 and 30 can be extended on the right-hand side to accommodate more sidelites. Alternatively, the sill assembly could be reversed so two of the sidelites 204 of FIG. 31 would be on the right-hand side with one of the sidelites 204 of FIG. 31 being on the left-hand side. The portion of the sill body 201 not covered by the sill decks 202 can be extended to accommodate one or more pairs of French doors. The sill decks 202 can extend across the entire sill body to accommodate only sidelites 204 in order to form a window wall. Virtually any number of sill decks 202 can be used.

FIGS. 44-67, and 69 illustrate an example of a continuous sill for use with an inswing door and one or more sidelites. The sill assembly 300 of FIGS. 57-67, and 69, includes alignment portions 302*d* (shown in FIGS. 57-63, 65, 66, and 69) for aligning and securing sidelites and vertical jambs. The sill assemblies 300 of FIGS. 44-56 do not include alignment portions. Referring to FIGS. 44-50, 53-55, 57-63, 65-67, and 69 the sill assembly 300 includes two main portions: The sill body 301 and one or more of the sill decks 302. The sill decks 302 are illustrated extending from the back of the sill body 301 to the front lengthwise edge of the sill body 301. The sill body 301 acts as threshold for the door 305 (see FIGS. 51, 52, 55, and 67) and together with the end dams 303 (FIGS. 44-49, 51, 52, 56-62) act as sill pan. The sill decks 302 are mounted and secured over the sill body 301 and provide horizontal surfaces 302*b* (FIGS. 44-47, 49, 50, 53, 54, 57-60, 62, 63, 65, 66, and 69) for the bottom surfaces of the sidelites 304 (FIGS. 54, 66, and 69) and the bottom surfaces of the vertical jambs 310 (FIGS. 53 and 65) to mount against.

Figure 51:
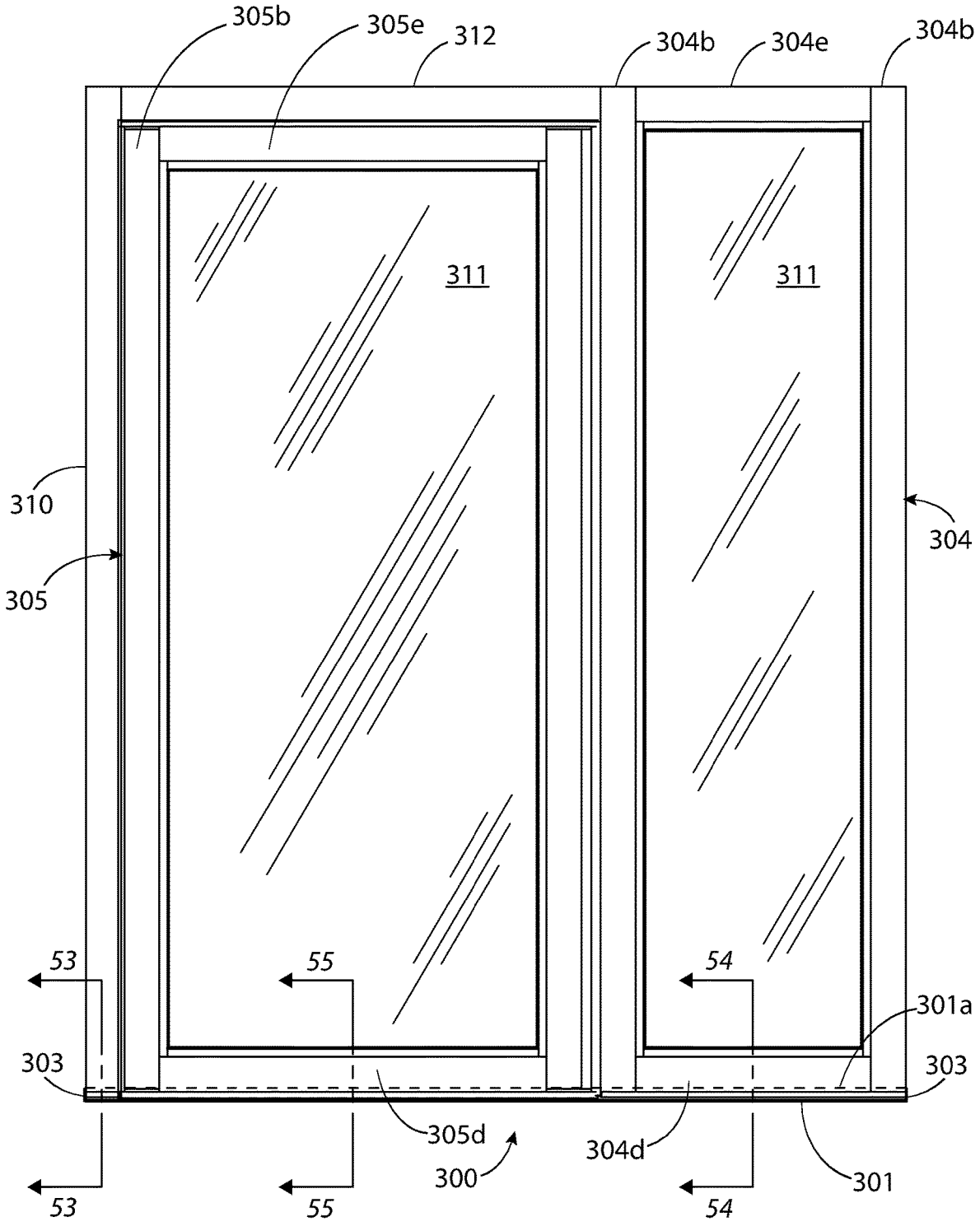
FIG. 51 illustrates a front view of a doorway assembly including an inswing door, sidelite, and incorporating the continuous sill of FIG. 44.
Figure 52:
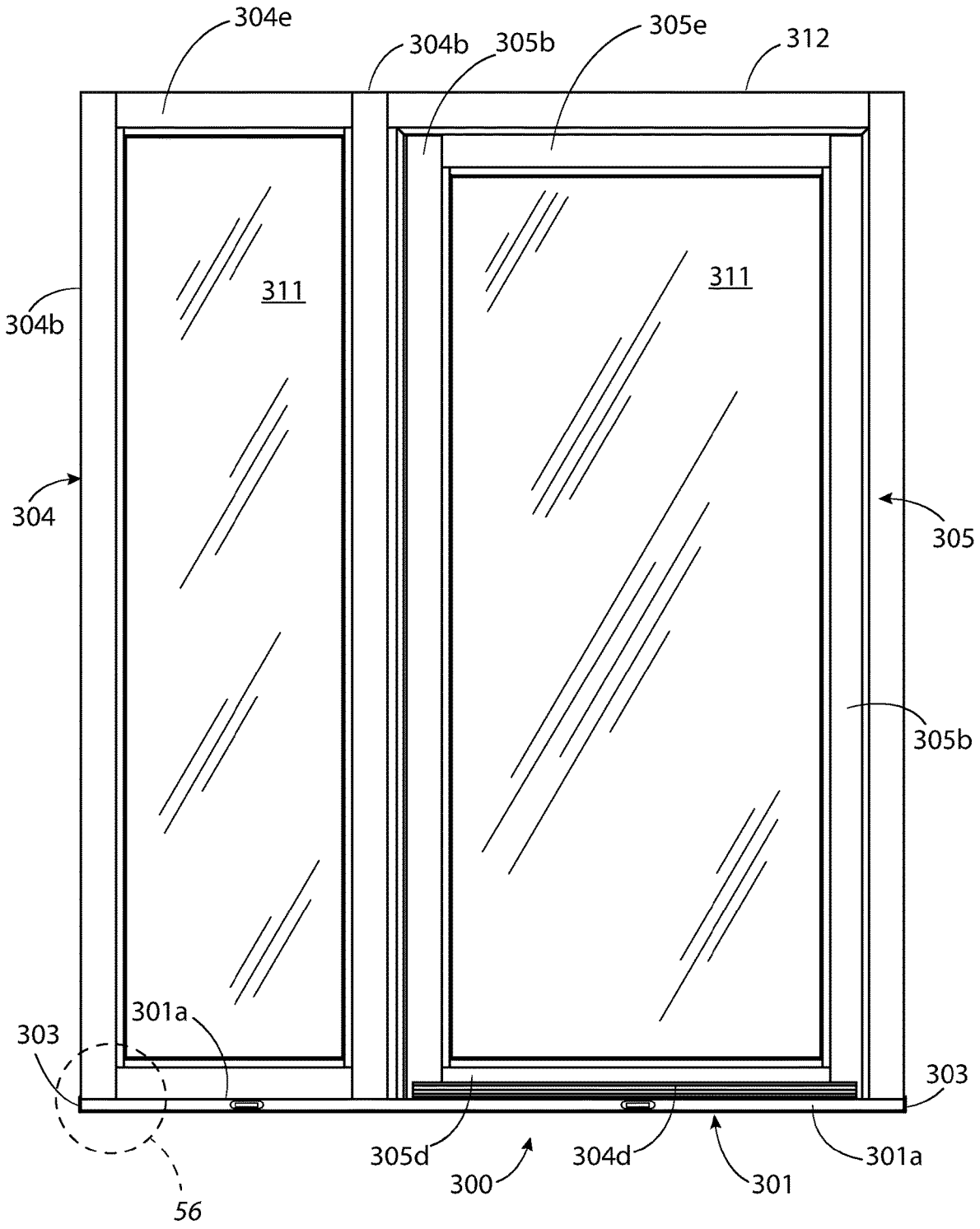
FIG. 52 illustrates a rear view of the doorway assembly of FIG. 51.
Figure 53:
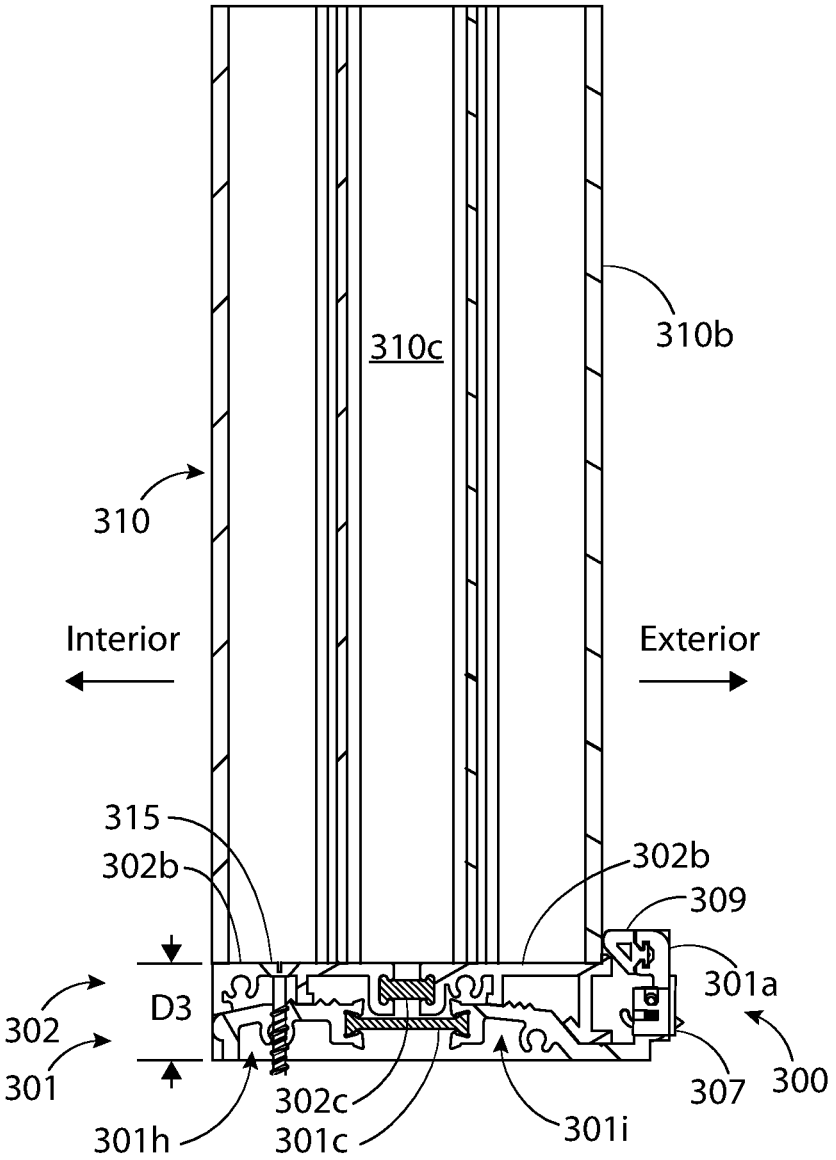
FIG. 53 illustrates a section view of the doorway assembly of FIG. 51 taken along section lines 53-53.
Figure 55:
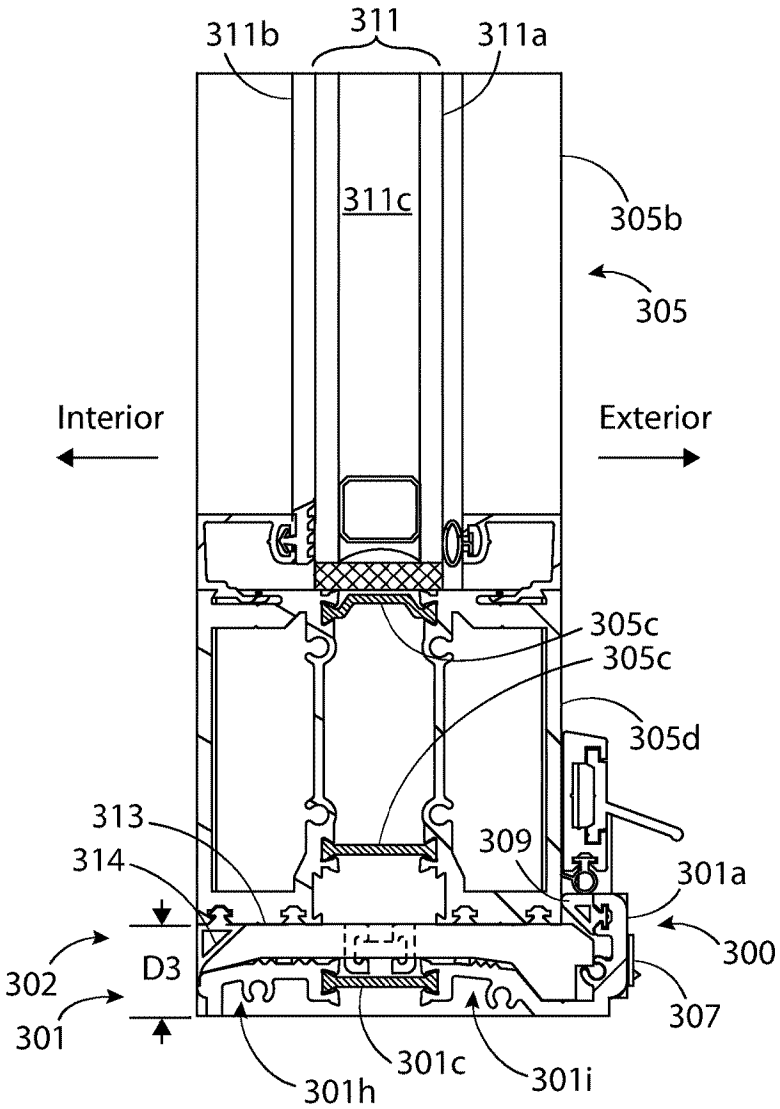
FIG. 55 illustrates a section view of the doorway assembly of FIG. 51 taken along section lines 55-55.
Figure 65:
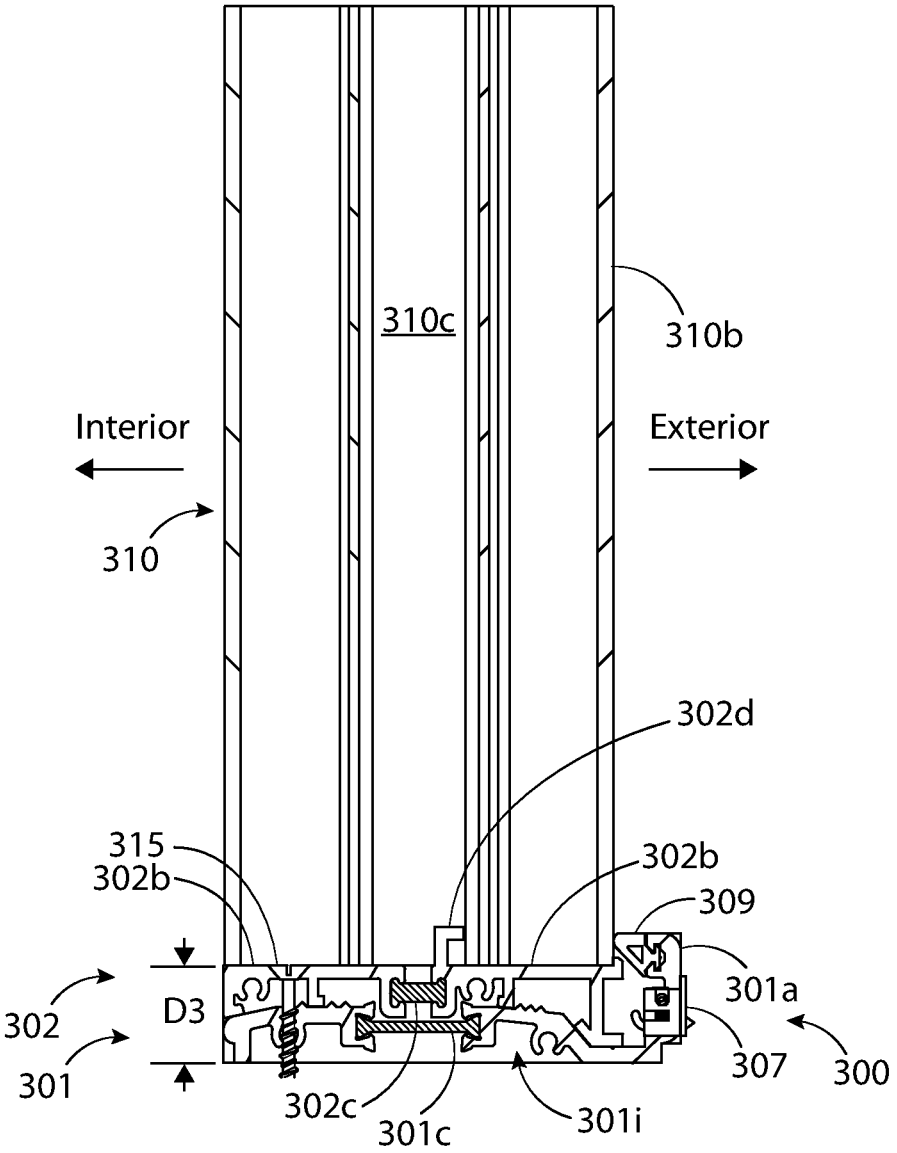
FIG. 65 illustrates an alternative section view of the doorway assembly of FIG. 51 taken along section lines 53-53 and utilizing the continuous sill of FIG. 57.
Figure 67:
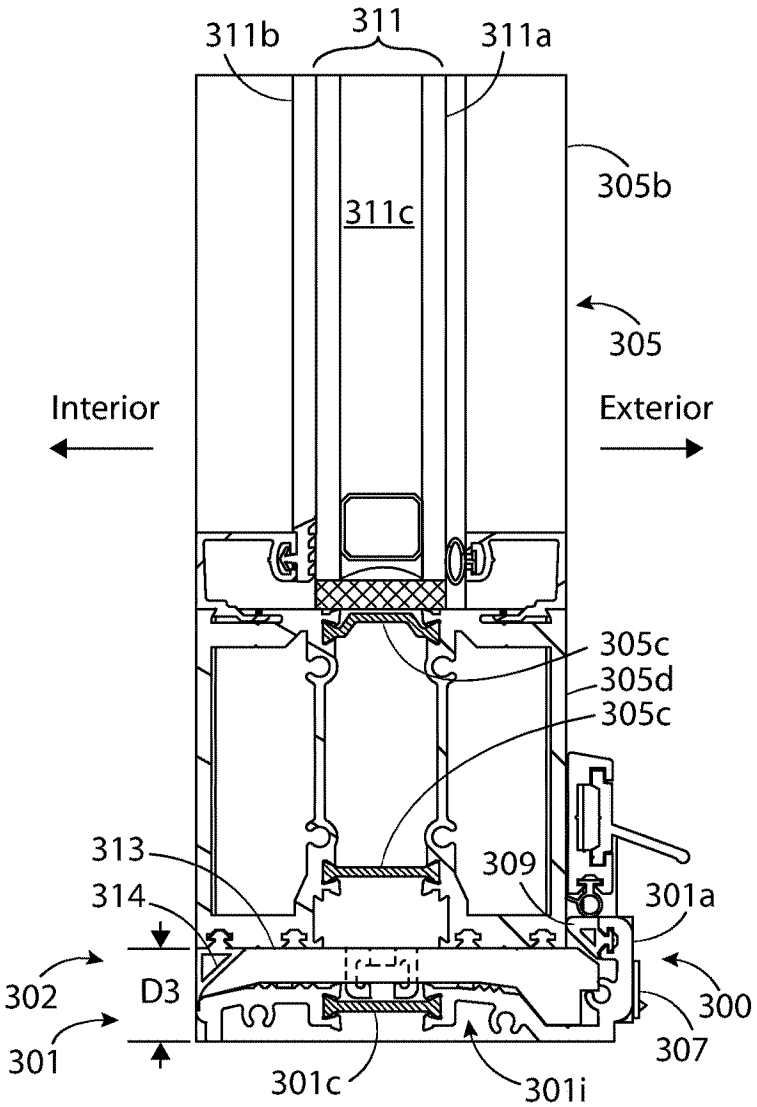
FIG. 67 illustrates an alternative section view of the doorway assembly of FIG. 51 taken along section lines 54-54 and utilizing the continuous sill of FIG. 57.

Referring to FIGS. 53, 54, 65, 66, and 69, the sill decks 302 raises the sidelite 304 (FIGS. 54, 66, and 69) and vertical jamb 310 (FIGS. 53 and 65) a distance D3 above the floor level. Referring to FIGS. 51, 52, 55, and 67, the door 305 closes directly over the sill body 301. Referring to FIGS. 55 and 67, the bottom of the door bottom rail 305*d* sits above the floor level a distance D3 allowing clearance for the door to swing. Referring to FIGS. 53-55, 65-67, and 69 this arrangement aligns the bottom lengthwise edge of the sidelite bottom rail 304*d* (FIGS. 54, 66, and 69), the bottom lengthwise edge of the door bottom rail 305*d* (FIGS. 55 and 67), and the bottom lengthwise edge of the vertical jamb 310 (FIGS. 53 and 65). Referring to FIGS. 55 and 67, the sill deck covers 313 are behind the door 305. The door sweep 314 provides weather sealing from the outside elements. The weep flap 307 facing the exterior environment, allows accumulated water to drain to the outside.

Figure 54:
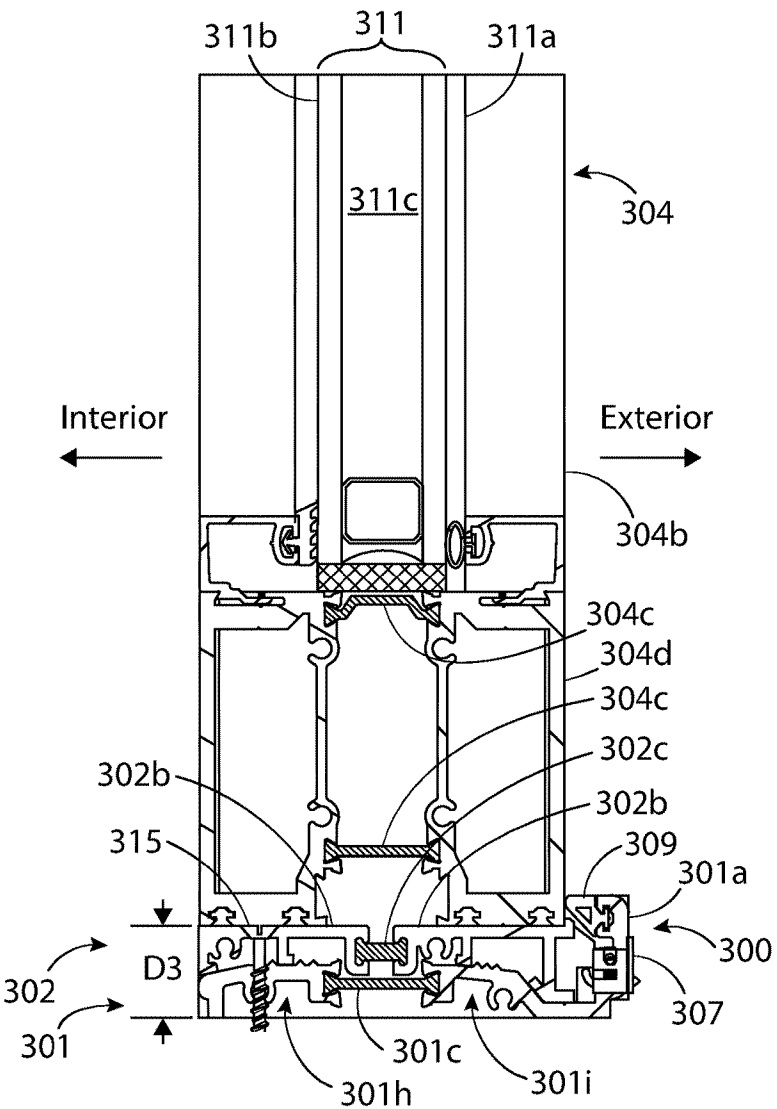
FIG. 54 illustrates a section view of the doorway assembly of FIG. 51 taken along section lines 54-54.
Figure 56:
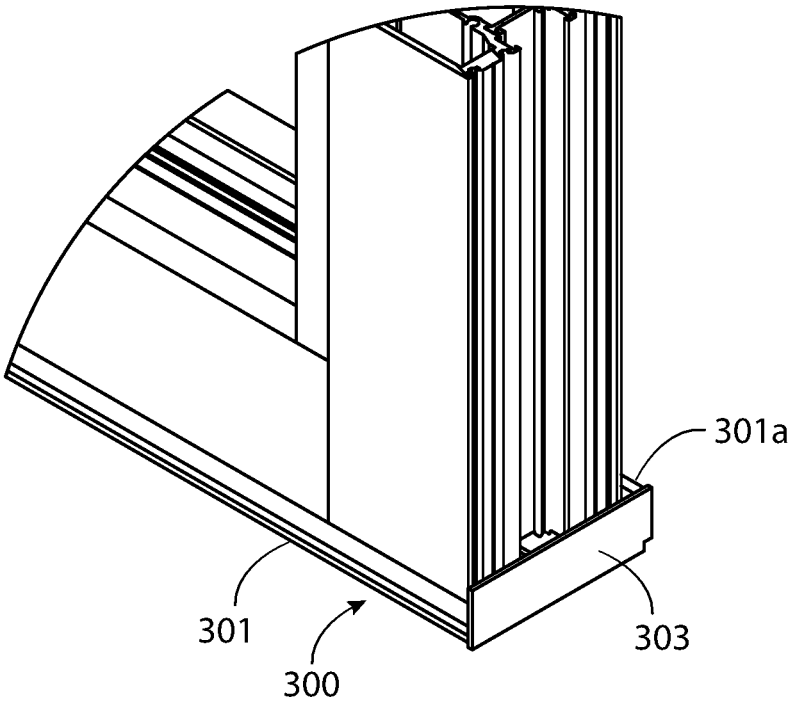
FIG. 56 illustrates a detail view of the doorway assembly of FIG. 52, enlarged for magnification purposes.
Figure 57:
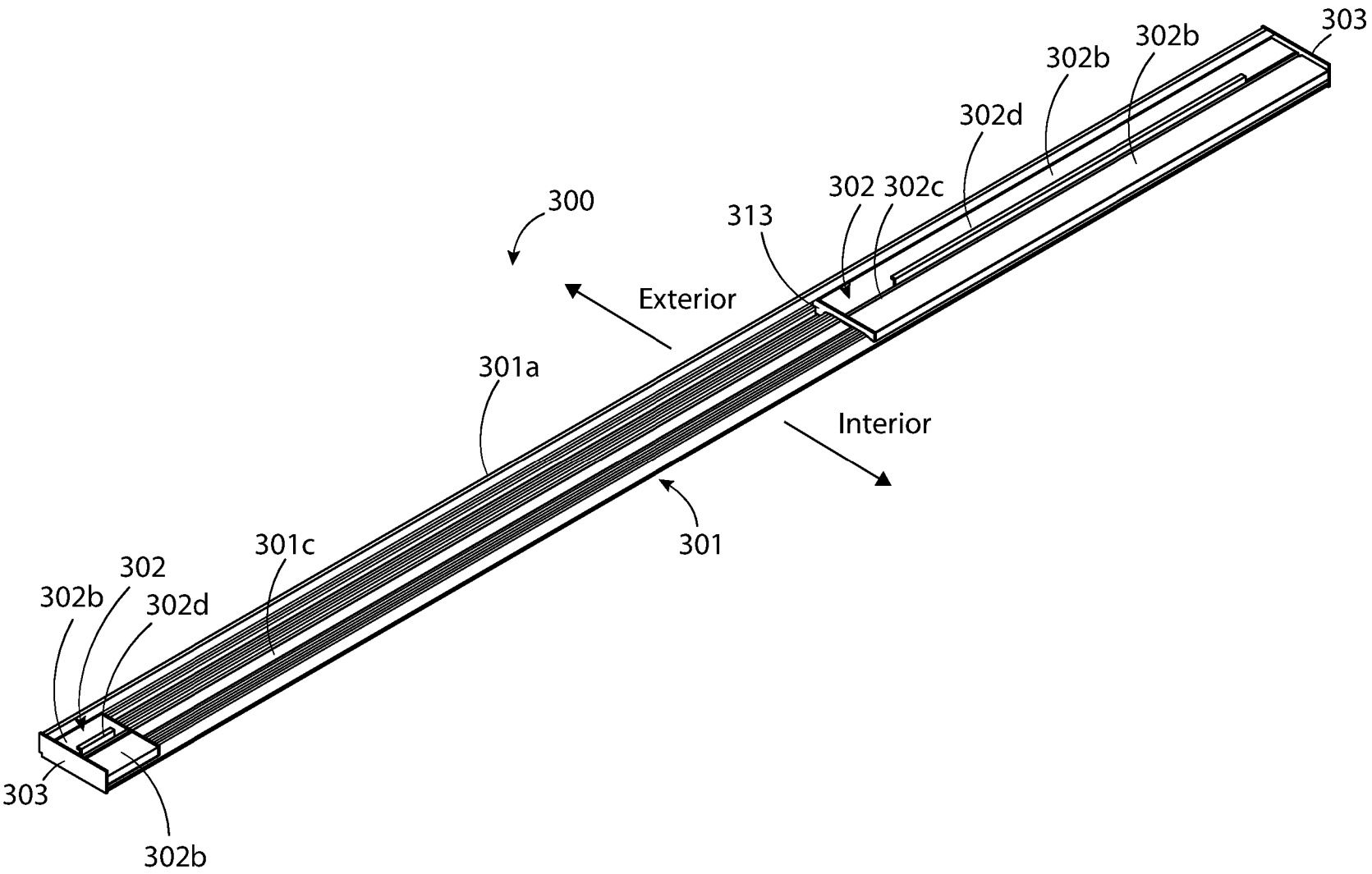
FIG. 57 illustrates a continuous sill, similar to the continuous sill of FIG. 44, in front perspective view, with the addition of alignment portion brackets for aligning and securing the sidelites and door jambs.
Figure 58:
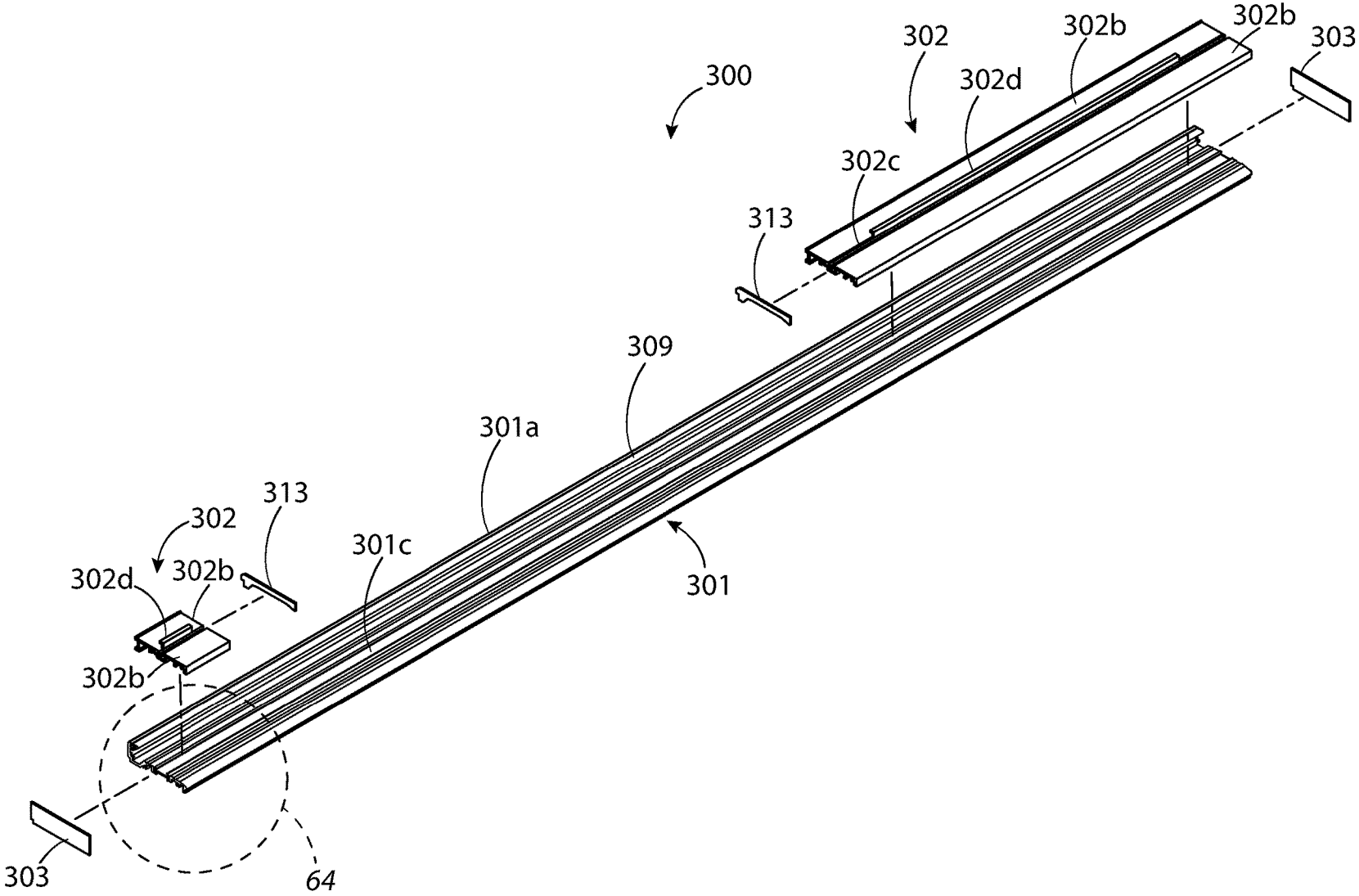
FIG. 58 illustrates the continuous sill of FIG. 57 in exploded perspective view.
Figure 59:
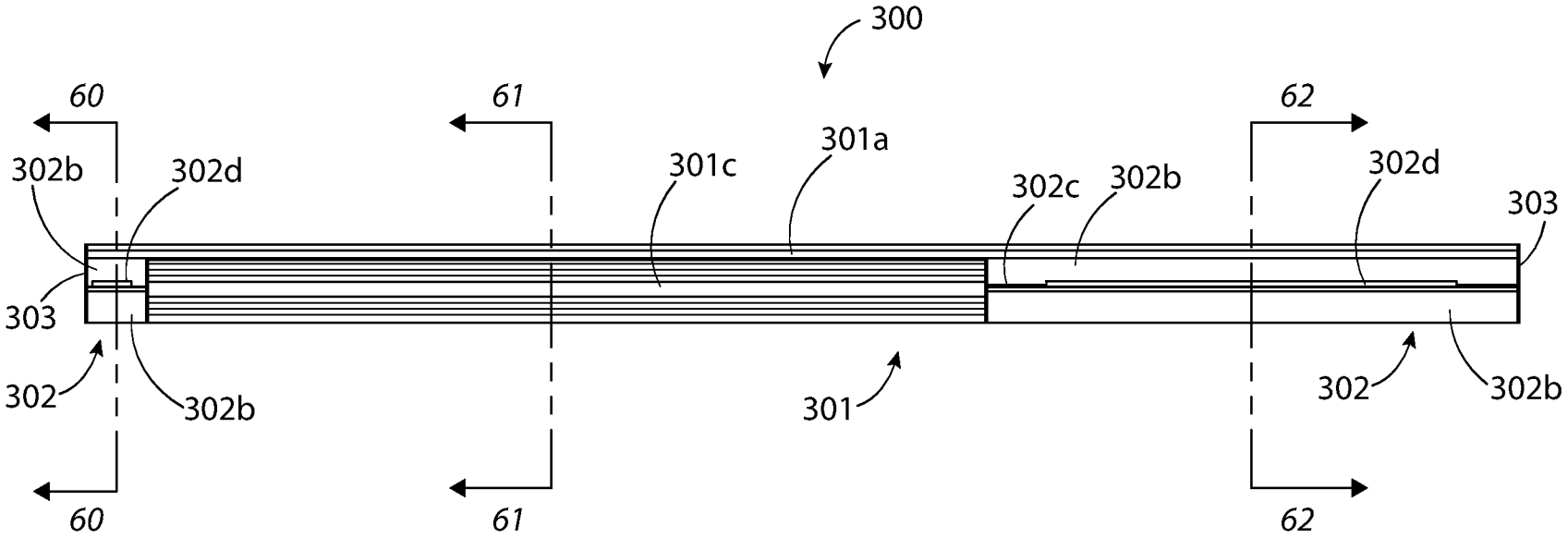
FIG. 59 illustrates a top view of the continuous sill of FIG. 57.
Figure 60:
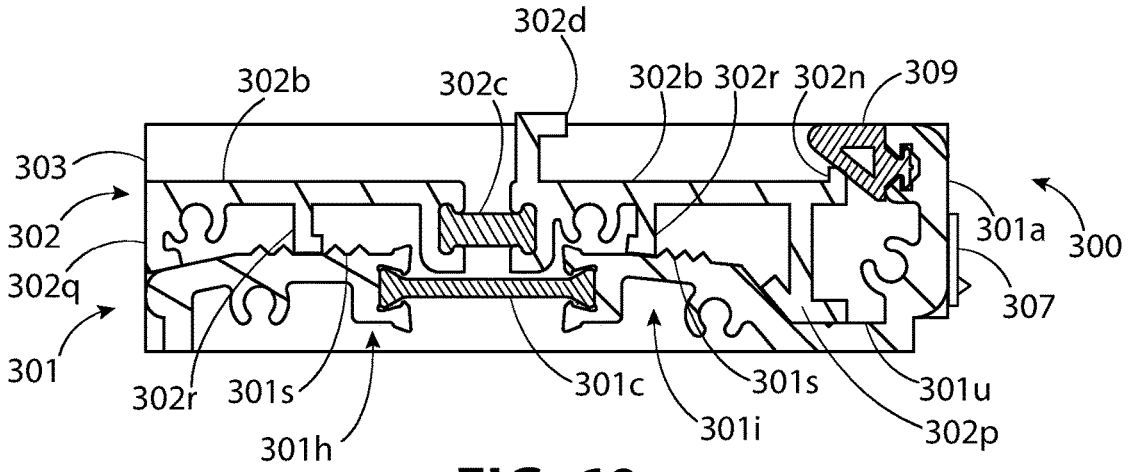
FIG. 60 illustrates a section view of the continuous sill of FIG. 59 taken along section lines 60-60.
Figure 61:
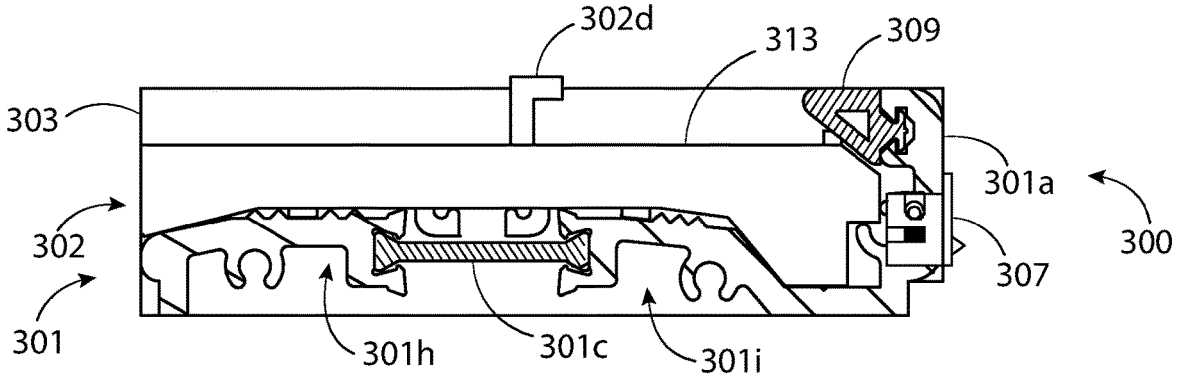
FIG. 61 illustrates a section view of the continuous sill of FIG. 59 taken along section lines 61-61.
Figure 62:
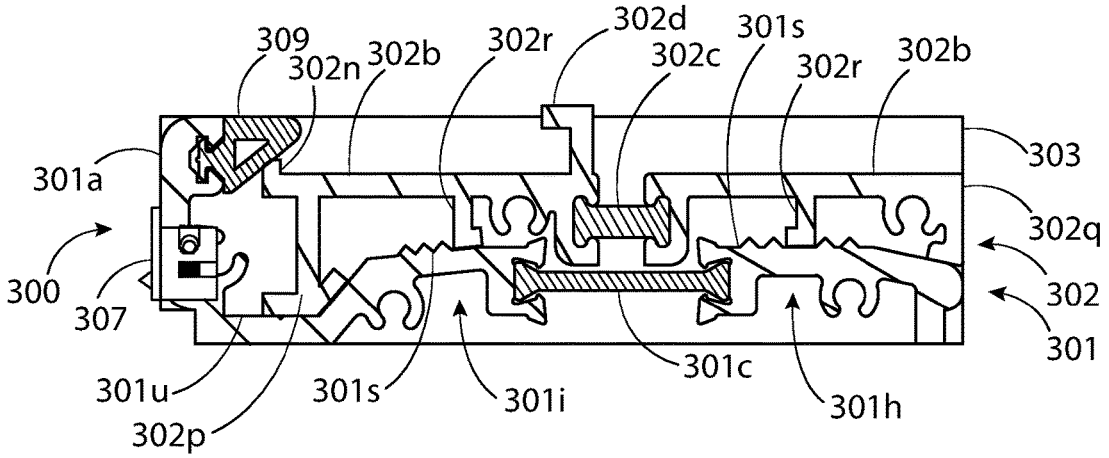
FIG. 62 illustrates a section view of the continuous sill of FIG. 59 taken along section lines 62-62.
Figure 66:
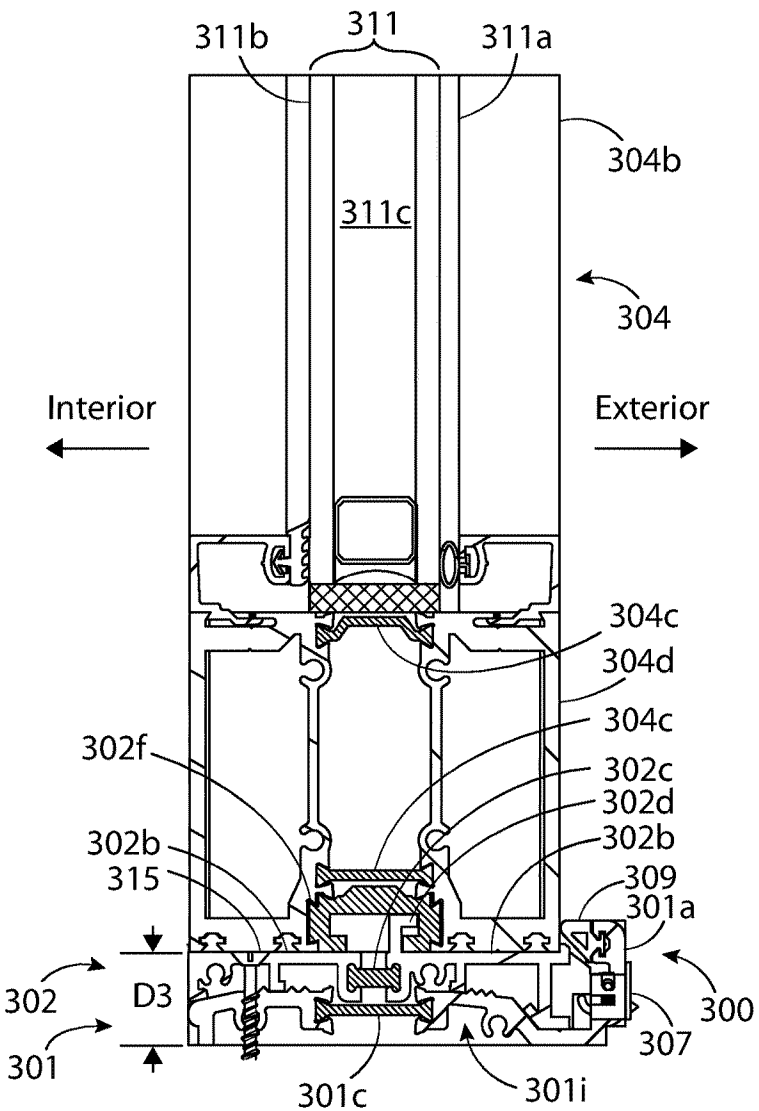
FIG. 66 illustrates an alternative section view of the doorway assembly of FIG. 51 taken along section lines 55-55 and utilizing the continuous sill of FIG. 57.
Figure 69:
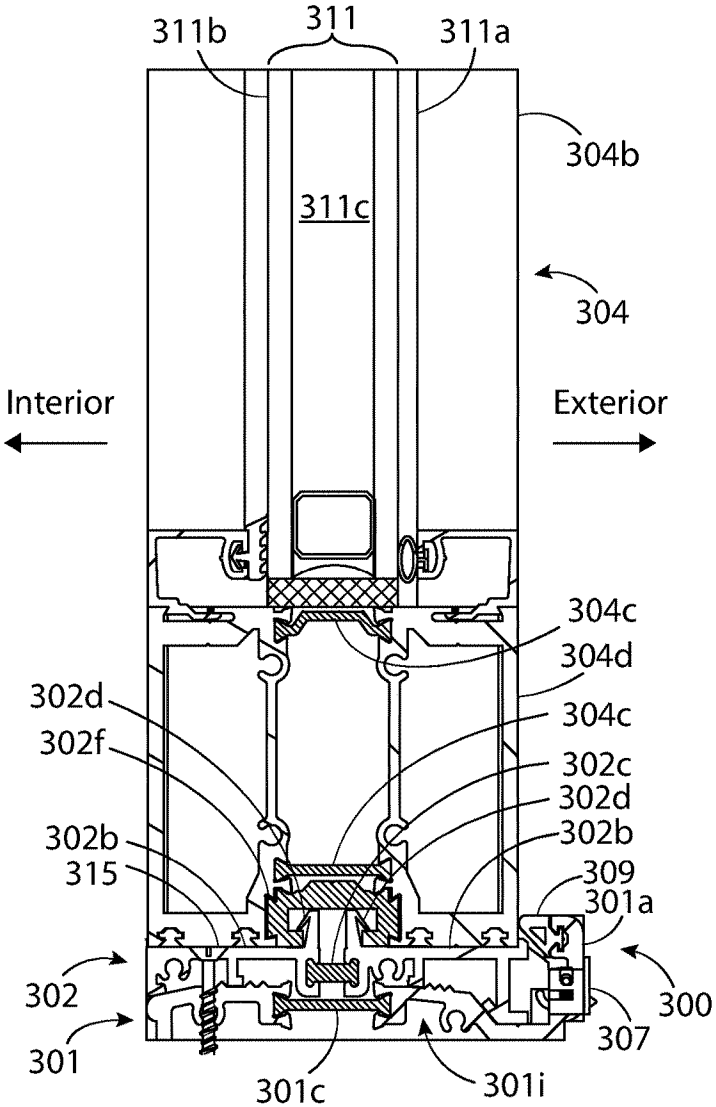
FIG. 69 illustrates an alternative version of the section view of FIG. 66 with an alternative version of the alignment portions.

Referring to FIGS. 54, 66, and 69, the thermal breaks 301*c*, 302*c* of the sill body 301 and the sill decks 302, respectively, can align, as illustrated, under the thermal break 304*c* of the sidelite 304. Referring to FIGS. 53 and 65, the thermal breaks 301*c*, 302*c* of the sill body 301 and the sill decks 302, respectively, can align, as illustrated, under hollow cavity 310*c* between thermal breaks (not shown) of the vertical jamb 310. Referring to FIGS. 55 and 67, in the closed position, the thermal breaks 301*c* of the sill body 301 can be aligned, as illustrated, under the thermal breaks 305*c* of the door 305. By the alignment described above, the inside-facing side of the door 305, the vertical jamb 310, the sidelite 304, sill body 301, and sill decks 302 can be thermally isolated from the exterior environment. Referring to FIGS. 54, 55, 66, 67, and 69, this includes the glazing panels 311 which are illustrated as an IGU. The glazing panels 311 can include a first glass panel 311*a* and a second glass panel 311*b* separated by a cavity 311*c* filled with either air or gas.

Figure 63:
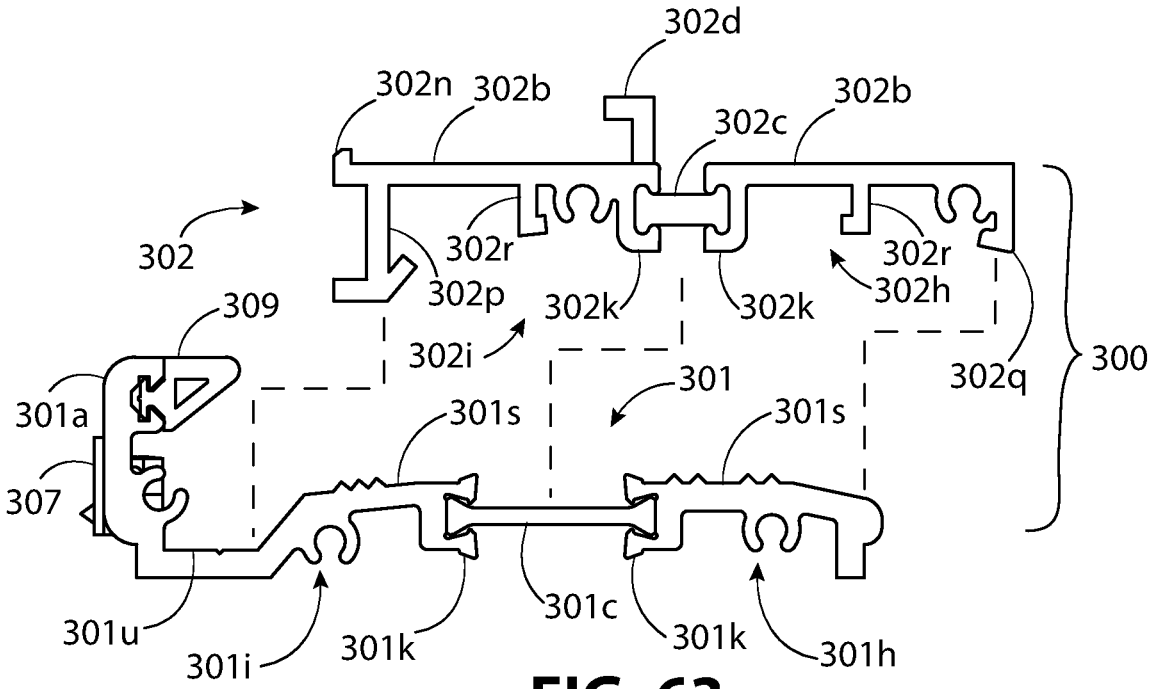
FIG. 63 illustrates an exploded side view of the continuous sill of FIG. 57.
Figure 64:
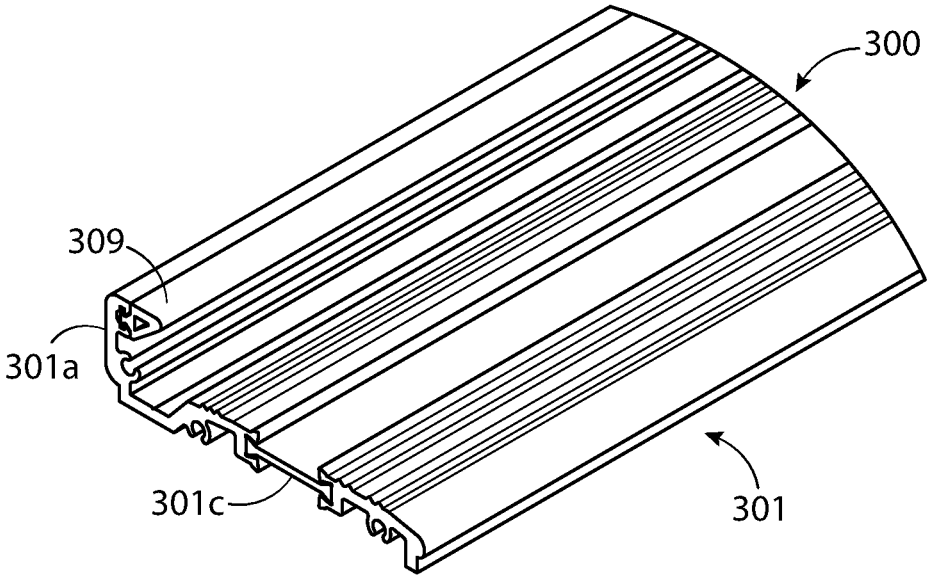
FIG. 64 illustrates a detail view of the continuous sill of FIG. 58, enlarged for magnification purposes.

Referring to FIGS. 54, 66, and 69, seal 309 helps to create an air-tight seal between the sill backstop 301*a* and the sidelite 304. As previously described, the seal is typically a silicone sealant, but can also be other watertight sealants such as an adhesive sealant tape. Referring to FIGS. 45, 47-49, 50, 53-55, 58, and 60-67, and 69, the seal 309 can run either continuously, or in sections, across the sill backstop 301*a* in its entirety. This allows the seal 309 to create an air seal across the sidelite 304 (FIGS. 54, 66, and 69), the door 305 (FIGS. 55 and 67), and the vertical jamb 310 (FIGS. 53 and 65). Referring to FIGS. 53-55, 65-67, and 69, the rear surfaces of the sidelite stiles 304*b* and sidelite bottom rail 304*d* (FIGS. 54, 66, and 69), the door stiles 305*b* and door bottom rail 305*d* (FIGS. 55 and 67), and the vertical jamb 310 (FIGS. 53 and 65) are all aligned against the sill backstop 301*a*, via the seal 309, in the same plane. If the sidelite stiles 304*b*, sidelite bottom rail 304*d*, door stiles 305*b*, door bottom rail 305*d*, and the vertical jamb 310 are all the same thickness, then their front surfaces would also lie in the same plane, which could be aesthetically desirable. Referring to FIGS. 65, 66, and 69, the alignment portion 302*d* can align the sidelite 304 (FIGS. 66 and 69) and the vertical jamb 310 (FIG. 65) against the sill backstop 301*a* in the same plane. Referring to FIGS. 54, 66, and 69, the alignment portion 302*d* can also align the thermal break 302*c* of the sill decks 302 with the thermal breaks 304*c* and the cavity 311*c* of the glazing panels 311. Referring to FIG. 66, the alignment portion 302*d* can also help secure the sidelite 304 to the sill decks 302 by a receiver 304*f* fitted within the sidelite 304. Here the receiver 304*f* is shown as a gasket fitted within a euro groove of the sidelite 304. However, the receiver 304*f* can be an integrally formed portion of the sidelite 304 or could be the euro groove itself. Referring to FIG. 63, the alignment portion 202*d* can be L-shaped with the stem of the alignment portion 302*d* extending upward from the horizontal surface 302*b* of the sill decks 302. The arm of the alignment portion 302*d* extends toward the sill backstop 301*a* of the sill body 301 as illustrated. In FIG. 63, the stem of the alignment portion 302*d* extends vertically upward from the horizontal surface 302*b* and the arm of the alignment portion 302*d* extends perpendicularly away from stem of the alignment portion 302*d* and horizontally toward the sill backstop 301*a*. The alignment portion 302*d* is shown as being integrally formed with the sill decks 302. However, the alignment portion 302*d* can be rigidly secured to the alignment portion by welding, adhesive, rivets, threaded fasteners or any other method of securing that creates a rigid bond capable of withstanding the forces encountered for a given installation. As previously discussed, while the alignment portion 302*d* is shown as L shaped, it can be any shape capable of engaging the receiver 304*f* and aligning the sidelite 304. For example, the alignment portion 302*d* can be a simple upward projection where it could align the sidelite 304, allow it to slide, but would not be captively slidable as in the case of other shapes, for example an L-shaped bracket or a T-shaped bracket. The receiver 304*f* may optionally be shaped to captively and slidably engaging the receiver 304*f*. While not illustrated, the vertical jamb 310 of FIG. 65 can include a receiver that receives and engages the alignment portions 302*d* similar to that described for FIG. 66 or could include a portion that is sized and shaped to engage the alignment portion 302*d* in a similar manner as the receiver 304*f* of FIG. 66.

Referring to FIG. 69, the alignment portions 302*d* may optionally snap into the receiver 304*f*, directly into the euro groove, or directly into a portion of the sidelite 304 sized and shaped engage the alignment portions 302*d* and snap them in place. In FIG. 69, the sill deck 302 includes two of the alignment portions 302*d*. Each of the alignment portions 302*d* is illustrated as barbed or hooked. The upper part is angled downward and thinner than the main stem allowing it to flex. The upper portions of the alignment portions 302*d* project downward away from each other. This arrangement allows the sidelite 304 to be pressed downward against the receiver 302*f* and snap into place. As the sidelite 304 is pressed downward, the upper part of the alignment portions flex inward, allowing the alignment portions 302*d* to pass through the opening in the alignment portion. Once the alignment portions 302*d* pass through the opening and the pressure is release from the upper portions of the alignment portion 302*d*, the upper portions well expand out to their resting position as illustrated thereby securing the sidelite 304 to the sill deck 302. The alignment portion 302*d* and the receiver 302*f* of FIG. 69 can be similarly applied to the vertical jamb 310 of FIG. 65. The receiver 302*f* can be a separate member as illustrated in FIG. 69, or could be a portion of the vertical jamb sized and shaped to engage the receiver and snap it in place.

Figure 50:
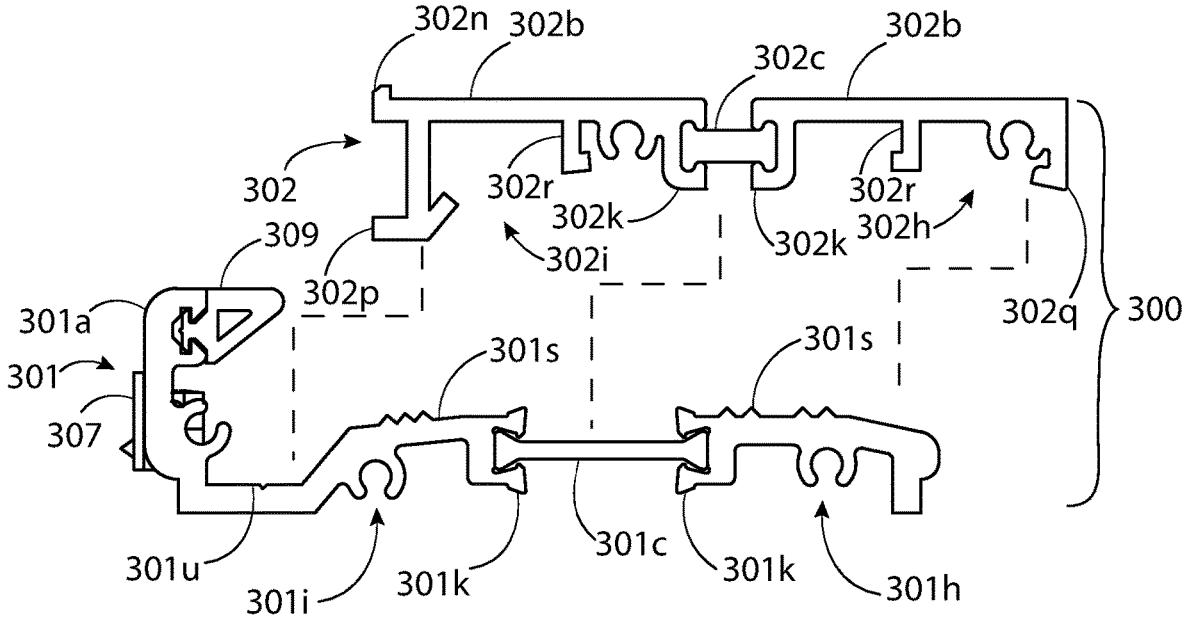
FIG. 50 illustrates an exploded side view of the sill of FIG. 44 with the end dam removed for clarity.

Referring to FIGS. 47, 49, 50, 60, 62, and 63, the sill decks 302 mounts to the sill body 301 as follows. The sill decks 302 include a sill deck backstop 302*n* projecting upwardly at the end of the rear sill deck portion 302*i* (FIGS. 50 and 63). The sill deck backstop 302*n* can project perpendicularly upward from the rear sill deck portion 302*i*, as illustrated in order to align sidelites 304 of FIGS. 54 and 66 and the vertical jambs 310 of FIGS. 53 and 65. A first mounting portion 302*p* projects downwardly away from the end of the rear sill deck portion 302*i* and rests against the drain channel 301*u*. The front sill deck portion 302*h* and the rear sill deck portion 302*i* each include a mounting portion 302*r* that projects downward from their respective bottom surfaces. Each of the mounting portions 302*r* includes a foot that planarly engages the top surfaces 301*s* of respective front sill portion 301*h* and rear sill portion 301*i* of the sill body 301. The front surface 302*q* of the sill deck 302 rests against the sill body 301. Referring to FIGS. 65, 66, and 69, the sill deck 302 can be fastened to the sill body 301 by a threaded fastener 315. The threaded fastener 315 can be any threaded fastener suitable for holding the sill deck to the sill and be able to withstand typical forces experienced by vertical jambs, mull posts, and sidelites as appropriate. Referring to FIGS. 47, 49, 50, 60, 62, and 63, one of the advantages of the sill assembly 300 is that the threaded fastener 315 of FIGS. 65, 66, and 69 is positioned entirely over the rear sill portion between the first mounting portion 302*p* and the mounting portion 302*r* of the rear sill deck portion 302*i* (FIGS. 50 and 63). This isolates any potential water leakage through the threaded fastener 315 to the environmentally exposed side of the sill assembly 300. Any water leaking through the threaded fastener 315, would roll down the top surface 301*s* of the rear sill portion 301*i* and drain out of the weep flap 307, on the sill backstop 301*a*.

Referring to FIGS. 50 and 63, the sill body 301 can include a front sill portion 301*h* and a rear sill portion 301*i* joined together by a thermal break 301*c*. The thermal break thermally isolates the front sill portion 301*h* from the rear sill portion 301*i*. The thermal strut is made of a thermally insulative material such as polyamide, as in the previous examples, is illustrated as a thermal strut. The thermal break 301*c* is also shown in FIGS. 44-50, 53-55, and 57-67, and 69. Continuing with FIGS. 50 and 63, the thermal breaks 301*c* can be crimped into grooves 301*k* in the front sill portion 301*h* and the rear sill portion 301*i* by large crimping rollers as previously described. This can create a watertight seal across the front sill portion 301*h* and the rear sill portion 301*i*. Silicone or other waterproof sealant can be placed along the lengthwise seams of the thermal break 301*c* to enhance water tightness. The sill backstop 301*a* extends directly upward from the rear sill portion 301*i* of the sill body 301 and defines the back portion of the sill body 301. The rear sill portion 301*i* and the sill backstop 301*a* are integral and have a unibody construction. Typically, this is accomplished by extrusion for a sill body made of aluminum. The sill backstop 301*a* is also shown in FIGS. 44-51, 53-67, and 69. Referring to FIGS. 50 and 63, the unibody construction assures that the inward-facing surface of the sill backstop 301*a* in combination with the rear sill portion 301*i* are sealed and waterproof. The sill body 301 in combination with the end dams 303 shown in FIGS. 44-49, 56-62 can create a watertight barrier with respect to surrounding wall structure and allows the sill body 301 to act both as a door threshold and a sill pan.

Referring to FIGS. 44-47, 49, 50, 53, 54, 57-60, 62, 63, 65, 66, and 69, the thermal breaks 302*c* thermally break the sill decks 302 between the front sill deck portion 302*h* and the rear sill deck portion 302*i*. The front sill deck portion 302*h* and the rear sill deck portion 302*i* are shown in FIGS. 50, and 63. Referring to FIGS. 50 and 63, the thermal break 302*c* can be crimped into grooves 302*k* in the front sill deck portion 302*h* and the rear sill deck portion 302*i* by large crimping rollers as previously described creating a watertight seal across the front sill deck portion 302*h* and the rear sill deck portion 302*i*. As previously described, silicone or other waterproof sealant can be placed also the lengthwise seams of the thermal break 302*c* to enhance water tightness.

Referring to FIGS. 44, 45, 48, 55, 57, 58, 61, and 67, sill deck covers 313 are attached to the sides of the sill decks 302. The sill deck covers 313 facing the door openings create a finished appearance for the side of the sill assembly 300. The sill deck covers 313 also contain any water run-off from the top of the sill decks 302 to within the sill body 301 under the sill decks 302. Referring to FIGS. 53, 54, 65, 66, and 69, the sidelites 304 (FIGS. 54 and 66) and the vertical jamb 310 (FIGS. 53 and 65) can be placed directly on the horizontal surfaces 302*b* of their respective 302 sill decks. They can also be placed with waterproofing silicone or a water-resistant gasket which would reduce the risk of water infiltration onto the sill decks 302. Referring to FIGS. 47-50, 53-55, 60-63, 65-67, and 69, a weep flap 307, or alternatively a weep hole, can optionally be positioned through the backstop of the sill body 301. The top surface 301*s* of the rear sill portion 301*i* are angled downward toward the rear of the sill body 301. Any water that might accumulate on the sill decks 302 and leak through to the sill body 301 via seal 309 would tend to flow to the front of the sill body 301, into the drain channel 301*u* (FIGS. 47, 49, 50, 60, 62, 63) and drain out the weep flaps 307.

Referring to FIGS. 51 and 52, the doorway shown is configured similarly to the doorway of FIGS. 21 and 22 with the top of the frame of the doorway including the sidelite top rail 304*e*, header 312, top of the sidelite stiles 304*b*, and top of the vertical jamb 310. Glazing panel 311 of the door 305 is surrounded on either side by door stiles 305*b*, on the top by door top rail 305*e*, and on the bottom by door bottom rail 305*d*. Glazing panel 311 of the sidelite 304 is surrounded on the either side by sidelite stiles 304*b*, on the top by sidelite top rail 304*e*, and on the bottom by sidelite bottom rail 304*d*.

The preceding paragraphs described a doorway that includes a novel sill assembly. It is not the intent of this disclosure to limit the claimed invention to the examples, variations, and exemplary embodiments described in the Description or other sections of this Specification. Those skilled in the art will recognize that variations will occur when embodying the claimed invention in specific implementations and environments. For example, while all of the examples show a combination of one or more sidelites and one or more doors, it is possible to implement each of the examples with only fixed glazing, (i.e., no door). For example, a window wall. For example, for the sill assembly 100 of FIGS. 1-13, a series of spacers 107 and spacer block 108 can be placed across the entire sill body so that two or more are located under each fixed glazing structure. The fixed glazing structures can be constructed similar to the sidelite 104 of FIGS. 7-10, and 70. Similarly, the sill decks 202 can extend across the entirety of the sill assembly 200 of FIGS. 14-43, and 68, and the sill deck 302 can extend across the entirety of the sill assembly 300 of FIGS. 44-67, and 69 to accommodate a window wall. As in the example above, the fixed glazing of the window wall can be constructed similarly to the sidelites 204, 304.

The examples of FIGS. 1-71 illustrate typical installations with one door and one or more sidelites. It is well within the scope of this disclosure to include additional doors, French doors, or a wall of French doors. For the sill assembly 100 of FIGS. 1-13, 70, and 71, the French doors can be mounted directly over the sill body 101 as with a single swing door. The vertical jambs and optional astragal can be mounted directly to the sill body 101. Similarly, in FIGS. 14-69, the French doors can be mounted directly over the sill body 201, 301. The vertical jambs and optional astragal can be mounted over sill decks 202, 302.

The sill body 101 of FIGS. 1-13, 70, and 71, the sill body 201 and sill decks 202 of FIGS. 14-43, and 68, and the sill body 301 and sill deck 302 of FIGS. 44-67, and 69, are shown as thermally broken. This is often desirable when these components are extruded, cast, or otherwise formed from a thermally conductive material, such as aluminum or steel, especially in colder climates. The inventor envisions that the sill bodies 101, 201, 301 and sill decks 202, 302 could continuous and not thermally broken. For example, the components could be molded, extruded or otherwise formed from a material with low thermal conductivity such as high impact plastics, fiberglass, compost, or vinyl. Alternatively, the components could be extruded, cast, or otherwise formed from a thermally conductive material such as aluminum or steel for installations where thermal isolation is not important. For example, within an enclosed shopping mall. Referring to FIGS. 1-6, 10-12, 70, and 71, the horizontal surfaces 101*b* separated by a thermal break 101*c* could instead be continuous from front to back instead of being thermal broken. In the context of a shopping mall or other applications within a protected environment, and inswing door would open from the general environment into a specific area, such as a store or office. An outswing door would open from the specific area into the general environment. Referring to FIGS. 14-17, 19, 20, 23, 25, 29, 30, 33-37, 39, 42, 43, and 68, the horizontal surfaces 202*b* separated by thermal breaks 202*c* could instead be continuous from front to back. Referring to FIGS. 17-20, 23-25, 36-39, 41-43, and 68, the front sill portion 201*h* and the rear sill portion 201*i* separated by thermal breaks 201*c* could also be continuous from front to back instead of being thermally broken. Referring to FIGS. 44-47, 49, 50, 53-54, 57-60, 62, 63, 65, 66 and 69, the horizontal surfaces 302*b* separated by thermal breaks 302*c* could instead be continuous from front to back. Referring to FIGS. 47-50, 53-55, 60-62, and 63, front sill portion 301*h* and the rear sill portion 301*i* separated by thermal breaks 301*c* could also be continuous from front to back instead of being thermally broken.

While separate flashing is often not required, the installer may opt to install additional flashing or self-sealing waterproof adhesive membrane if they deem necessary or if required by local building codes. Installing additional flashing or self-sealing waterproof adhesive membrane is well within the scope of the sills of this disclosure.

Throughout this disclosure, the infill panel has been illustrated as glazing panels. For example, the glazing panel 111 of FIGS. 7-11, and 70 glazing panel 211 of FIGS. 21-24, 27, 28, 31, 32, 41, 42, and 68, and glazing panel 311 of FIGS. 51, 52, 54, 55, 66, 67, and 69. The inventor envisions that some of this can be readily substituted with solid infill panels such as composite or wood and remain within the spirit of the inventive concept.

It is possible to implement certain features described in separate embodiments in combination within a single embodiment. Similarly, it is possible to implement certain features described in single embodiments either separately or in combination in multiple embodiments. For example, the sill assembly 100 of FIGS. 1-13 can incorporate the alignment portion 202*d* of FIGS. 33-39, 42, and 43 or the alignment portion 302*d* of FIGS. 57-63 and 65, 66, and 69. The inventor envisions that this and other variations fall within the scope of the claimed invention. Just as the alignment portions 302*d* of FIG. 69 could be replace the alignment portions 302*d* of FIGS. 65 and 66 by following the explanation for FIG. 69, the alignment portions 302*d* of FIG. 69 could similarly replace the alignment portion 202*d* of FIGS. 42 and 43. This could allow the sidelite 204 to snap into place against the sill deck 202. Similarly this could allow the vertical jamb 210 to snap into place against the sill deck 202.

While the examples, exemplary embodiments, and variations are helpful to those skilled in the art in understanding the claimed invention, it should be understood that, the scope of the claimed invention is defined solely by the following claims and their equivalents.

What is claimed is:

1. A sill assembly for a door, a sidelite, a vertical door frame member, comprising:

a sill body extending continuously under the door, the sidelite, and the vertical door frame member;

the sill body including a sill backstop, the sill backstop extending across an entire length of the sill body, defining a lengthwise back edge of the sill body, and extending vertically upward from the sill body sufficiently to face vertically disposed rear surfaces of the sidelite, the door, and the vertical door frame member; and the sill body and the sill backstop are stop sized, shaped, and positioned to allow the vertically disposed rear surfaces of the sidelite, the door, and the vertical door frame member to together planarly align against the sill backstop.

2. The sill assembly of claim 1 wherein the sill assembly includes horizontal surfaces for seating the sidelite and the vertical door frame member.

3. The sill assembly of claim 1 wherein the vertically disposed rear surfaces of the sidelite and the vertical door frame member are secured to the sill backstop.

4. The sill assembly of claim 1, further comprising:

a first end dam and a second end dam positioned over opposing ends of the sill body and comprising a water-tight barrier between the sill body and a surrounding wall opening.

5. The sill assembly of claim 1, wherein:

the sill body includes a thermal break; and corresponding thermal breaks in the door and sidelites align over the thermal break of the sill body.

6. The sill assembly of claim 1, wherein the sill assembly is sized, shaped, and arranged so that bottom lengthwise edges of the door, the sidelite, and the vertical door frame member are linearly aligned.

7. The sill assembly of claim 1, further including:

a first sill deck, positioned over the sill body and extending from the sill backstop to a front lengthwise edge of the sill body, the first sill deck includes a first horizontal surface and the sidelite seated on the first horizontal surface;

a second sill deck, positioned over the sill body and extending from the sill backstop to the front lengthwise edge of the sill body, the second sill deck includes a second horizontal surface and the vertical door frame member seated on the second horizontal surface; and the sill backstop extends upwardly from the first sill deck and the second sill deck.

8. The sill assembly of claim 7, wherein bottom lengthwise edges of the door, the sidelite, and the vertical door frame member are planarly aligned.

9. The sill assembly of claim 7, further including:

a first alignment portion extending secured to and extending upward from the first sill deck;

a receiver positioned within the sidelite; and the first alignment portion captively engages the receiver, the receiver in combination with the first alignment portion aligns the sidelite over the first sill deck and against the sill backstop.

10. The sill assembly of claim 7 wherein the sidelite and the vertical door frame member are secured to the sill backstop.

11. The sill assembly of claim 1, wherein the sill body includes a horizontal surface extending outward along a top portion of the sill body and faces bottom surfaces of the door, the sidelite, and the vertical door frame member, with the sill backstop extending upward above the horizontal surface.

12. The sill assembly of claim 11, wherein the vertically disposed rear surfaces of the sidelite and the vertical door frame member are secured to the sill backstop and the bottom surfaces of the sidelite and the vertical door frame member are secured to the horizontal surface.

13. The sill assembly of claim 1, further including:

a sill deck, positioned over the sill body and extending from the sill backstop to a front lengthwise edge of the sill body, the sill deck includes a horizontal surface extending outward along a top portion of the sill body, with the sill backstop extending upward above the horizontal surface.

14. The sill assembly of claim 13, wherein the vertically disposed rear surfaces of the sidelite and the vertical door frame member are secured to the sill backstop.

15. A sill assembly for a door, a sidelite, a vertical door frame member, comprising:

a sill body extending continuously under the door, the sidelite, and the vertical door frame member;

the sill body including a sill backstop extending vertically upward from the sill body and across an entire length of the sill body, the sill backstop defining a lengthwise back edge of the sill body with rear surfaces of the sidelite, the door, and the vertical door frame member planarly align against the sill backstop;

a first sill deck, positioned over the sill body and extending from the sill backstop to a front lengthwise edge of the sill body, the first sill deck includes a first horizontal surface and the sidelite seated on the first horizontal surface;

a second sill deck, positioned over the sill body and extending from the sill backstop to the front lengthwise edge of the sill body, the second sill deck includes a second horizontal surface and the vertical door frame member seated on the second horizontal surface; and the sill body includes a first thermal break and the first sill deck includes a second thermal break with corresponding thermal breaks in the door and sidelites align over the first thermal break and the second thermal break.

16. The sill assembly of claim 15, further including:

a first alignment portion extending secured to and extending upward from the first sill deck;

a receiver positioned within the sidelite; and the first alignment portion captively engages the receiver, the receiver in combination with the first alignment portion aligns the sidelite over the first sill deck and against the sill backstop.

17. The sill assembly of claim 16, further including:

a second alignment portion secured to and extending upward from the second sill deck and into the vertical door frame member; and the second alignment portion aligns the vertical door frame member over the second sill deck and against the sill backstop.

18. A sill assembly for a door, a sidelite, a vertical door frame member, comprising:

a sill body extending continuously under the door, the sidelite, and the vertical door frame member;

the sill body including a sill backstop extending vertically upward from the sill body and across an entire length of the sill body, the sill backstop defining a lengthwise back edge of the sill body;

rear surfaces of the sidelite, the door, and the vertical door frame member planarly align against the sill backstop;

a first sill deck, positioned over the sill body and extending from the sill backstop to a front lengthwise edge of the sill body, the first sill deck includes a first horizontal surface and the sidelite seated on the first horizontal surface;

a second sill deck, positioned over the sill body and extending from the sill backstop to the front lengthwise edge of the sill body, the second sill deck includes a second horizontal surface and the vertical door frame member seated on the second horizontal surface;

a first alignment portion extending secured to and extending upward from the first sill deck;

a receiver positioned within the sidelite, the first alignment portion captively engages the receiver, the receiver in combination with the first alignment portion aligns the sidelite over the first sill deck and against the sill backstop;

a second alignment portion secured to and extending upward from the second sill deck and into the vertical door frame member; and the second alignment portion aligns the vertical door frame member over the second sill deck and against the sill backstop.

19. A sill assembly for a door, a sidelite, a vertical door frame member, comprising:

a sill body extending continuously under the door, the sidelite, and the vertical door frame member;

the sill body including a sill backstop, the sill backstop extending vertically upward from the sill body, extending across an entire length of the sill body, defining a lengthwise back edge of the sill body, and including an front-facing surface extending sufficiently upward from the sill body to face vertically disposed rear surfaces of the sidelite, the door, and the vertical door frame member; and the sill body and back stop sized, shaped, and positioned to allow the vertically disposed rear surfaces of the sidelite, the door, and the vertical door frame member to together planarly align against the front-facing surface of the sill backstop.

20. The sill assembly of claim 19, wherein the sill assembly is sized, shaped, and arranged so that bottom lengthwise edges of the door, the sidelite, and the vertical door frame member are linearly aligned.

* * * * *